US011700954B2

(12) United States Patent
Fosse et al.

(10) Patent No.: US 11,700,954 B2
(45) **Date of Patent: *Jul. 18, 2023**

(54) CHILD CARRYING SYSTEM WITH ADAPTABLE HEAD SUPPORT

(71) Applicant: Lalabu LLC, Statham, GA (US)

(72) Inventors: Brian Fosse, Bend, OR (US); Mirona Motoc, Seattle, WA (US)

(73) Assignee: Lalabu LLC, Stillwater, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/838,836

(22) Filed: Jun. 13, 2022

(65) Prior Publication Data

US 2022/0304480 A1 Sep. 29, 2022

Related U.S. Application Data

(63) Continuation of application No. 17/501,949, filed on Oct. 14, 2021, now Pat. No. 11,357,339.

(60) Provisional application No. 63/092,836, filed on Oct. 16, 2020.

(51) Int. Cl.
*A47D 13/02* (2006.01)

(52) U.S. Cl.
CPC ..... *A47D 13/025* (2013.01)

(58) Field of Classification Search
CPC ..... A47D 13/02; A47D 13/025
USPC ..... 224/158–160
See application file for complete search history.

(56) References Cited

U.S. PATENT DOCUMENTS 4,139,131 A * 2/1979 Hathaway ..... A47D 13/025 224/160
4,149,687 A 4/1979 Nunemacher
4,428,514 A * 1/1984 Elf ..... A47D 13/025 297/118
4,449,253 A 5/1984 Hettinger
4,467,945 A 8/1984 Schaapveld
(Continued)

FOREIGN PATENT DOCUMENTS

CN 101426456 A 5/2009
GB 4021063 8/2012
(Continued)

OTHER PUBLICATIONS

Final Office Action, dated Jan. 8, 2019, from corresponding U.S. Appl. No. 15/861,546.
(Continued)

*Primary Examiner* — Adam J Waggenspack
(74) *Attorney, Agent, or Firm* — Brient IP Law, LLC

(57) ABSTRACT

A child carrying system for carrying a child includes a carrier portion having a top portion; a middle portion having a pair of tabs extending away from a center of the middle portion in a lateral direction; a pair of adjustment mechanisms, each adjustment mechanism fixedly attached to a respective tab of the pair of tabs; and a bottom portion. The child carrying system also includes a pair of straps, each strap having a first end and a second end. Each first end is fixedly attached proximate a respective top corner of the top portion. Each second end is detachably connected to an adjustment mechanism of the pair of adjustment mechanisms. A width of each strap of the pair of straps is wider than a conventional shoulder strap on a backpack.

20 Claims, 61 Drawing Sheets

(56) References Cited

U.S. PATENT DOCUMENTS 4,469,259 A * 9/1984 Krich ..... A47D 13/025 224/159
4,602,390 A 7/1986 Morera et al.
5,205,450 A 4/1993 Derosier
5,246,152 A 9/1993 Dotseth
5,547,461 A 8/1996 Levis
5,732,861 A 3/1998 Jakobson
5,766,114 A 6/1998 Campbell
5,799,851 A 9/1998 Wulf et al.
5,813,580 A 9/1998 Fair
5,845,967 A * 12/1998 Kane ..... B60N 2/2881 297/229
5,848,741 A 12/1998 Fair
6,179,187 B1 1/2001 Lemire et al.
6,240,564 B1 6/2001 Te Kanawa
6,409,060 B2 6/2002 Donine
6,460,746 B1 10/2002 Amram
6,598,771 B2 7/2003 Norman
6,666,361 B1 12/2003 Lin
6,776,317 B1 8/2004 Parker
6,836,902 B2 1/2005 Marquez et al.
7,204,002 B2 4/2007 Kaneko et al.
7,322,498 B2 1/2008 Frost
7,356,850 B2 4/2008 Turcotte et al.
7,484,645 B2 2/2009 Hoff et al.
7,494,031 B2 * 2/2009 Kassai ..... A47D 13/02 224/159
7,574,750 B2 8/2009 Harris
D615,749 S 5/2010 Wagner
7,780,587 B2 8/2010 Thornton et al.
7,819,831 B2 10/2010 Dellanno
7,886,946 B2 2/2011 Gray
7,971,273 B2 7/2011 Grilliot et al.
8,028,871 B2 10/2011 Gray
8,267,290 B2 9/2012 Schlipper
8,272,507 B1 9/2012 Crump et al.
8,363,181 B2 1/2013 Nasu et al.
8,393,505 B2 3/2013 Coote
8,490,844 B2 7/2013 Favorito et al.
8,567,652 B2 10/2013 Di Stasio et al.
8,656,516 B1 2/2014 Reinhardt Rawlings et al.
8,973,794 B2 3/2015 Bergkvist et al.
9,017,226 B2 4/2015 Nash
9,038,868 B2 5/2015 Poiani
D738,614 S 9/2015 Chapman
D738,615 S 9/2015 Chapman
9,119,484 B2 9/2015 Hyppolite
9,185,993 B2 11/2015 Telford et al.
9,277,830 B2 3/2016 Schachtner
9,357,852 B2 6/2016 Salazar et al.
9,380,886 B2 7/2016 Rahni
9,439,516 B2 * 9/2016 Workman ..... A47D 13/025
9,498,007 B2 11/2016 Rizk
9,521,912 B2 12/2016 Yen
9,545,159 B2 1/2017 Wang
9,629,477 B2 4/2017 Tagle
9,750,352 B2 9/2017 Harris
9,848,713 B2 12/2017 Rosen et al.
9,949,575 B2 4/2018 Pond et al.
9,955,797 B2 5/2018 Telford et al.
10,045,634 B2 8/2018 Salazar et al.
10,172,437 B2 1/2019 Barber
10,264,894 B2 4/2019 Gibbons
10,441,091 B2 10/2019 Salazar et al.
D877,490 S 3/2020 Daws
10,694,867 B2 6/2020 Troutman et al.
10,750,879 B2 * 8/2020 Schachtner ..... A47D 13/025
11,191,368 B2 12/2021 Manouchehri et al.
2003/0172430 A1 9/2003 Jarrett
2003/0173150 A1 9/2003 Sharp
2004/0065708 A1 4/2004 Amram
2004/0149790 A1 8/2004 Kassai et al.
2005/0045674 A1 3/2005 Rehbein
2007/0029356 A1 2/2007 Moriguchi et al.
2007/0125815 A1 6/2007 Tong
2007/0254129 A1 11/2007 Horblitt
2008/0185409 A1 8/2008 Kellenberger
2009/0206116 A1 8/2009 Grant
2009/0302075 A1 12/2009 Trainer
2010/0147910 A1 6/2010 Schachtner
2010/0155446 A1 * 6/2010 Stein ..... A47D 13/025 224/159
2011/0062195 A1 3/2011 Jones et al.
2011/0185477 A1 8/2011 Olenicoff
2011/0240693 A1 * 10/2011 Parness ..... A47D 13/025 224/160
2012/0152987 A1 6/2012 Beltrame et al.
2012/0199619 A1 * 8/2012 Zack ..... A47D 13/025 224/160
2013/0240590 A1 9/2013 Montgomery
2014/0084037 A1 3/2014 Hartwell
2014/0319189 A1 10/2014 Hoppener-Visser
2014/0361055 A1 12/2014 Myers
2015/0101108 A1 4/2015 Wallace
2015/0181953 A1 7/2015 Brown
2015/0201761 A1 7/2015 Wollenberg
2016/0150893 A1 6/2016 Salazar et al.
2016/0198865 A1 7/2016 Houston
2016/0206115 A1 7/2016 Brake et al.
2016/0345750 A1 12/2016 Workman
2017/0119173 A1 5/2017 Telford
2018/0116426 A1 5/2018 Telford
2018/0125124 A1 5/2018 Jylkka-Tesler
2018/0184813 A1 7/2018 Salazar et al.
2018/0206653 A1 7/2018 Andrus et al.
2019/0014920 A1 1/2019 Matsuyama
2019/0038044 A1 2/2019 Cummings
2019/0075939 A1 3/2019 Plested et al.
2019/0125100 A1 5/2019 Rothwell
2019/0216232 A1 7/2019 Kee et al.
2019/0246811 A1 8/2019 Wiley
2019/0380508 A1 12/2019 Telford
2020/0229615 A1 * 7/2020 Cummings ..... A45F 3/14
2021/0186234 A1 6/2021 Majima et al.

FOREIGN PATENT DOCUMENTS

IL 57723 11/2017
JP 3787778 B2 6/2006
WO D083120-001 3/2014
WO 2017200451 A1 11/2017

OTHER PUBLICATIONS

Final Office Action, dated Oct. 30, 2019, from corresponding U.S. Appl. No. 15/861,546.
International Search Report, dated Feb. 7, 2020, from corresponding International Application No. PCT/US2019/054466.
Invitation to Pay Additional Fees, dated Dec. 12, 2019, from corresponding International Application No. PCT/US19/54466.
Notice of Allowance, dated Jan. 21, 2020, from corresponding U.S. Appl. No. 15/861,546.
Notice of Allowance, dated Jan. 31, 2022, from corresponding U.S. Appl. No. 17/501,949.
Notice of Allowance, dated Jul. 12, 2022, from corresponding U.S. Appl. No. 29/755,075.
Notice of Allowance, dated Mar. 13, 2020, from corresponding U.S. Appl. No. 16/591,284.
Office Action, dated Jul. 15, 2019, from corresponding U.S. Appl. No. 15/861,546.
Office Action, dated Jun. 13, 2022, from corresponding U.S. Appl. No. 29/755,075.
Office Action, dated Jun. 22, 2018, from corresponding U.S. Appl. No. 15/861,546.
Office Action, dated Jun. 27, 2018, from corresponding U.S. Appl. No. 15/861,512.
Office Action, dated Nov. 26, 2019, from corresponding U.S. Appl. No. 16/591,284.
Restriction Requirement, dated Feb. 28, 2018, from corresponding U.S. Appl. No. 15/861,546.

(56) References Cited

OTHER PUBLICATIONS

Restriction Requirement, dated Mar. 1, 2018, from corresponding U.S. Appl. No. 15/861,512.
Written Opinion of the International Searching Authority, dated Feb. 7, 2020, from corresponding International Application No. PCT/US2019/054466.
Amazon.ca, Site visited Jun. 2, 2022, Baba Wrap Baby Carrier, First available Jul. 30, 2012, https://www.amazon.ca/Boba-Baby-Wrap-Carrier-Grey/dp/B005S P2 L WW (Year: 2012).
Amazon.ca, Site visited Jun. 6, 2022, Koala Babycare Baby Sling, First available May 25, 2020, https://www.amazon.ca/Koala-Babycare-Easy-Adjustable-Unisex/dp/B07G85PQ5J (Year: 2020).
Nordstrom .com, Site visited Jun. 6, 2022, Solly Baby Baby Wrap, oldest review Dec. 9, 2018, https ://www.nordstrom.com/s/solly-baby-baby-wrap/5101912 (Year: 2018).
YouTube.com, Site visited Jun. 6, 2022, "How to Use Caboo Lite Carrier," published Jan. 25, 2017 features the Caboo Lite, https://www.youtube.com/watch?v=BB5-trpLVHk (Year: 2017).
International Search Report, dated Feb. 28, 2022, from corresponding International Application No. PCT/US2021/055088.
Written Opinion of the International Searching Authority, dated Feb. 28, 2022, from corresponding International Application No. PCT/US2021/055088.

* cited by examiner

CHILD CARRYING SYSTEM WITH ADAPTABLE HEAD SUPPORT

CROSS-REFERENCE TO RELATED APPLICATION

This application is a continuation of U.S. patent application Ser. No. 17/501,949, filed Oct. 14, 2021, which claims priority to U.S. Provisional Patent Application Ser. No. 63/092,836, filed Oct. 16, 2020, the disclosures of which are hereby incorporated by reference in their entirety.

BACKGROUND

Wearable child carriers for carrying a baby or child are often designed for carrying the child on either the front or the back of a person, without the versatility of doing both. Carriers often have bulky components like shoulder straps that are padded similar to a hiking backpack in an effort to increase comfort for the user. However, such padding can be bulky and cumbersome, often resulting in a large carrier that is difficult to carry or stow when not in use with a child.

Moreover, providing head support is important for infants and sleeping children, but less important with older children. Most conventional carriers are specifically designed either for infants requiring head support or for older children who do not require head support. If a conventional carrier has a removable head support, the head support is often bulky, which again creates a carrier that is not compact for carrying or stowage when not in use. Various embodiments of the present child carrying system recognize and address the foregoing considerations, and others, of prior art devices.

SUMMARY OF THE INVENTION

A child carrying system according to various embodiments is configured to be worn by a person to enable the person to carry a child. The child carrying system includes: a carrier portion comprising: a top portion; a middle portion having a pair of tabs extending away from a center of the middle portion in a lateral direction; a pair of adjustment mechanisms, each adjustment mechanism fixedly attached to a respective tab of the pair of tabs; and a bottom portion. The child carrying system also includes a pair of straps, each strap having a first end and a second end, wherein: each first end is fixedly attached proximate a respective top corner of the top portion; each second end is detachably connected to an adjustment mechanism of the pair of adjustment mechanisms; and a width of each strap of the pair of straps is wider than a conventional shoulder strap on a backpack.

In further embodiments, a child carrying system includes a carrier portion; a first strap and a second strap both fixedly attached to the carrier portion; a first adjustment mechanism and a second adjustment mechanism both fixedly attached to the carrier portion; and a waist belt. The child carrying system is adapted to be donned by a user by: adjusting the carrier portion based on the child's size by wrapping the carrier portion around the waist belt; wrapping the waist belt around the user's waist; buckling the waist belt at the user's back; securing the first strap to the first adjustment mechanism, the first adjustment mechanism being on an opposite side of the carrier portion in a lateral direction from an attachment point of the first strap; securing the second strap to the second adjustment mechanism, the second adjustment mechanism being on an opposite side of the carrier portion in the lateral direction from an attachment point of the second strap; lifting the first strap and the second strap over the user's head; inserting a first arm of the user between the first strap and the second strap; inserting a second arm of the user between the first strap and the second strap; and adjusting the carrier portion by pulling on a free end of the first strap and a free end of the second strap.

A child carrying system, according to further embodiments, includes a first means for supporting a child's bottom; a second means for transferring a weight of the child to a wearer's shoulders and substantially covering the wearer's shoulders; a third means for selectively securing the second means to the first means; and a fourth means for supporting the child's head, wherein the fourth means is secured to the first means, wraps around the second means, and is adjustable in a vertical direction relative to the first means.

BRIEF DESCRIPTION OF THE DRAWINGS

Various embodiments of the invention are described below. In the course of the description, reference is made to the accompanying drawings, which are not necessarily drawn to scale, and wherein.

DETAILED DESCRIPTION OF VARIOUS EMBODIMENTS

Figure 1:
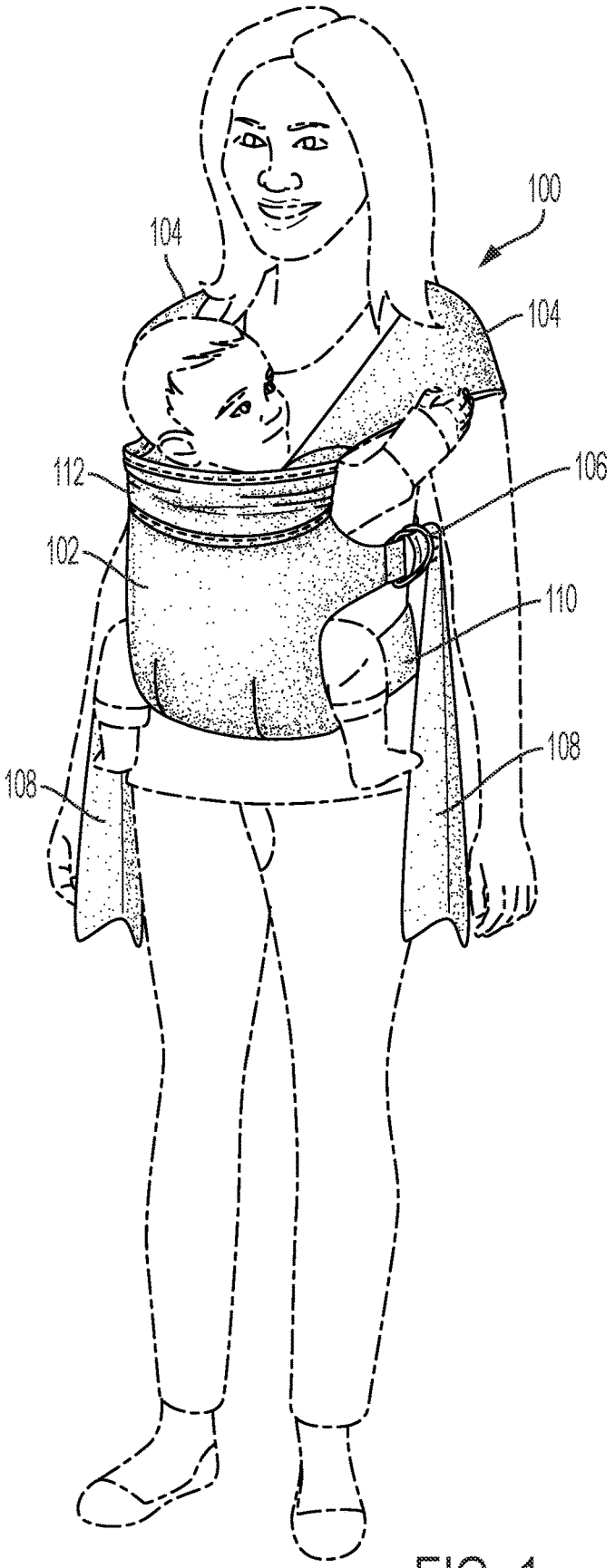
FIG. 1 is a perspective view of a child carrying system where the system is being utilized to carry a child on the front of a person with a head support in a lowered configuration according to various embodiments herein.
Figure 2:
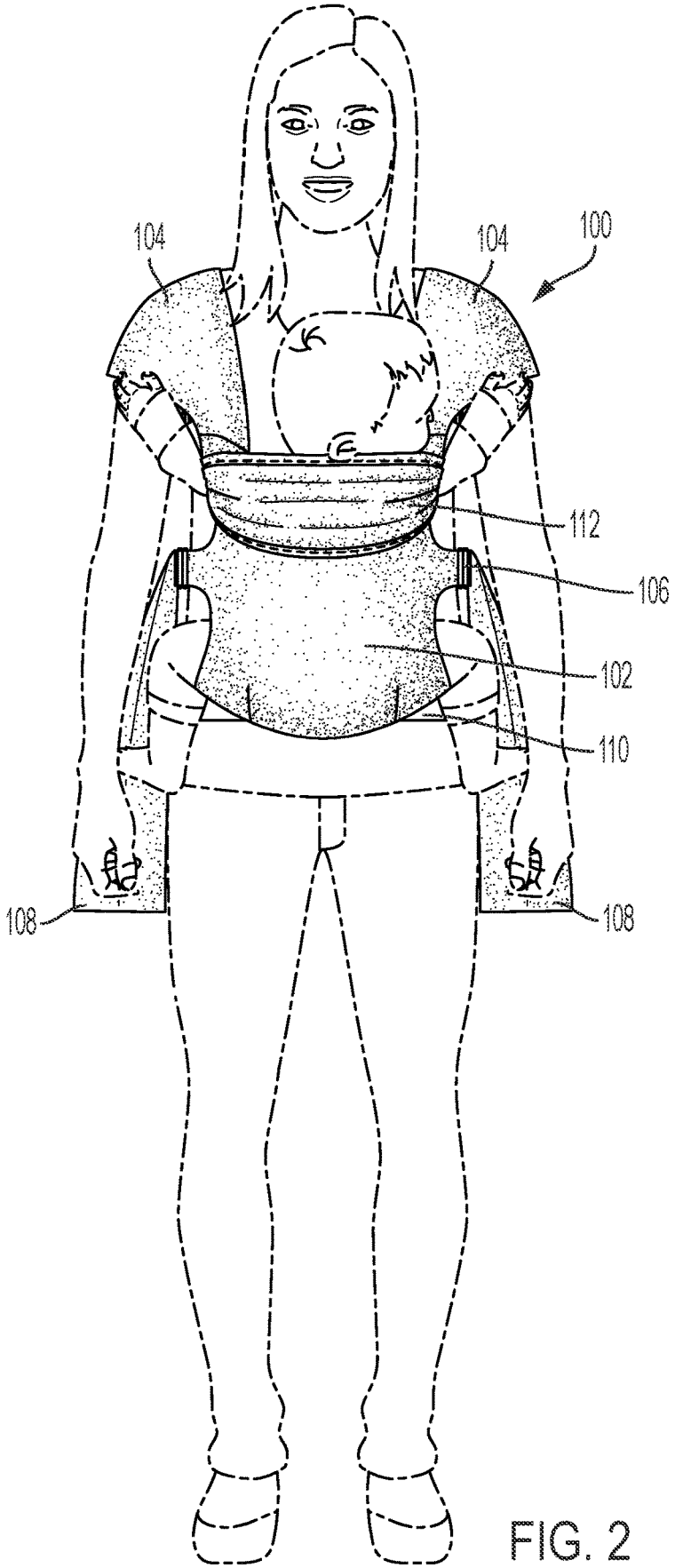
FIGS. 2-7 are, respectively, front, rear, right-side, left-side, top, and bottom views of the child carrying system of FIG. 1, where the system is being utilized to carry a child on the front of a person with the head support in a lowered configuration.
Figure 3:
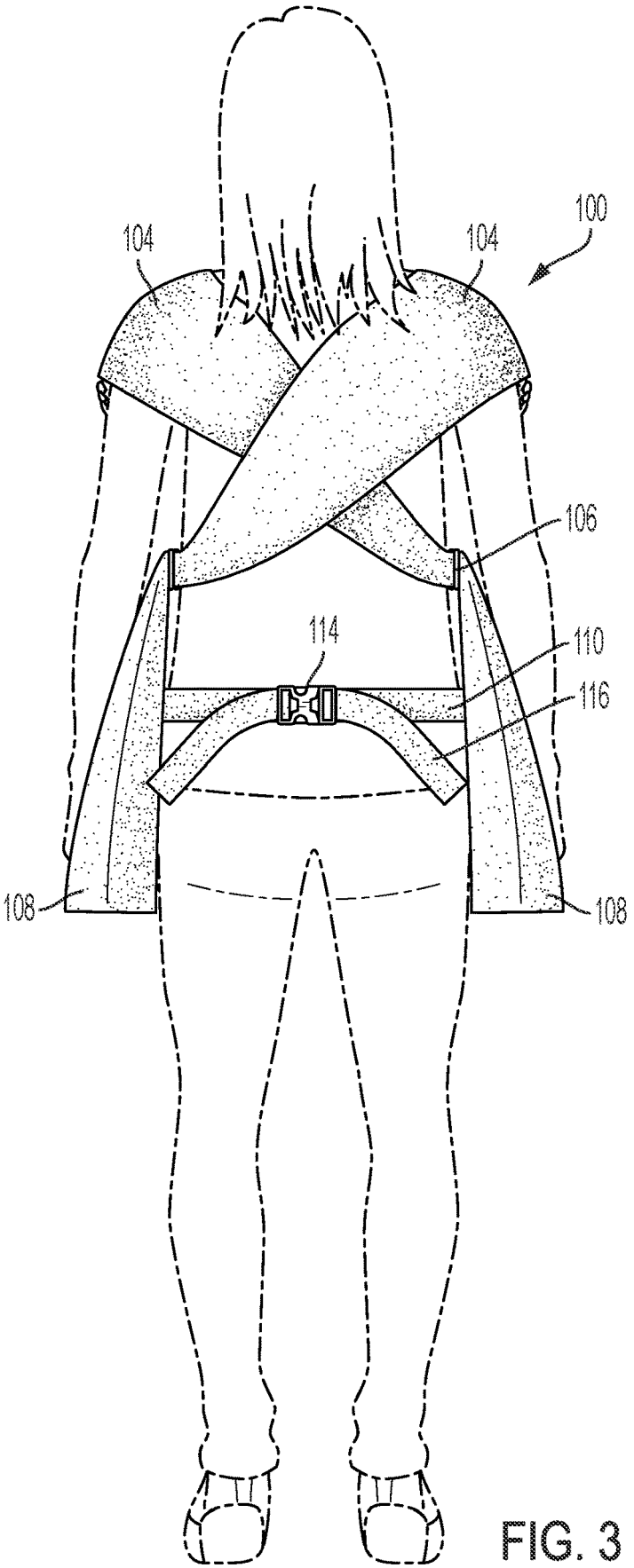
Figure 4:
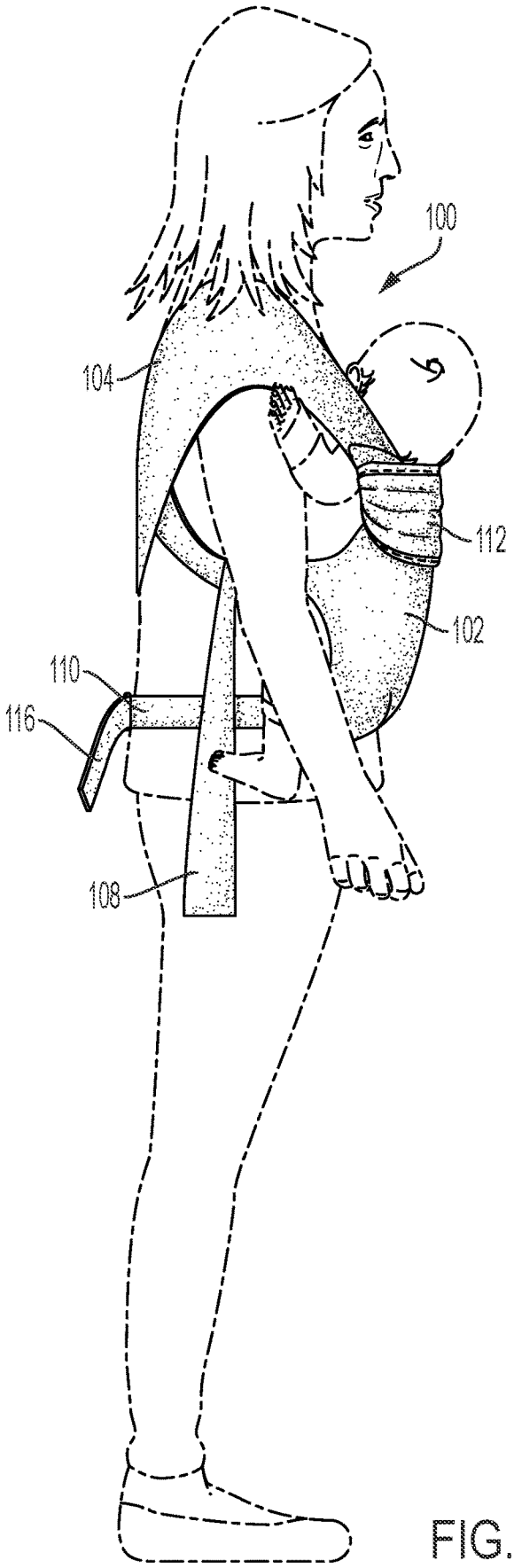
Figure 5:
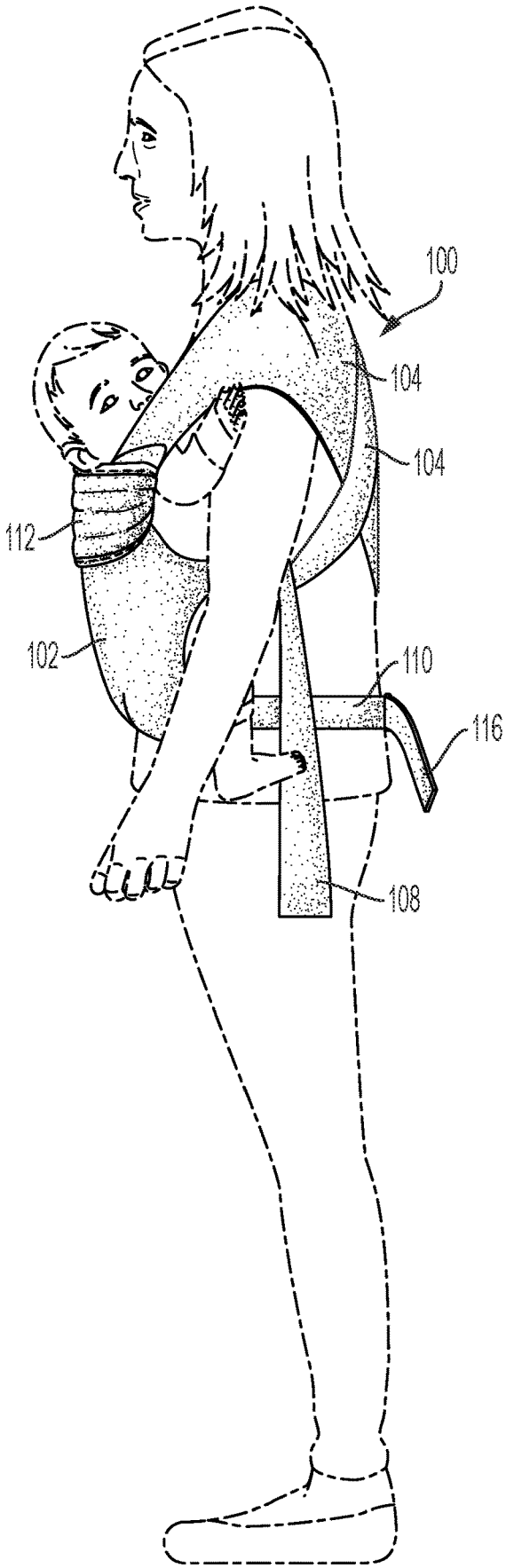
Figure 6:
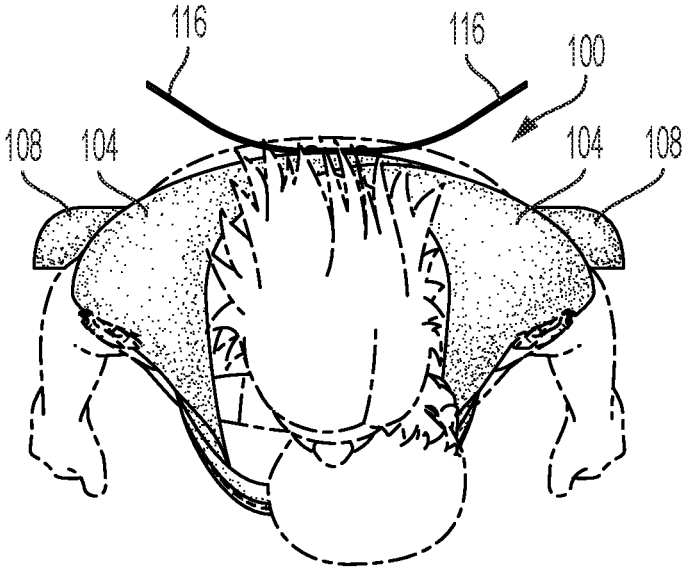
Figure 7:
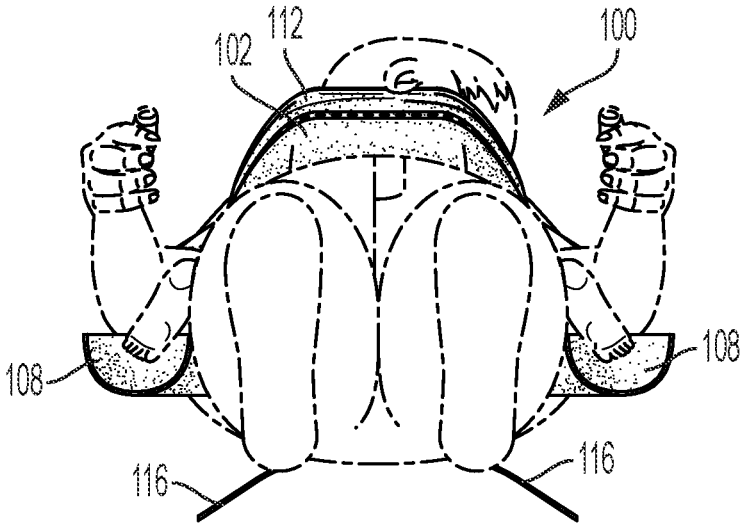
Figure 8:
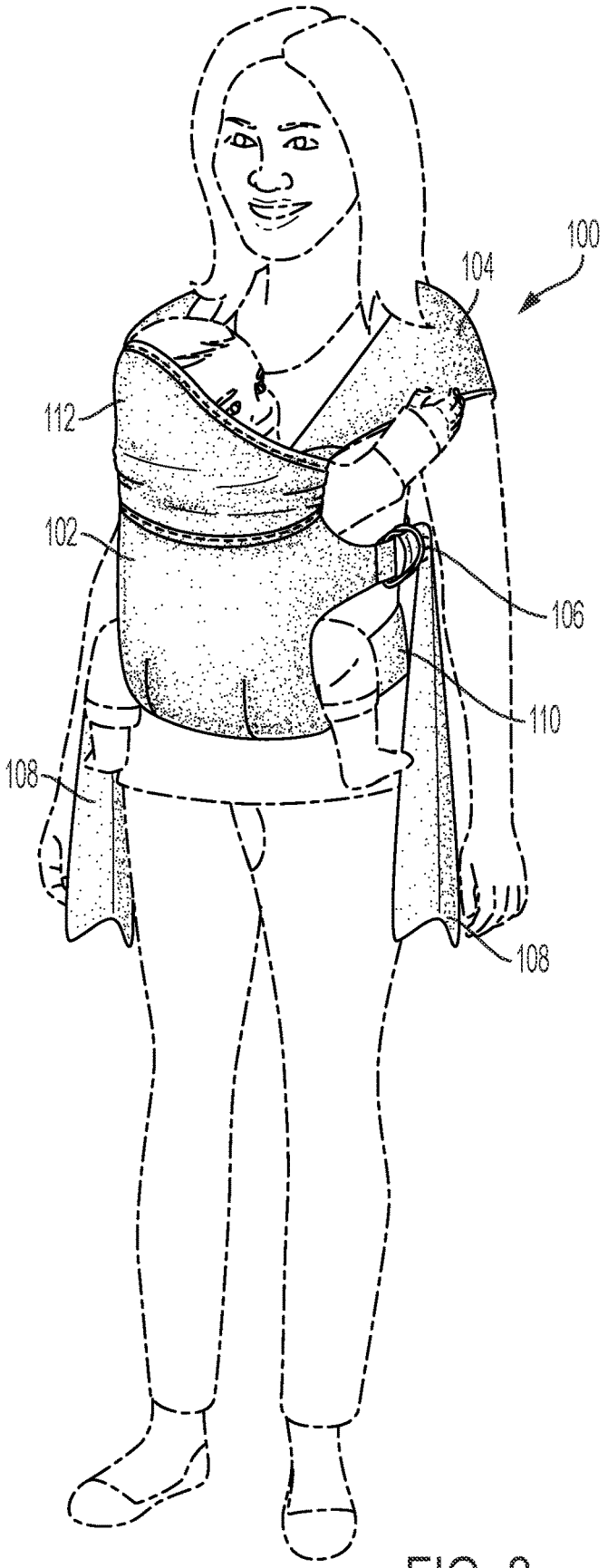
FIGS. 8-14 correspond, respectively, to the views of the child carrying system of FIGS. 1-7, where the system is being utilized to carry a child on the front of a person with the head support in a raised configuration.
Figure 9:
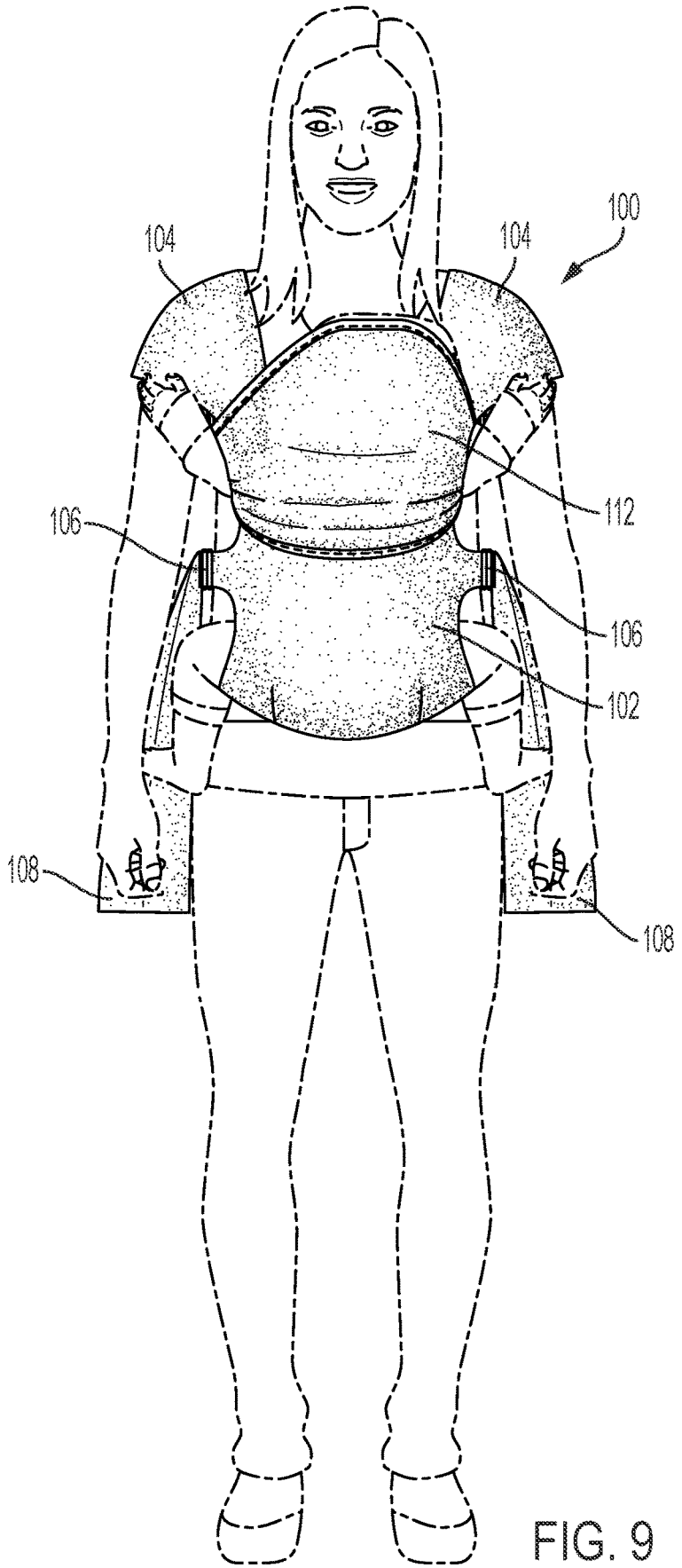
Figure 10:
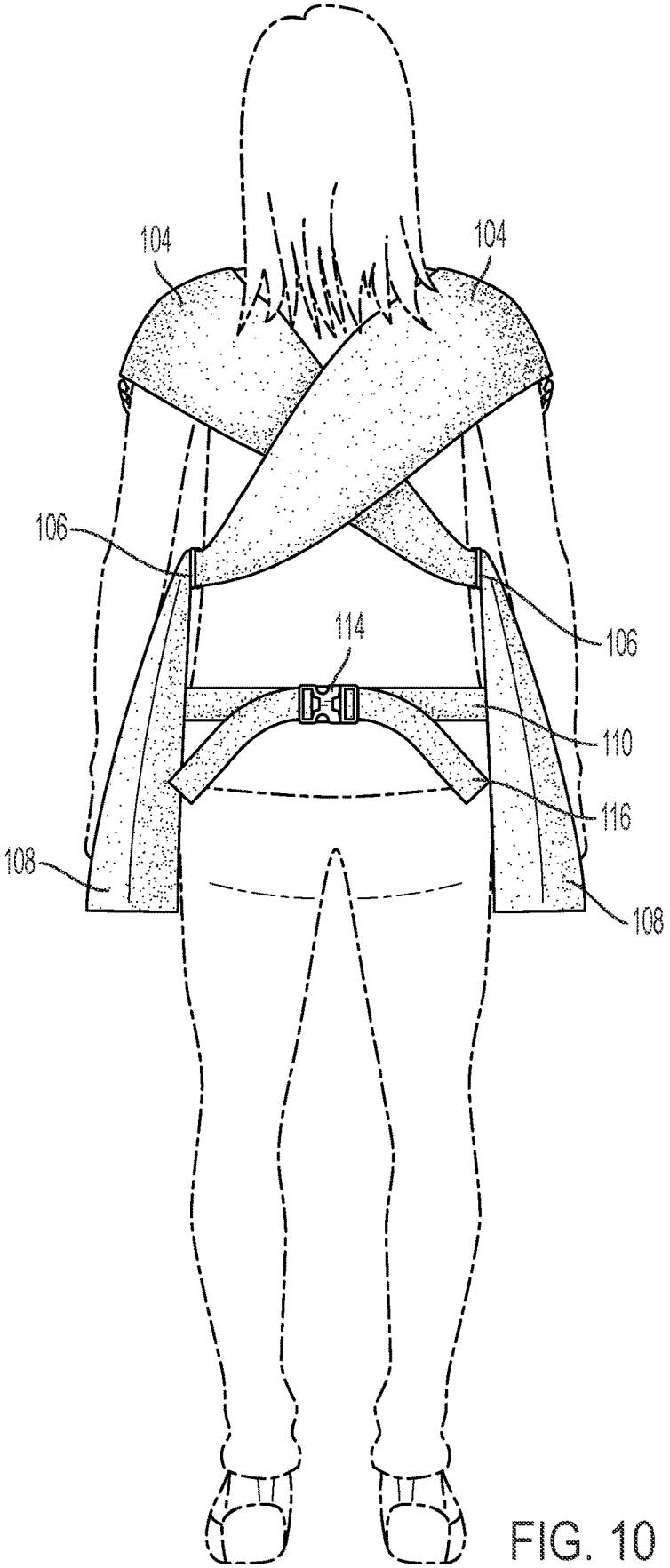
Figure 11:
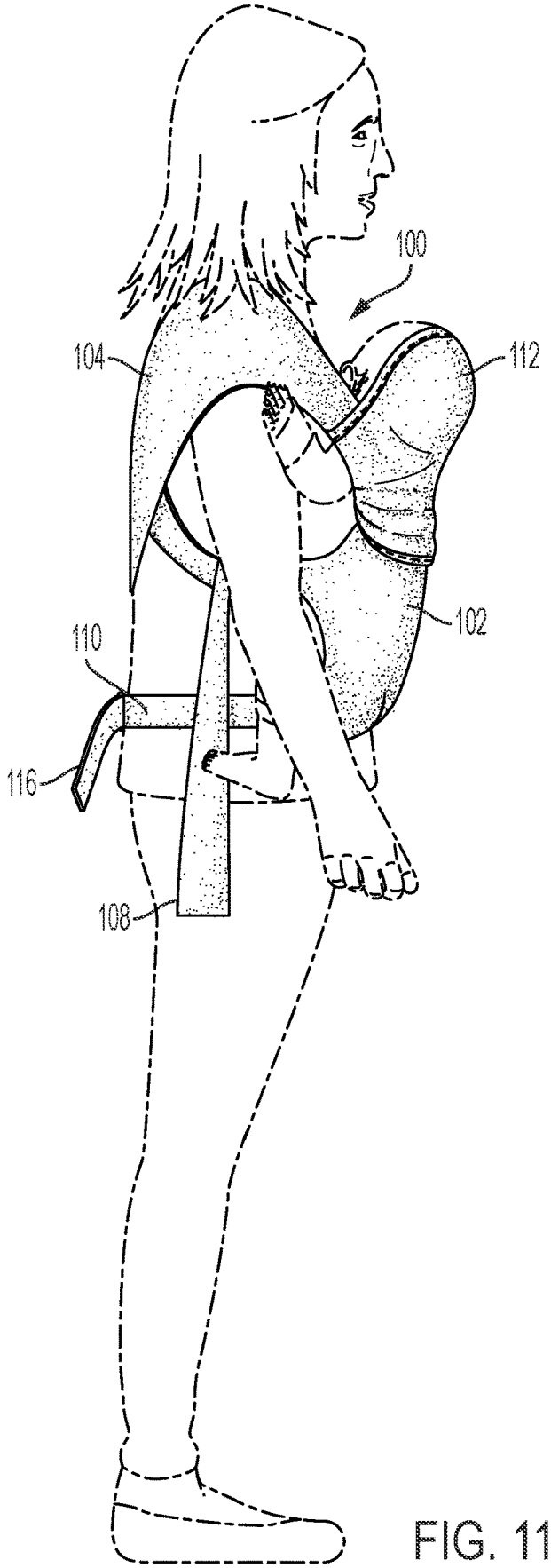
Figure 12:
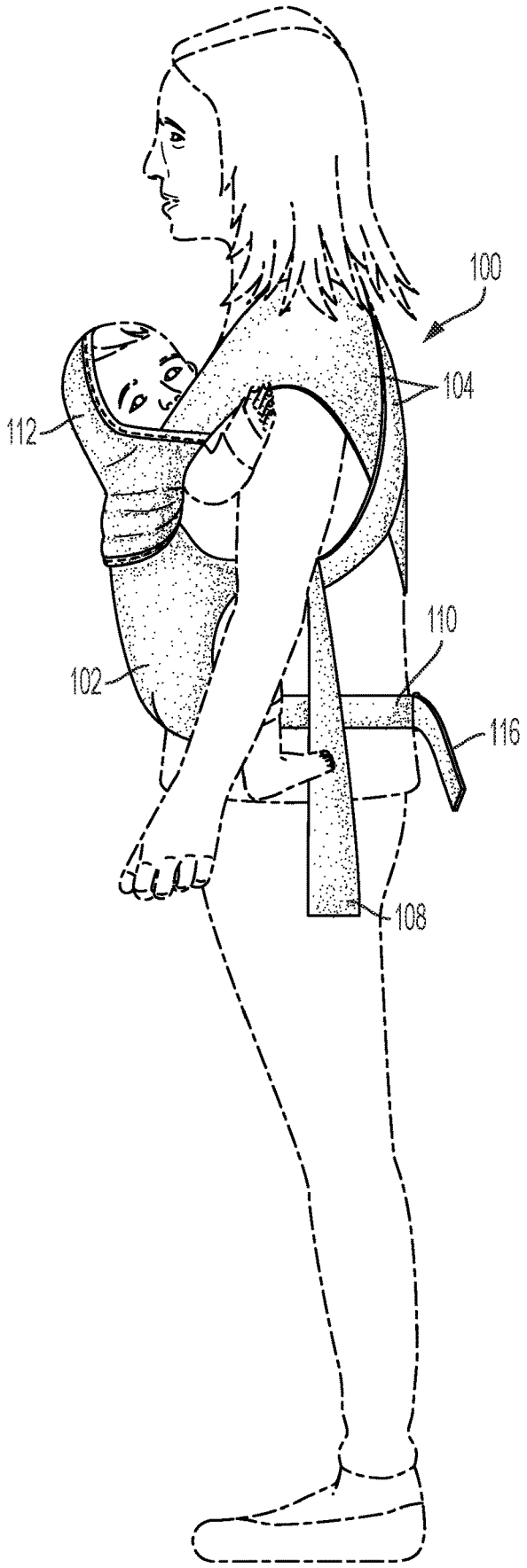
Figure 13:
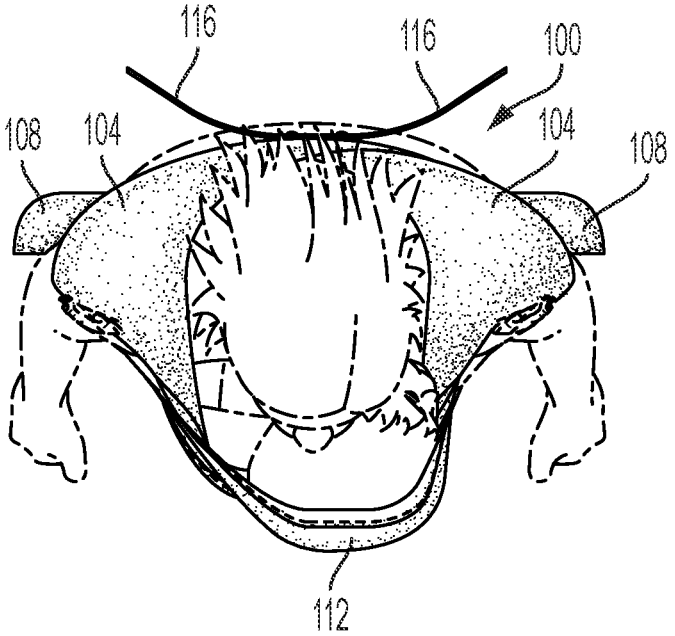
Figure 14:
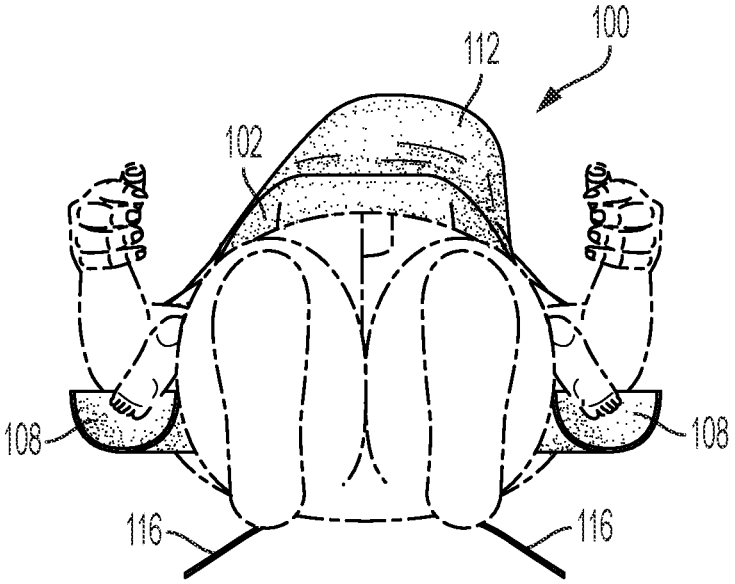
Figure 15:
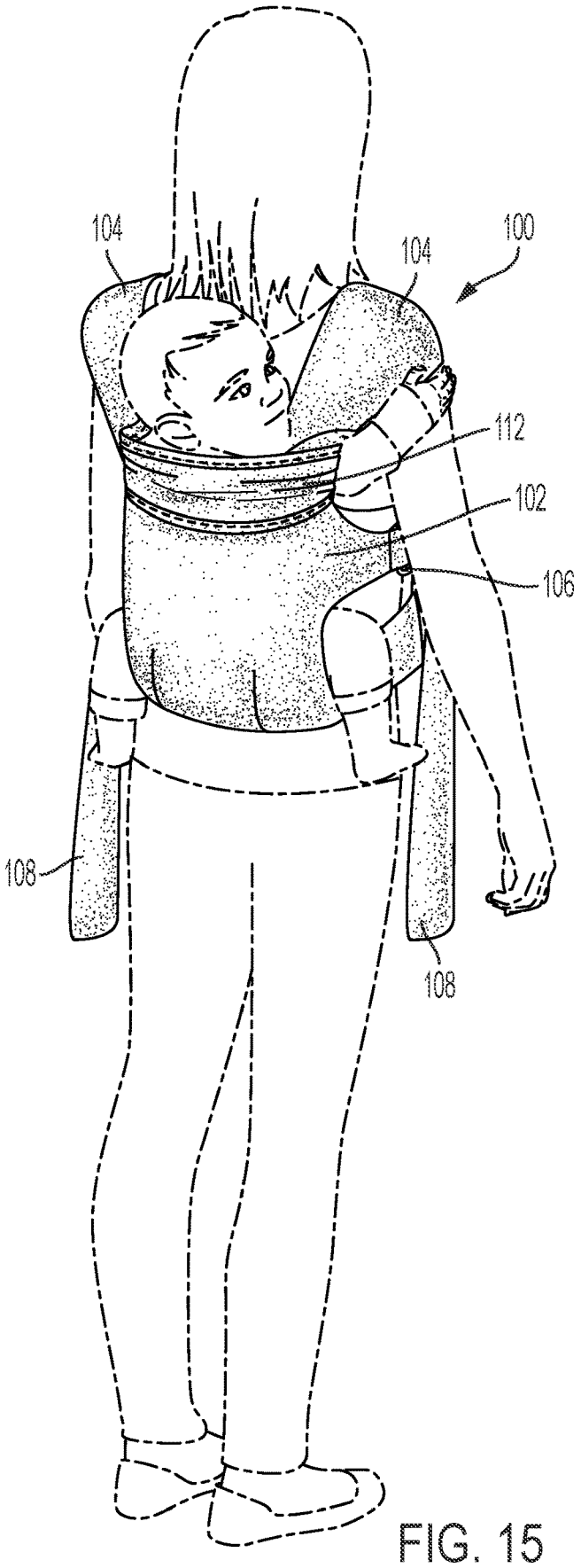
FIG. 15 is a perspective view of the child carrying system of FIG. 1, where the child carrying system is being utilized to carry a child on the back of a person with the child carrying system's head support in a lowered configuration.
Figure 16:
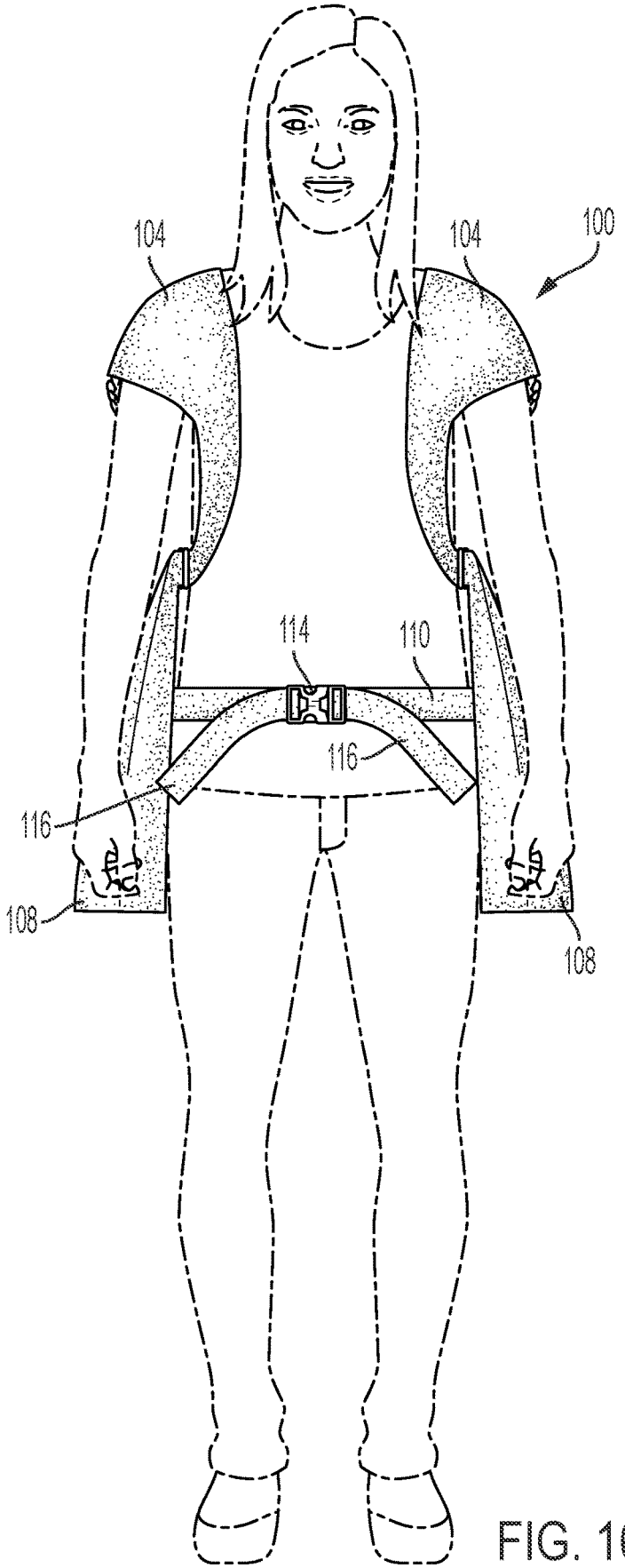
FIGS. 16-21 are, respectively, front, rear, right-side, left-side, top, and bottom views of the child carrying system of FIG. 1, where the system is being utilized to carry a child on the back of a person with the child carrying system's head support in a lowered configuration.
Figure 17:
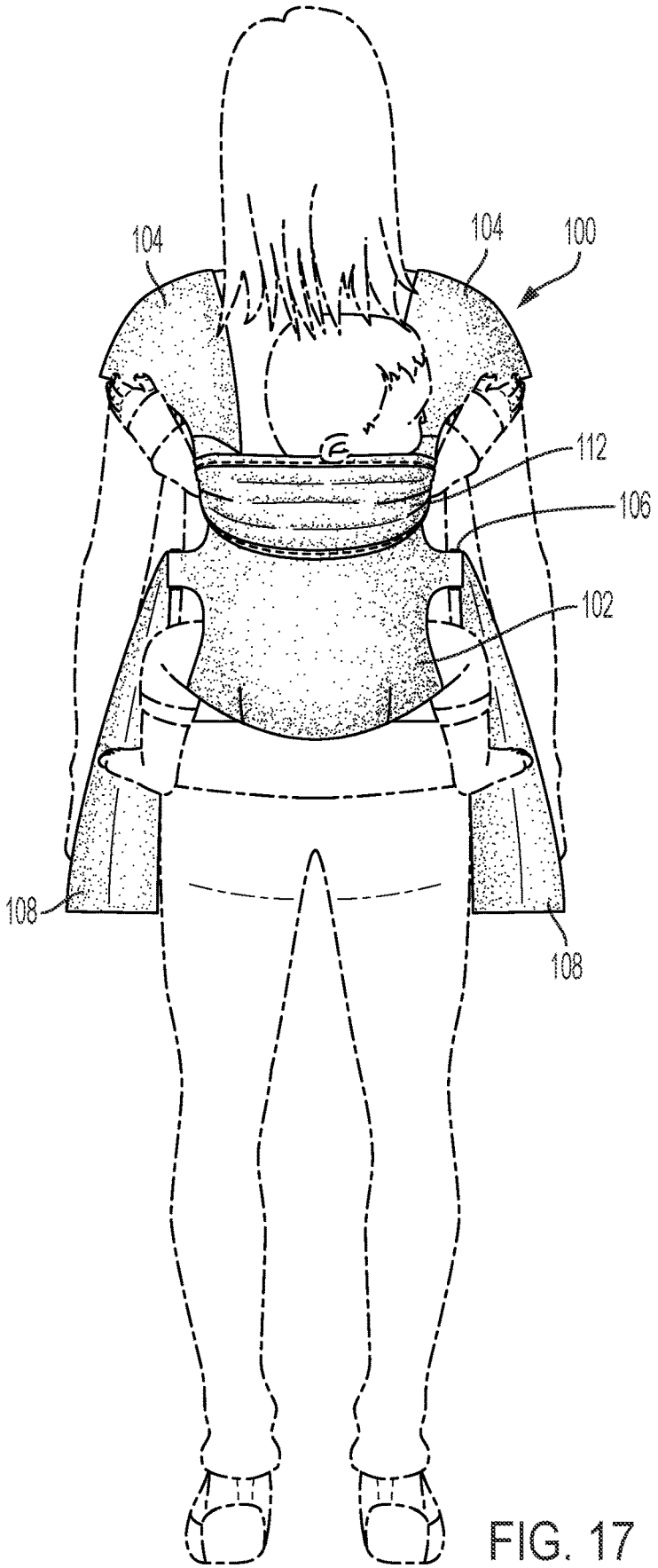
Figure 18:
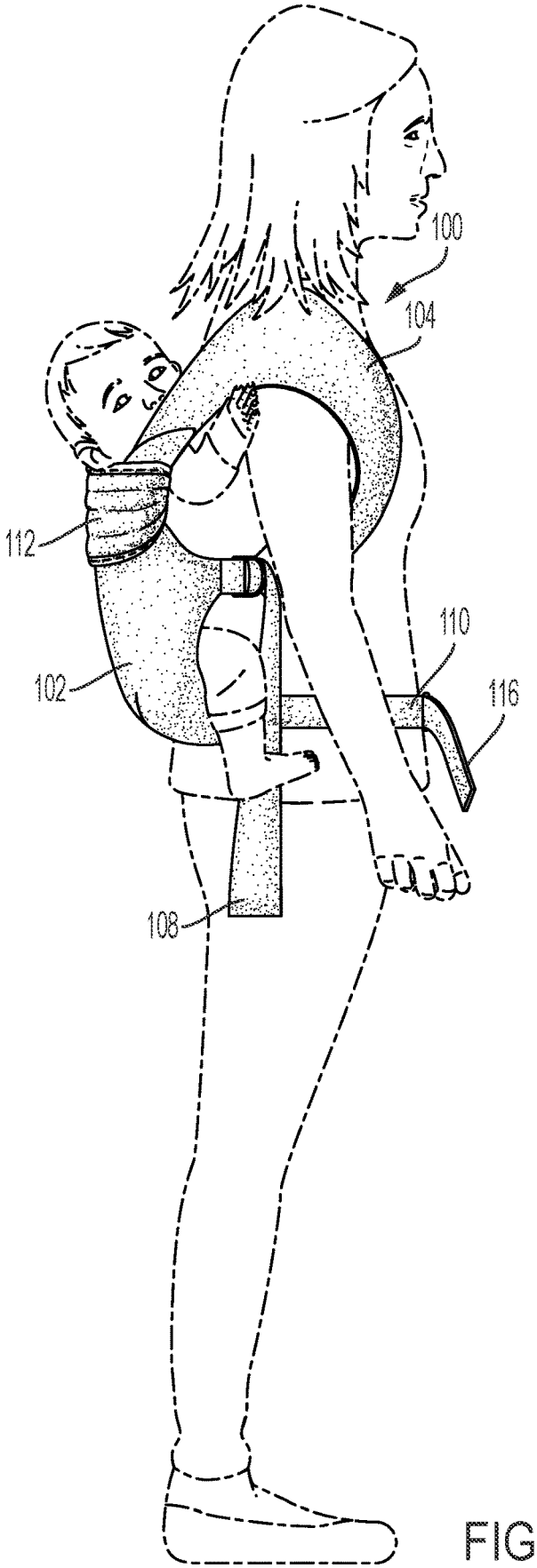
Figure 19:
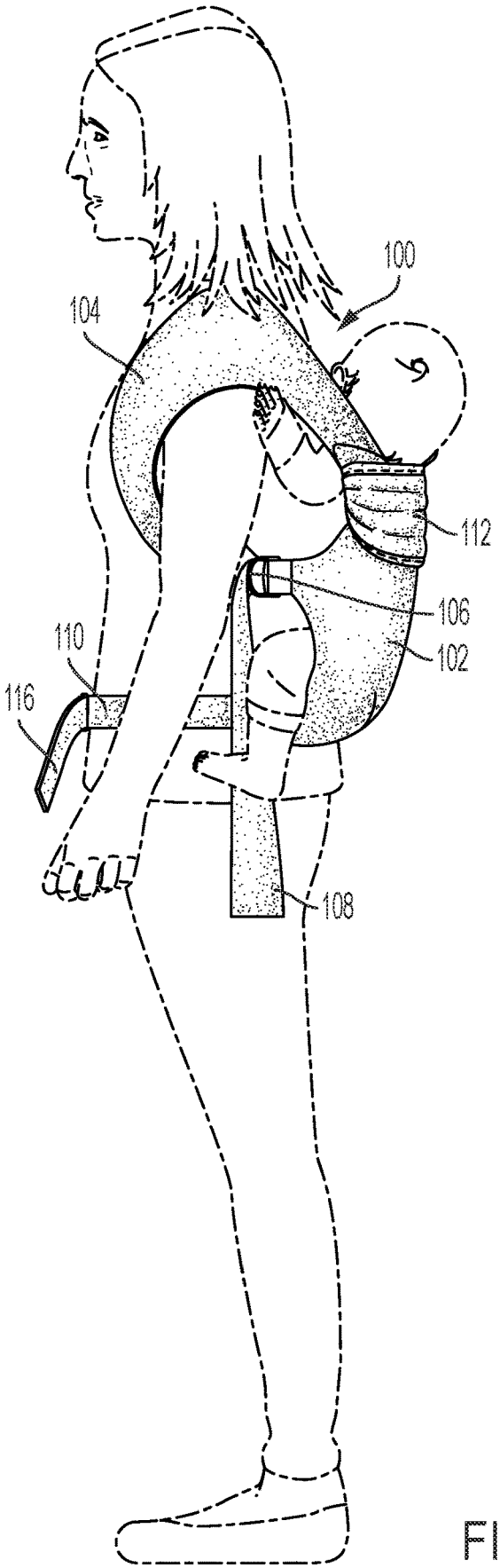
Figure 20:
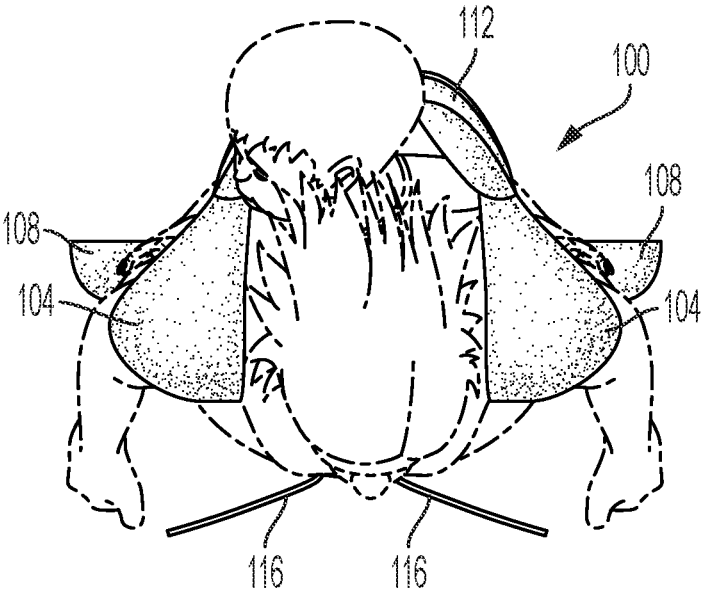
Figure 21:
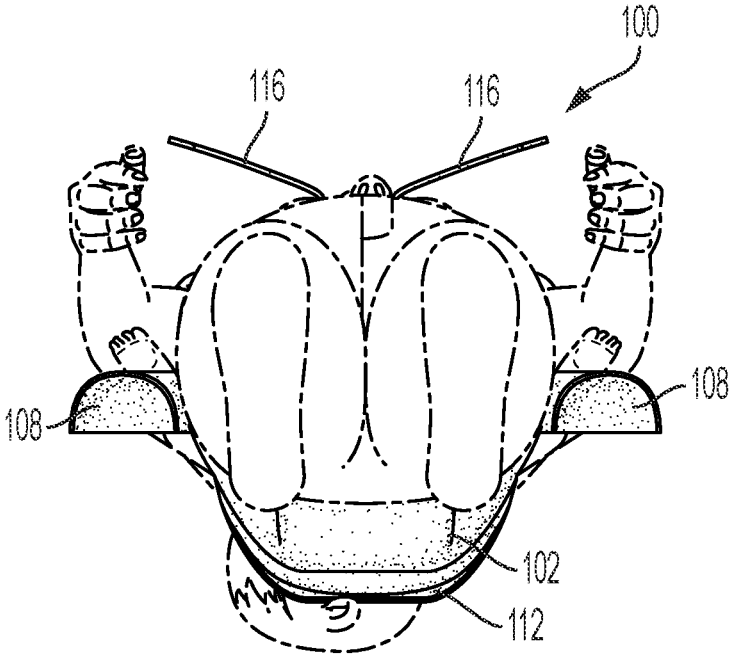
Figure 22:
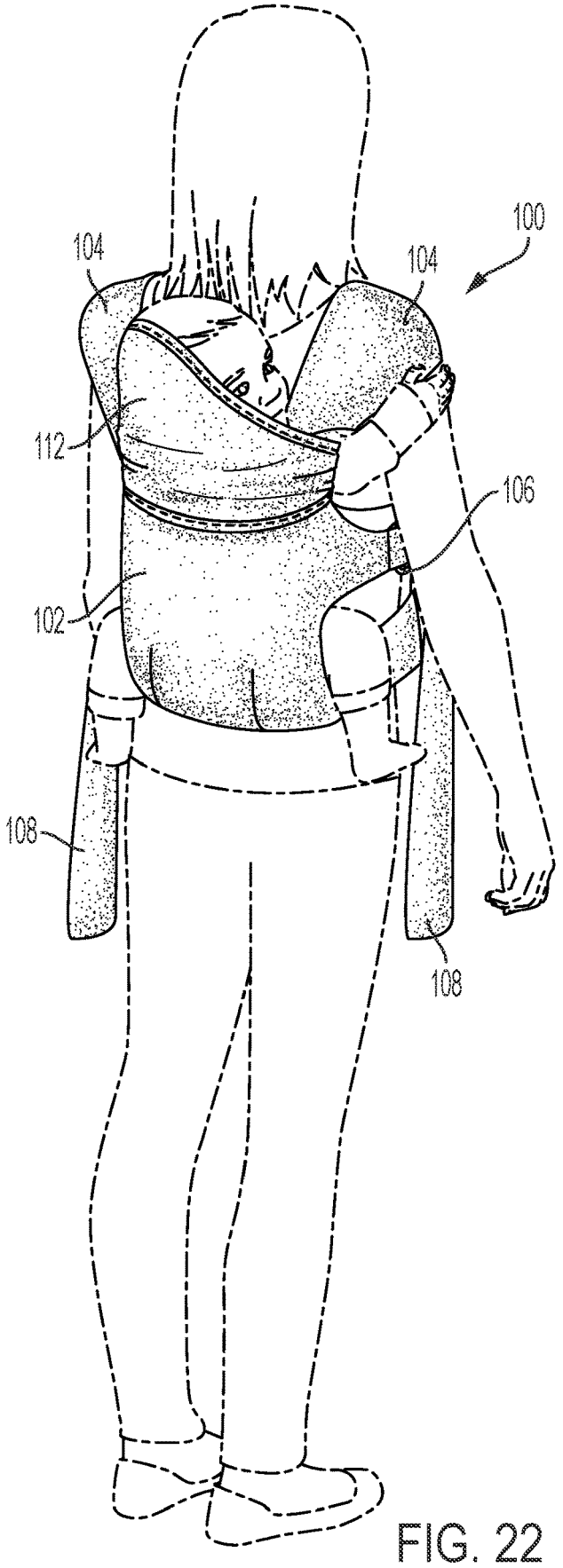
FIGS. 22-28 correspond to the views of the child carrying system of FIGS. 15-21, respectively, where the system is being utilized to carry a child on the back of a person with the head support in a raised configuration according to various embodiments herein.
Figure 23:
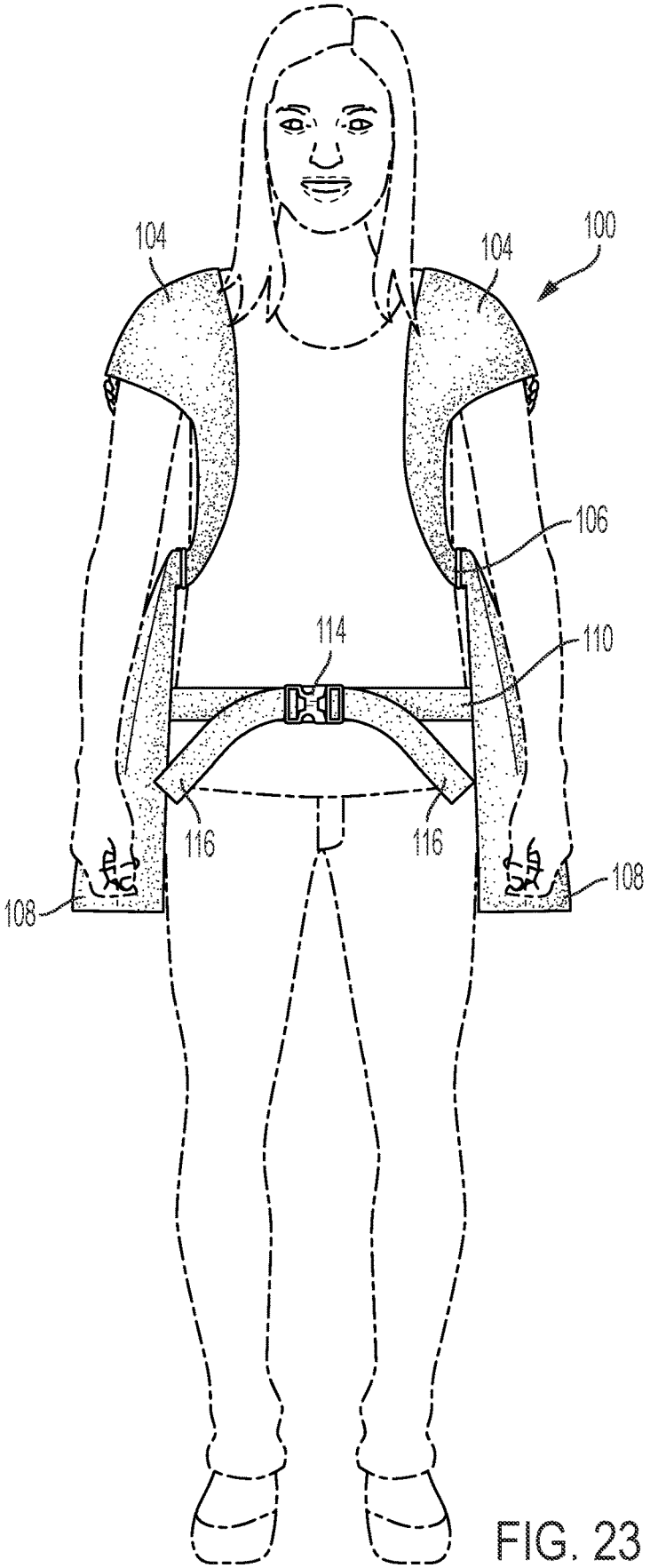
Figure 24:
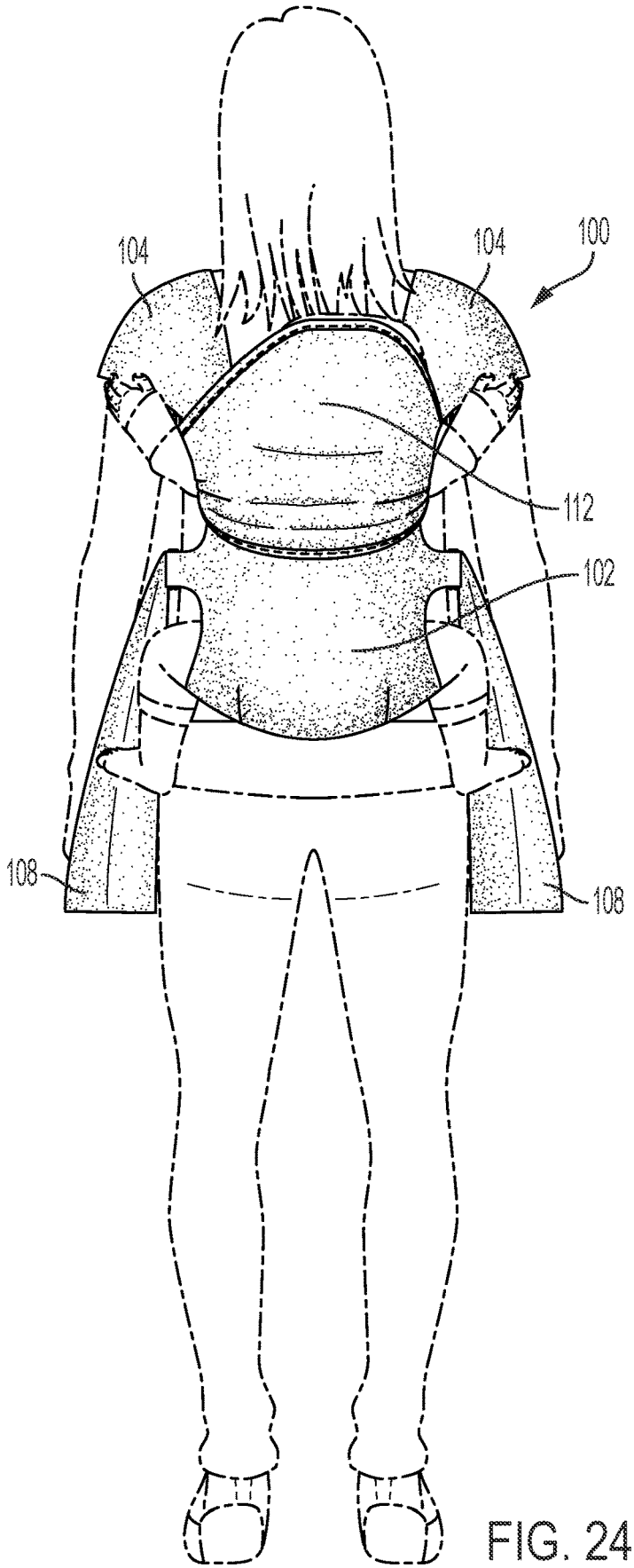
Figure 25:
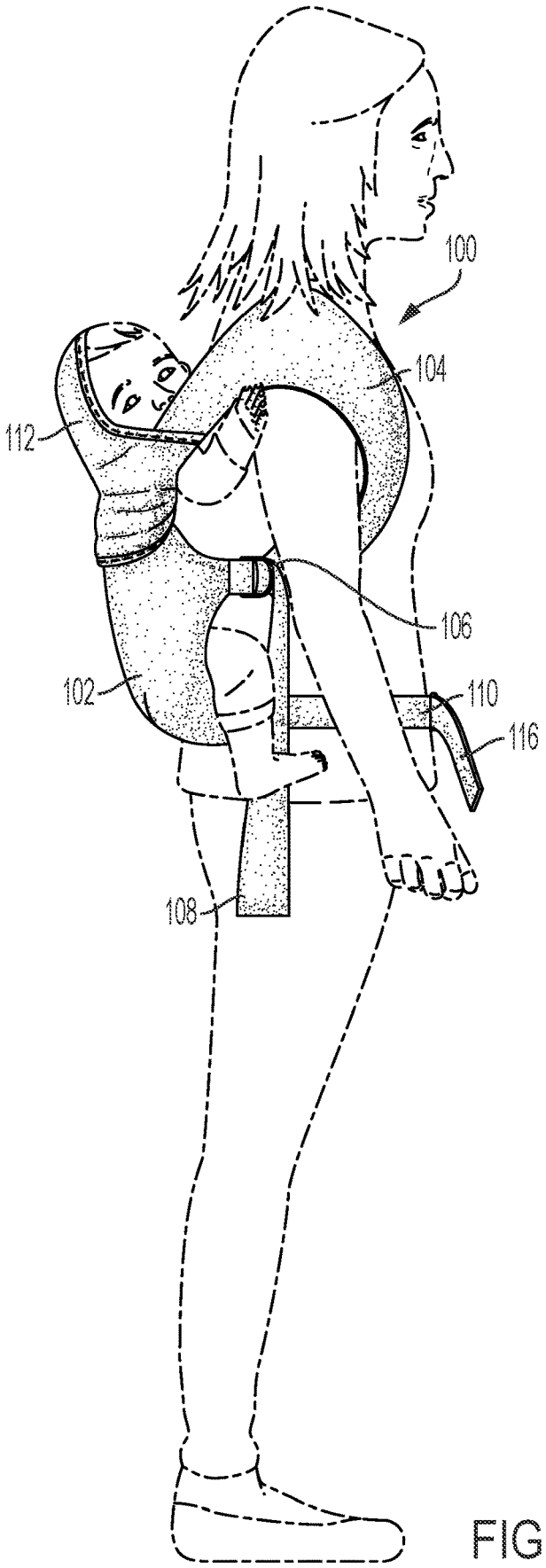
Figure 26:
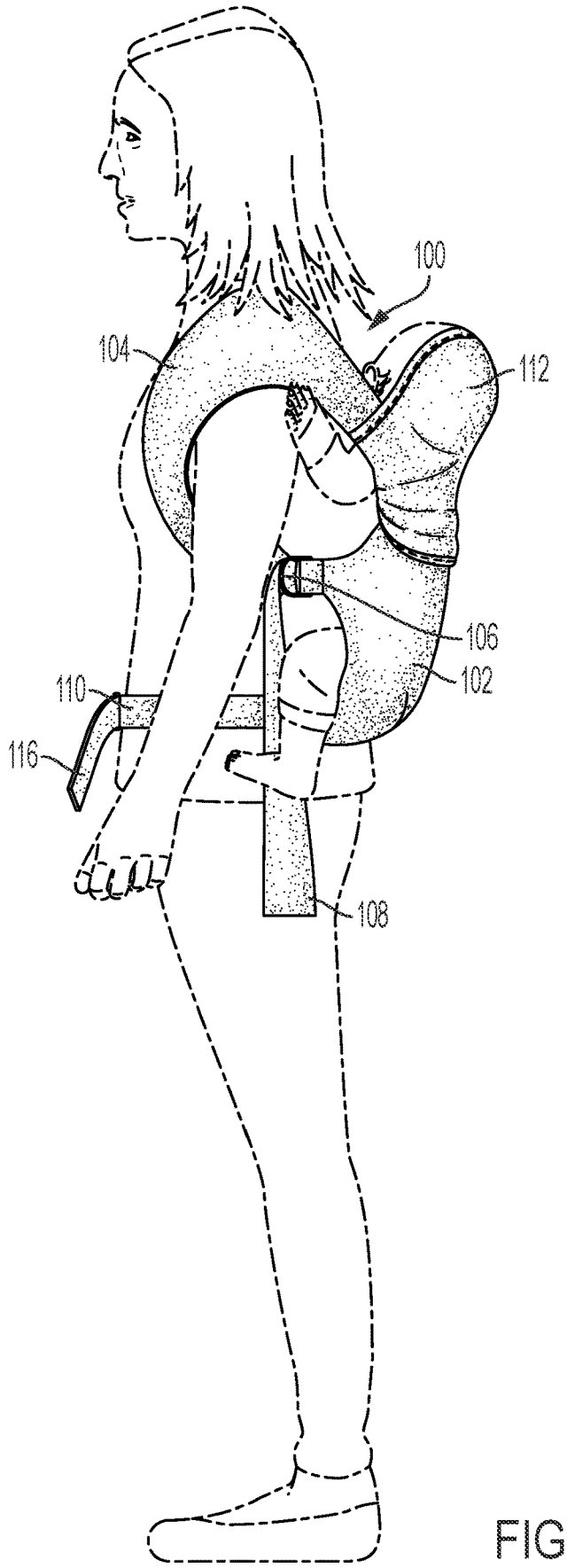
Figure 27:
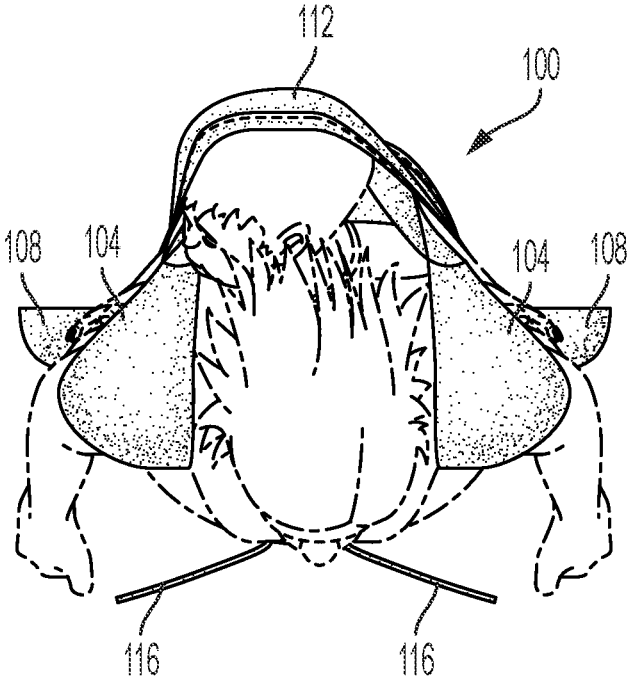
Figure 28:
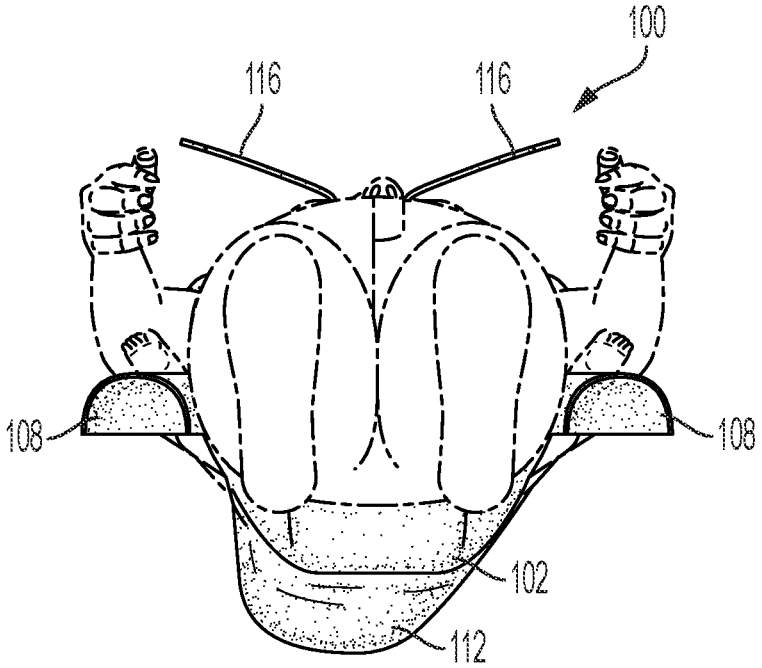

Various embodiments will now be described more fully hereinafter with reference to the accompanying drawings. It should be understood that the invention may be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Conventional child carriers vary greatly in structure and configuration. Child carriers may be configured with a rigid framework to provide support for the carrier and to distribute the child's weight. These carriers are often bulky, heavy, and cumbersome. Other soft carriers provide for carrying the baby or child on the user's back or on their front. Most carriers have limitations as they are designed for a specific placement of the child on the user's back or front, which, while useful for that particular use, does not provide allow for flexibility in carrying position and comfort as the child grows. Carriers often include numerous straps and buckles to provide for optimum fit and positioning of the child's weight while being carried. Similarly, straps are often padded and bulky in an attempt to provide comfort. The result is a bulky, cumbersome carrier that is difficult or inconvenient to carry while not in use and uncomfortable due to the numerous straps, buckles, and traditional mesh and plastic materials used in the carriers.

Various concepts and technologies described herein utilize a child carrying system that includes a carrier portion that encompasses the child that is made of soft fabric material. Instead of padded "backpack style" straps that secure conventional carriers to the user, various embodiments described herein may include wide fabric straps that may be positioned around the user's shoulders and threaded through large D-rings (which are a specific example of an "adjustment mechanism") that are attached to the carrier portion to allow for easy adjustment. In various embodiments, the entire child carrying system is manufactured from one or more soft fabrics, without any internal or external framing, and without any bulky padding (although alternative embodiments may include some internal or external framing and/or padding). Because of the nature of the fabric, the configuration of the straps and carrier portion, and the manner in which the carrier is worn, various embodiments of the child carrying system described herein provide a significant improvement over conventional carriers in terms of comfort and versatility.

Various child carrying systems described herein allow for the child to be worn on the user's back or on the user's front. When the child is carried on the user's back, the wide fabric straps extend from the carrier portion, over the user's shoulders, and directly down through the D-rings attached to the carrier portion. In various embodiments, the wide fabric straps are of a length that allows for extended "tail" portions of the straps to hang below the D-rings after being threaded through. These tails may be pulled away from the carrier portion to pull the straps through the D-rings and tighten the carrier portion against the user, or pushed back through the D-rings towards the carrier portion to loosen the carrier portion from the user when putting the child carrying system on or taking it off. Because the tails are wide and long, they may be tied across the user's chest as desired for aesthetic purposes, or allowed to hang by the user's side, according to the user's preference.

When the child is carried on the user's front, the wide fabric straps extend from the carrier portion, over the user's shoulders, and cross across the user's back to the D-rings on the opposite side of the carrier portion from where the straps begin. As noted above, the wide fabric straps may be of a length that allows for extended tails to hang below the D-rings after being threaded through.

Various embodiments of the child carrying system described herein provide a head support that is comfortable, provides exceptional support, and is easily configured according to the user's preference and/or the child's needs. The respective lateral sides of the head support may, for example, be wrapped around the two fabric shoulder straps in a manner that allows the head support to slide up and down the straps between lowered and raised configurations. In certain embodiments, the respective lateral sides of the head support may each slide independently of each other between a retracted and an extended position along a respective one of the fabric shoulder straps. In alternative embodiments, the head support may be slideably connected to the respective shoulder straps using any other type of slideable fastener and/or slideable fastening connection (e.g., suitable plastic loops, ties, etc.). The head support may be made from fabric having an elasticity that allows the head support to be pulled up and over the child's head and/or any particular portion of the child's head, as desired. In various embodiments, when not needed, the head support may be lowered, and/or pushed down toward and against a top edge of the carrier portion, to a position at or below the child's neck (e.g., as shown in FIG. 1).

Referring now to FIGS. 1-28, aspects of the child carrying system 100 will be discussed in detail. As discussed above, the child carrying system 100 is configured to allow for a child to be carried on a user's front or on a user's back. FIGS. 1-14 show various views of an embodiment of the child carrying system 100 worn by an adult with a child secured within the child carrying system 100 on the front side of the user. FIGS. 15-28 show various views of this embodiment of the child carrying system 100 worn by an adult (in a different configuration) with a child secured within the child carrying system 100 on the back side of the user.

Specifically, FIGS. 1-7 show various views of an embodiment of the child carrying system 100 worn by an adult with a child secured within the child carrying system 100 on the front side of the user, and with the head support 112 in a lowered configuration. In this configuration, the child's head is not supported by the head support 112 so that the child has complete freedom of movement of his or her head. FIGS. 8-14 show various views of an embodiment of the child carrying system 100 worn by an adult with a child carried on the front side of the user, and with the head support 112 in a raised configuration. In this configuration, the child's head is fully supported by the head support 112, which is important for infants that are unable to support the weight of their heads. This configuration may also be convenient for any child that is sleeping. FIGS. 15-21 show various views of an embodiment of the child carrying system 100 worn by an adult with a child carried on the back side of the user, and with the head support 112 in the lowered configuration. FIGS. 22-28 show various views of an embodiment of the child carrying system 100 worn by an adult with a child carried on the back side of the user, and with the head support 112 in the raised configuration.

Figure 31:
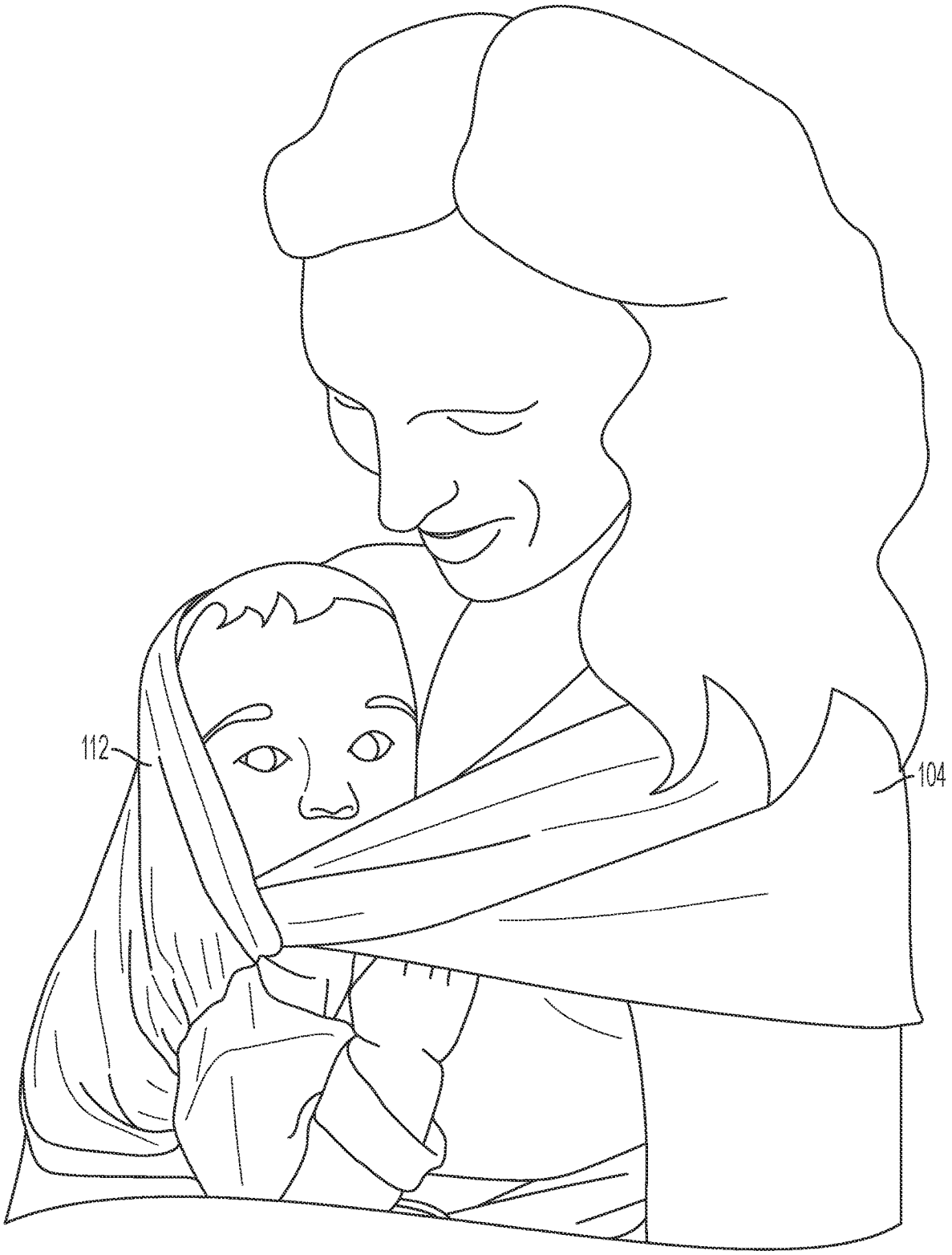
FIG. 31 is a close-up perspective view of a child in a child carrying system with the head support in a partially raised (left side raised, right side partially raised) configuration according to various embodiments.

FIG. 31 shows a close up view of a child carrying system 100 with the head support in a raised or partially raised configuration. As partially shown in FIG. 31, the head support 112 may be made by taking a generally rectangular length of appropriate fabric and sewing the opposing ends together to create a loop of fabric (see seam on head support 112). However, the loop of fabric may encompass or be looped around the two fabric shoulder straps 104 so that the sides of the head support 112 are able to slide and/or be pulled and pushed along the fabric shoulder straps 104 for raising and lowering. In this manner, each side of the head support 112 may be independently raised and lowered with or without raising or lowering the other side. Doing so provides the user with the flexibility to place the head support 112 at almost limitless positions between the fully raised and fully lowered configurations. For example, if a child is sleeping with his head turned toward the side, the parent wearing the child carrying system 100 may find it beneficial to only partially raise the side of the head support 112 on the same side as the child's face, and to fully raise the opposite side of the head support 112 to cover the back of the child's head while leaving the child's face exposed to provide visual and physical access and unrestricted breathing.

Finally, the bottom edge of the head support 112 may be sewn or otherwise coupled to the top edge of the carrier portion 102 to maintain the proper positioning of the head support 112 when it is pulled upward to the raised configuration. According to other embodiments, the head support 112 may be wrapped or looped around the fabric shoulder straps 104 but without being attached to the carrier portion 102. According to one embodiment, the head support 112 may be manufactured from a single piece of material with the opposing ends detachably connected rather than sewn together. In this embodiment, the head support 112 may be purchased separately from the child carrying system 100 and fitted onto any traditional child carrier by wrapping the head support 112 around the existing shoulder straps and connecting the ends to one another (e.g., via hook-and-loop fastening straps such as Velcro straps, snaps, or buttons).

Figure 34:
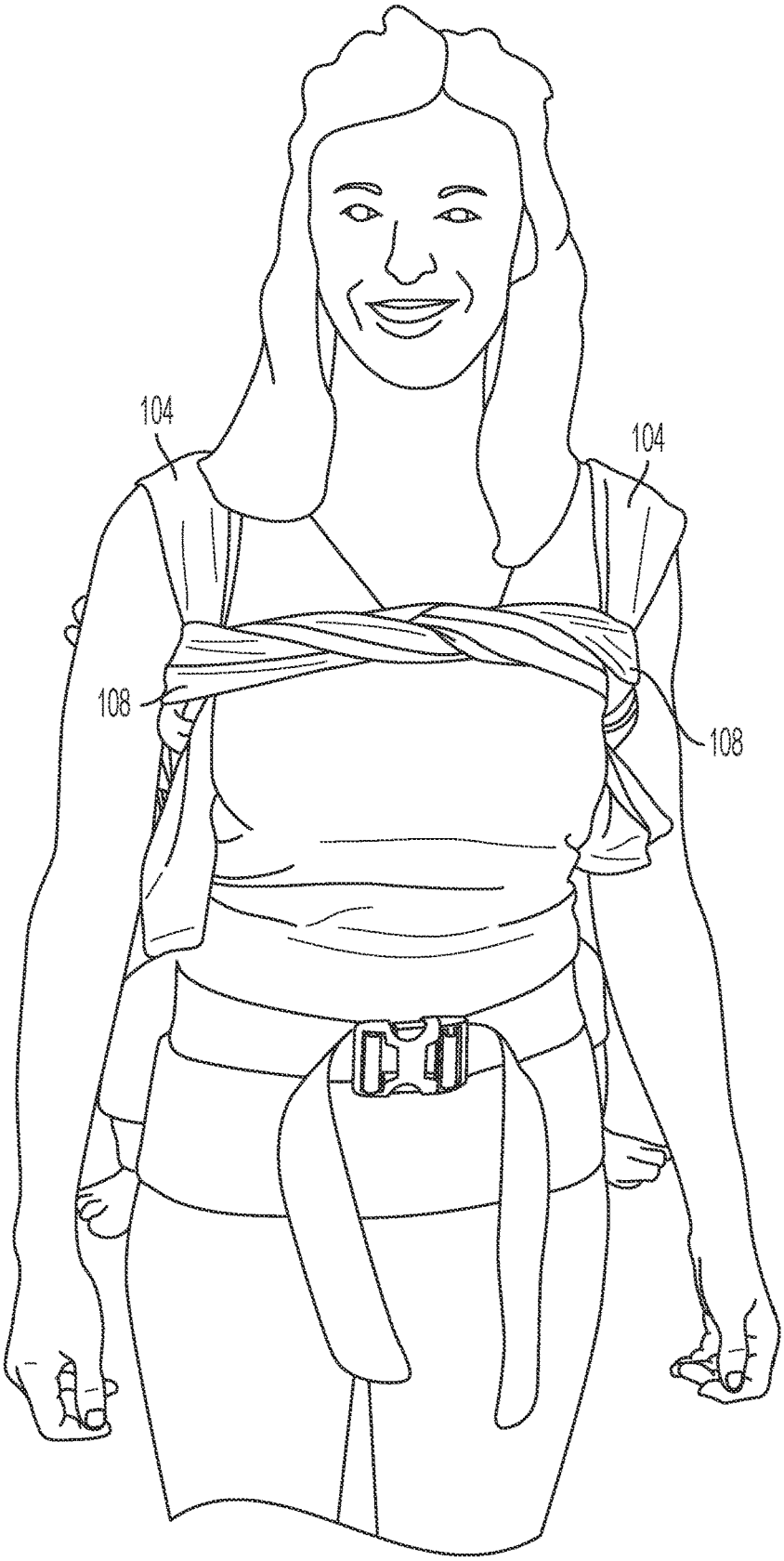
FIG. 34 is a front view of a child carrying system utilized to carry a child on the back of a person with shoulder strap tails engaged with each other across a chest of a person according to various embodiments herein.

As seen in the various embodiments, the child carrying system 100 includes a carrier portion 102 that supports the child's body. The carrier portion 102 may be selectively secured to the user using a waist belt 110 and a pair of shoulder straps 104. The shoulder straps 104 are each coupled at a first end to the carrier portion 102 proximate to a top corner of the carrier portion 102 and uncoupled at a second end opposite the first end. As mentioned above, the second end of each shoulder strap 104 is referred to herein as a tail 108. The tails 108 of the shoulder straps 104 may be left hanging down the user's side when the child is secured within the carrier portion 102 and the child carrying system 100 is being used. The length of the tails 108 allow for easy access for adjustments. Because the tails 108 are generally long enough to hang below the carrier portion 102, the user has various options for the tails 108 while carrying a child. One option is to allow the tails 108 to hang generally straight down, as shown in most of the drawings. Another option when the child is carried on the back of the user is to tie or wrap the tails 108 together across the user's chest, as shown in FIG. 34.

The fabric shoulder straps 104 are generally wide, significantly wider than a conventional shoulder strap on a backpack or typical child carrier. In doing so, the shoulder straps may be bunched up or folded to a narrower configuration where the shoulder straps 104 meet the carrier portion 102 or where the head support 112 loops around, and able to expand to a wider configuration where the shoulder straps 104 traverses the user's shoulder and back. By widening the fabric shoulder straps 104 to encompass substantially the user's entire shoulder, the child carrying system 100 is fully supported in a manner that is substantially more comfortable to the user than a conventional strap that has a minimal contact surface area and may "dig in" or irritate the user's shoulder after prolonged wear. Maximizing the contact surface area on the shoulders distributes the weight of the child, while the fabric of the shoulder straps 104 adapts to the contours of the user's body and moves with the shoulders and arms, maximizing comfort.

Figure 29:
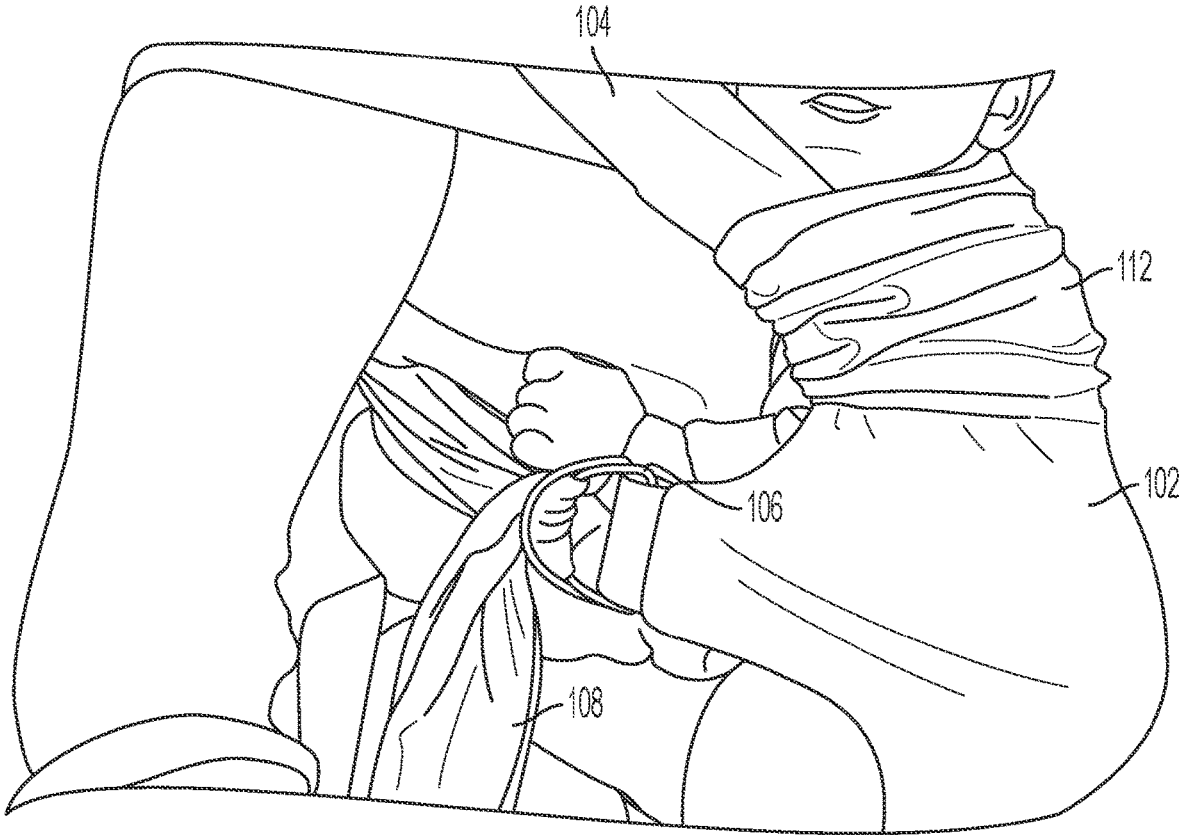
FIG. 29 is a close-up view of an adjustment mechanism of a child carrying system according to various embodiments.
Figure 30:
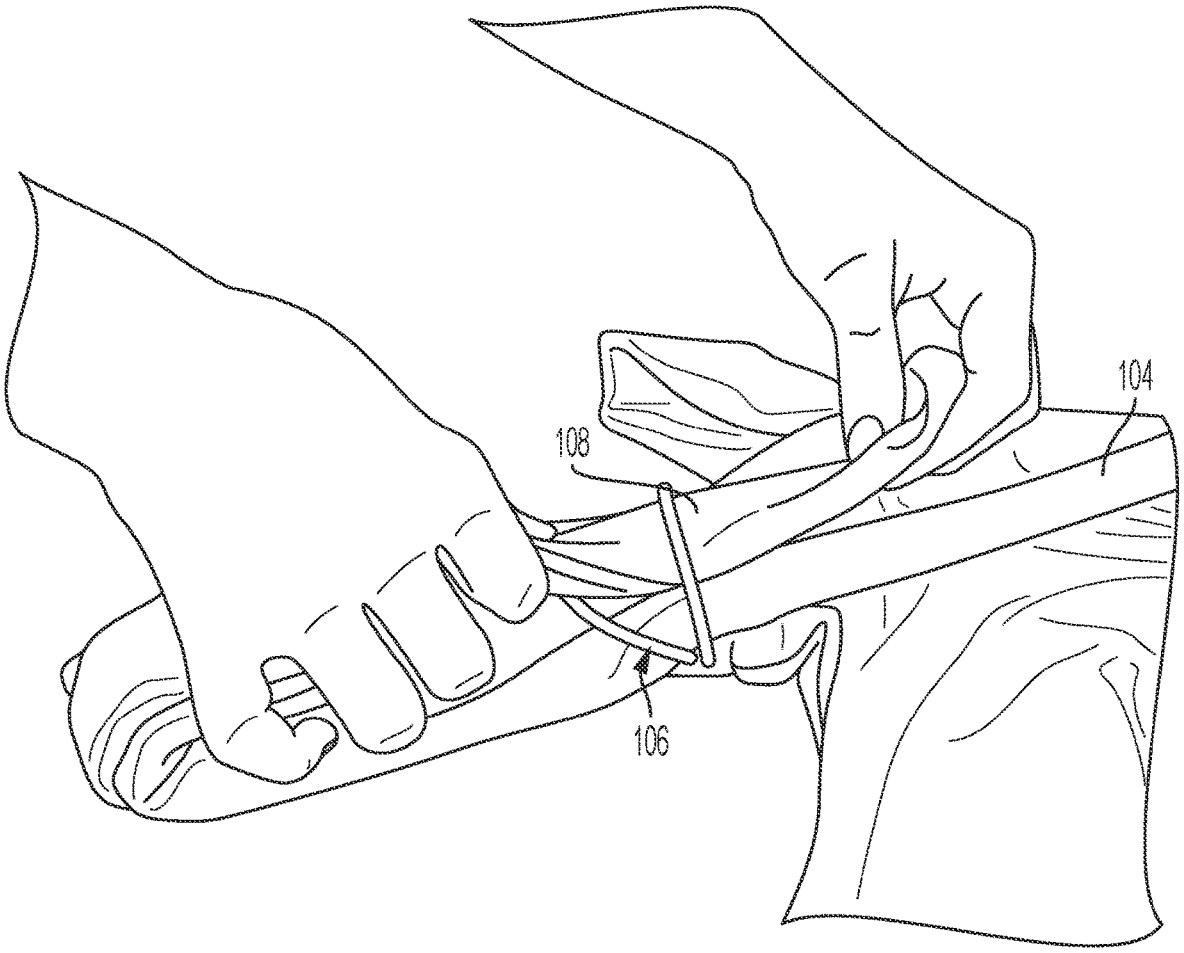
FIG. 30 is a close-up view of a shoulder strap of a child carrying system being threaded through an adjustment mechanism according to various embodiments.
Figure 32:
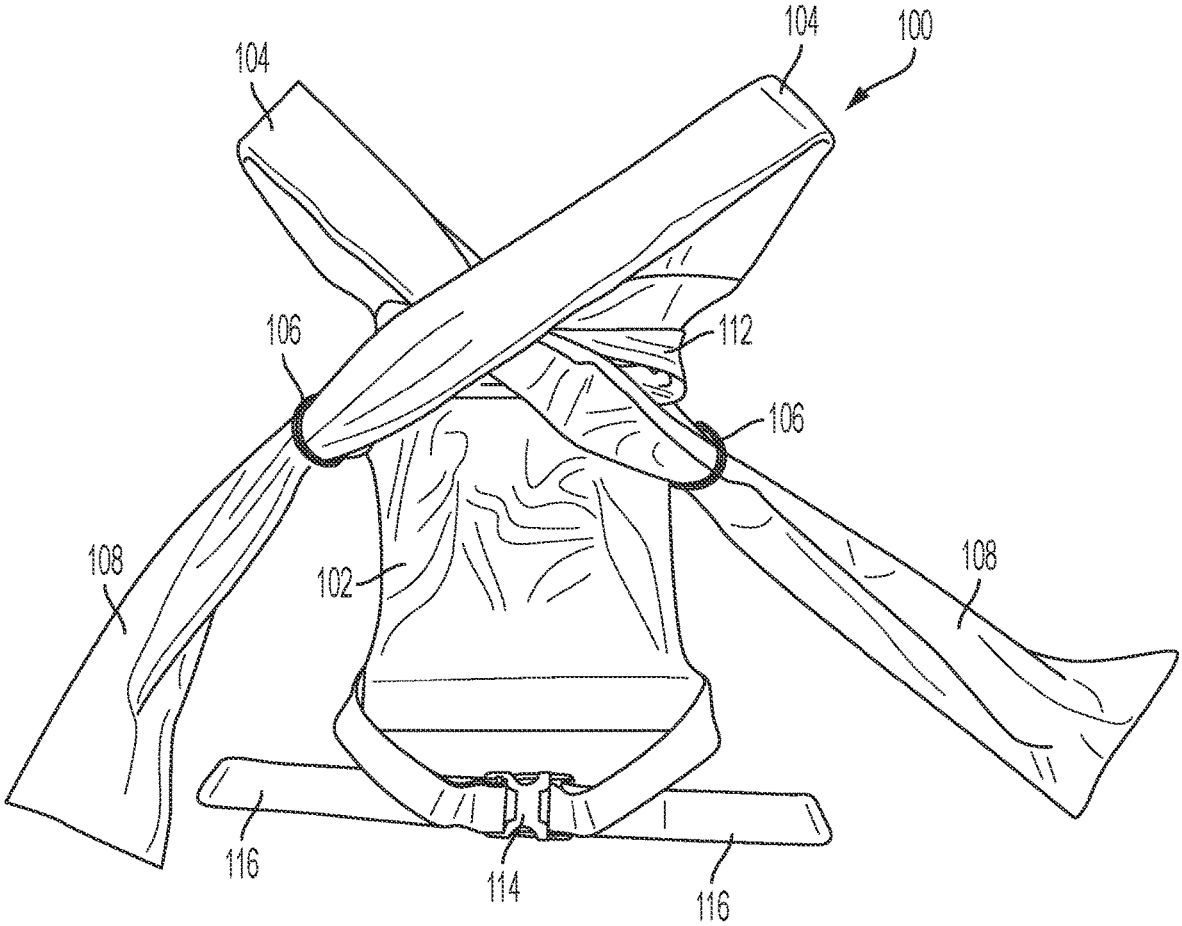
FIG. 32 is a rear view of a child carrying system without a child supported within and configured for carrying a child on a front of a person, according to various embodiments herein.
Figure 33:
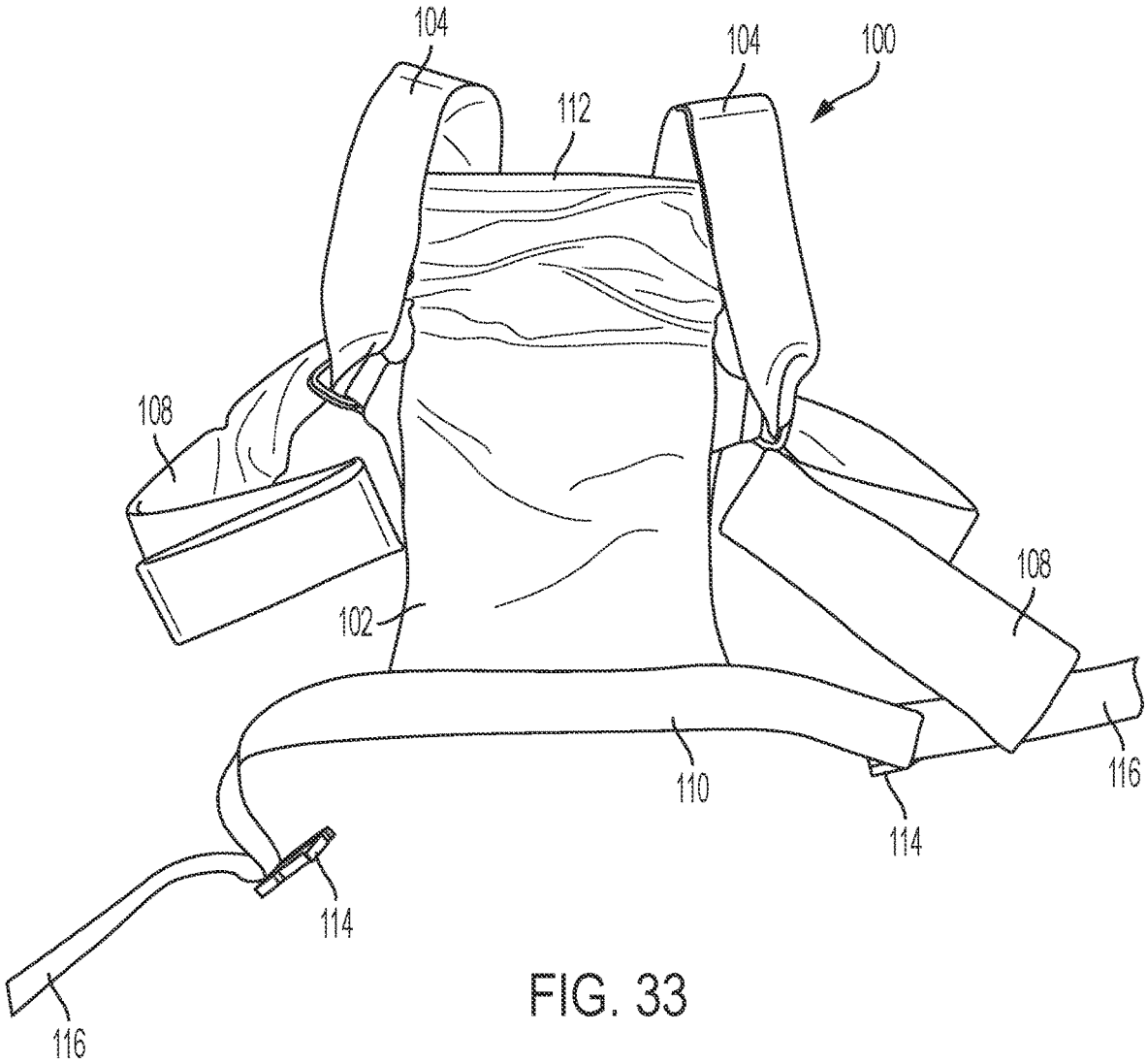
FIG. 33 is a rear view of a child carrying system without a child supported within and configured for carrying a child on a back of a person, according to various embodiments herein.

The fabric shoulder straps 104 are routed through D-rings 106 or any other suitable attachment mechanism (e.g., adjustable attachment mechanism) connected to the carrier portion 102. FIG. 29 shows a close up of a shoulder strap 104 secured through a D-ring 106, while FIG. 30 shows a close up view of the installation process for routing the shoulder strap 104 through the D-ring 106. For support and comfort purposes, the fabric shoulder straps 104 may be crisscrossed to opposite D-rings 106 when the child carrying system 100 is configured for carrying a child on a user's front. This configuration is shown in FIG. 32. FIG. 33 shows the configuration of the fabric shoulder straps 104 when the child carrying system 100 is configured for carrying a child on a user's back. In this configuration, the fabric shoulder straps 104 are routed downward from the user's shoulder to a set of D-rings 106 on the same side of the carrier.

Figure 35:
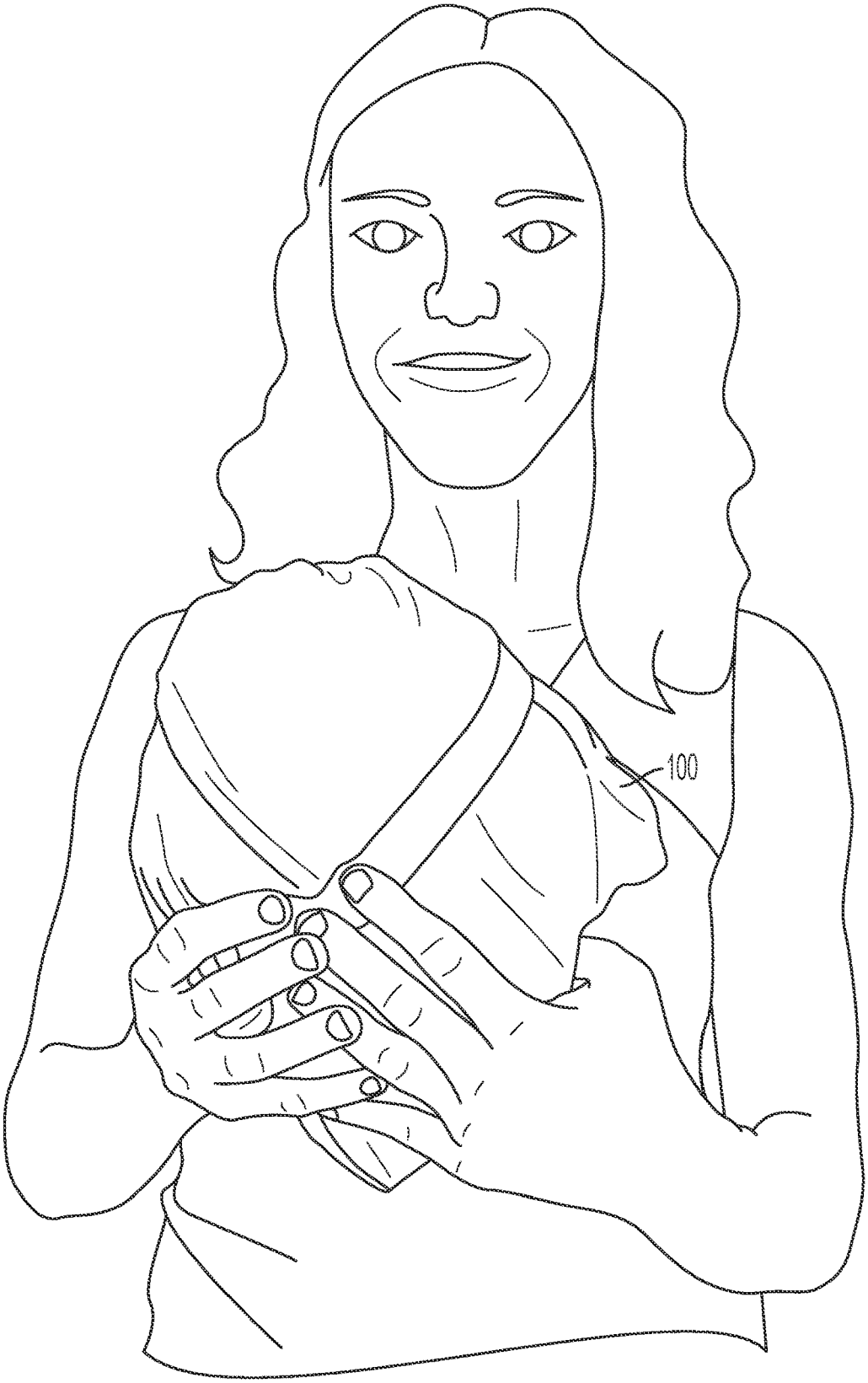
FIG. 35 is a front view of a child carrying system configured in a stowed configuration according to various embodiments herein.

The child carrying system 100 includes a waist belt 110 that is attached to a bottom edge or portion of the carrier portion 102. The waist belt 110 is preferably fabric, but may be any material. The waist belt 110 has waist belt tails 116 that thread through a fastener mechanism 114 and are adjustable to various waist sizes. The waist belt 110 is most clearly shown in FIGS. 32-34. When not in use, at least in part because the child carrying system 100 is made from a soft fabric without the bulky padding and various semi-rigid materials of conventional carriers, the child carrying system 100 is able to be folded up to a small stowage configuration, which is shown in FIG. 35. Finally, FIGS. 36-39 show detailed instructions for putting on and adjusting the child carrying system 100, as well as for folding the child carrying system 100 to the stowage configuration.

Use of the Child Carrying System

In various embodiments, the child carrying system includes a first, "3 to 6 months" indicia printed on the inside of the carrier portion 102, which is used to help a user configure the child carrying system for use with a small (e.g., 3 to 6 month old) child, and a second, "6 months and up" indicia to help a user configure the child carrying system for use with larger children (e.g., those that are older than 6 months old.

Figure 36A:
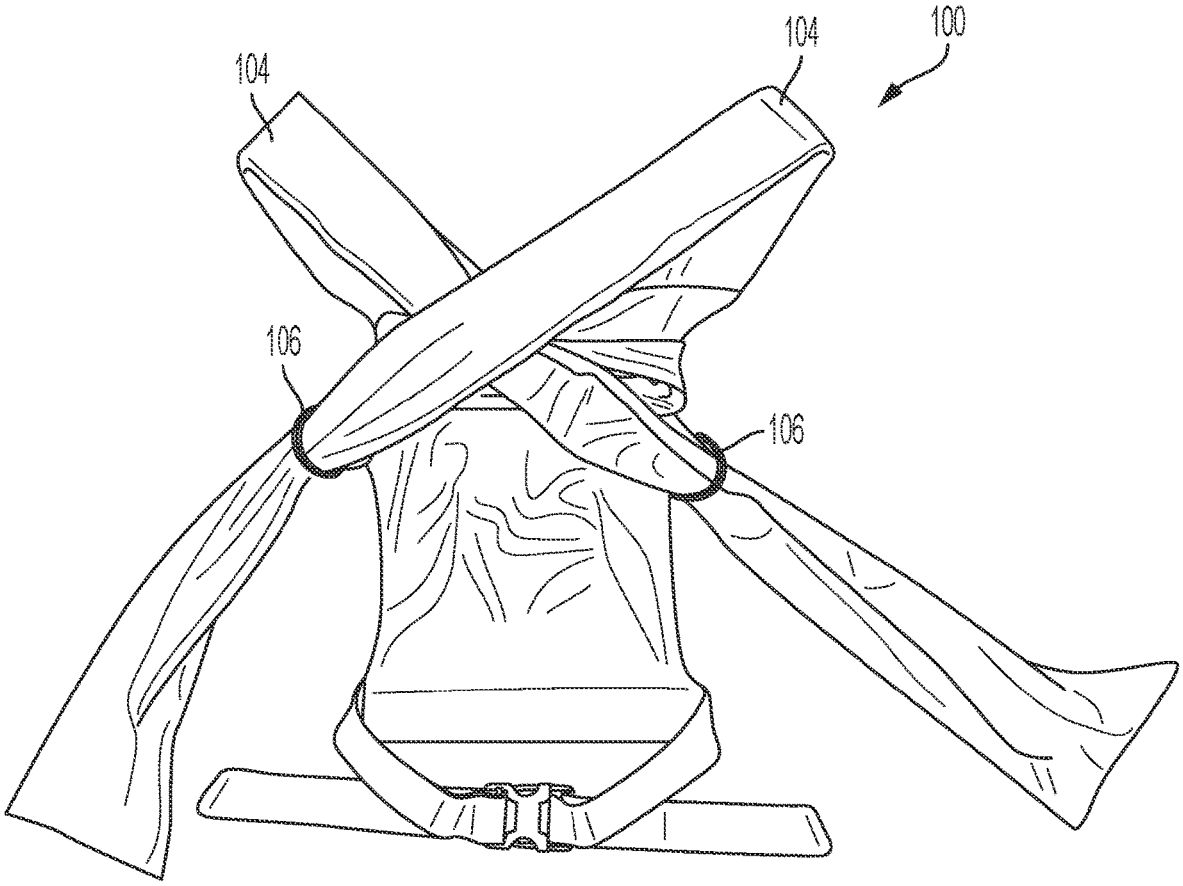
FIGS. 36A-36G, 37A-37G, and 38A-38G, and 39A-39E illustrate a process for wearing and stowing a child carrying system according to various embodiments herein.
Figure 36B:
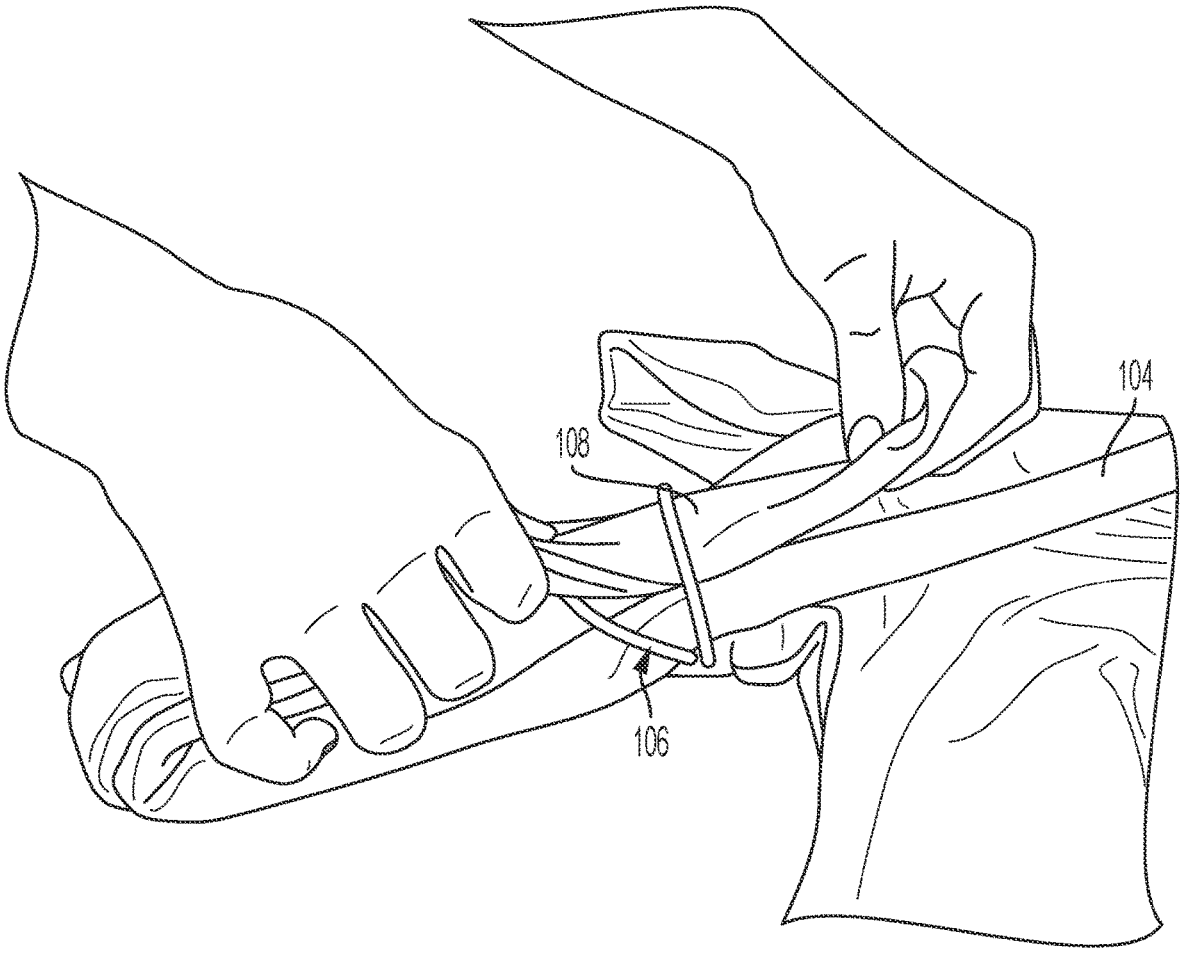

In particular embodiments, to prepare the child carrying system for front wear, a user first orients the child carrying system 100 so that the first, "3 to 6 months" indicia is facing them. The user then crosses the shoulder straps 104 and threads the distal end of each shoulder strap 104 through a fastener mechanism 114 on an opposite lateral side of the child carrying system 10 as the proximal end of the shoulder strap 104 as shown in FIG. 36A. In doing so, the user threads the distal end of each strap through both rings of each respective fastener mechanism 114 from the inside to the outside. The user then loops the strap back over the outside ring and under and through the inside ring (See FIGS. 36B and 36D). This serves to adjustably maintain each strap in place relative to the fastener mechanism so that the shoulder straps are maintained at the length desired by the user.

Figure 36C:
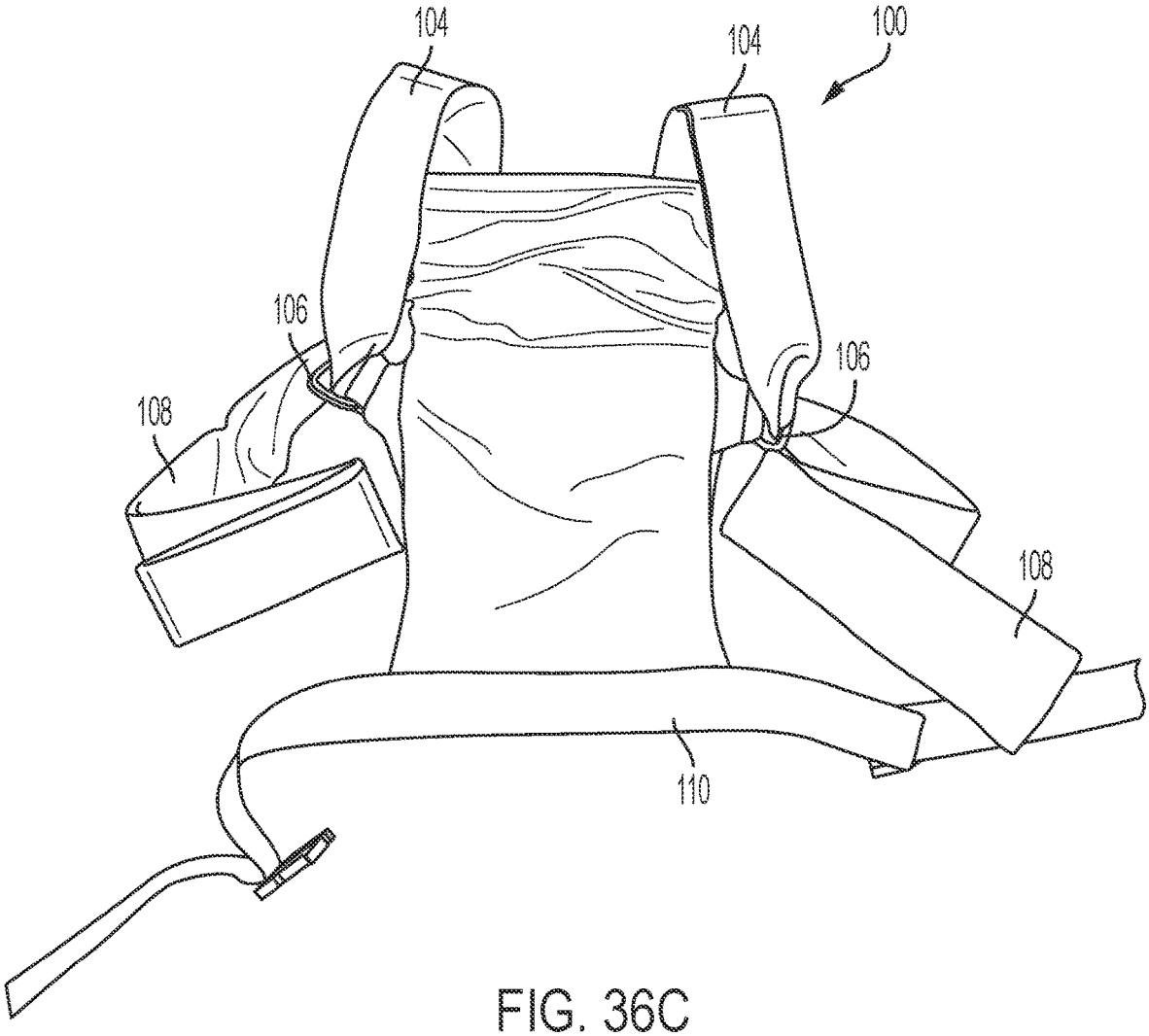
Figure 36D:
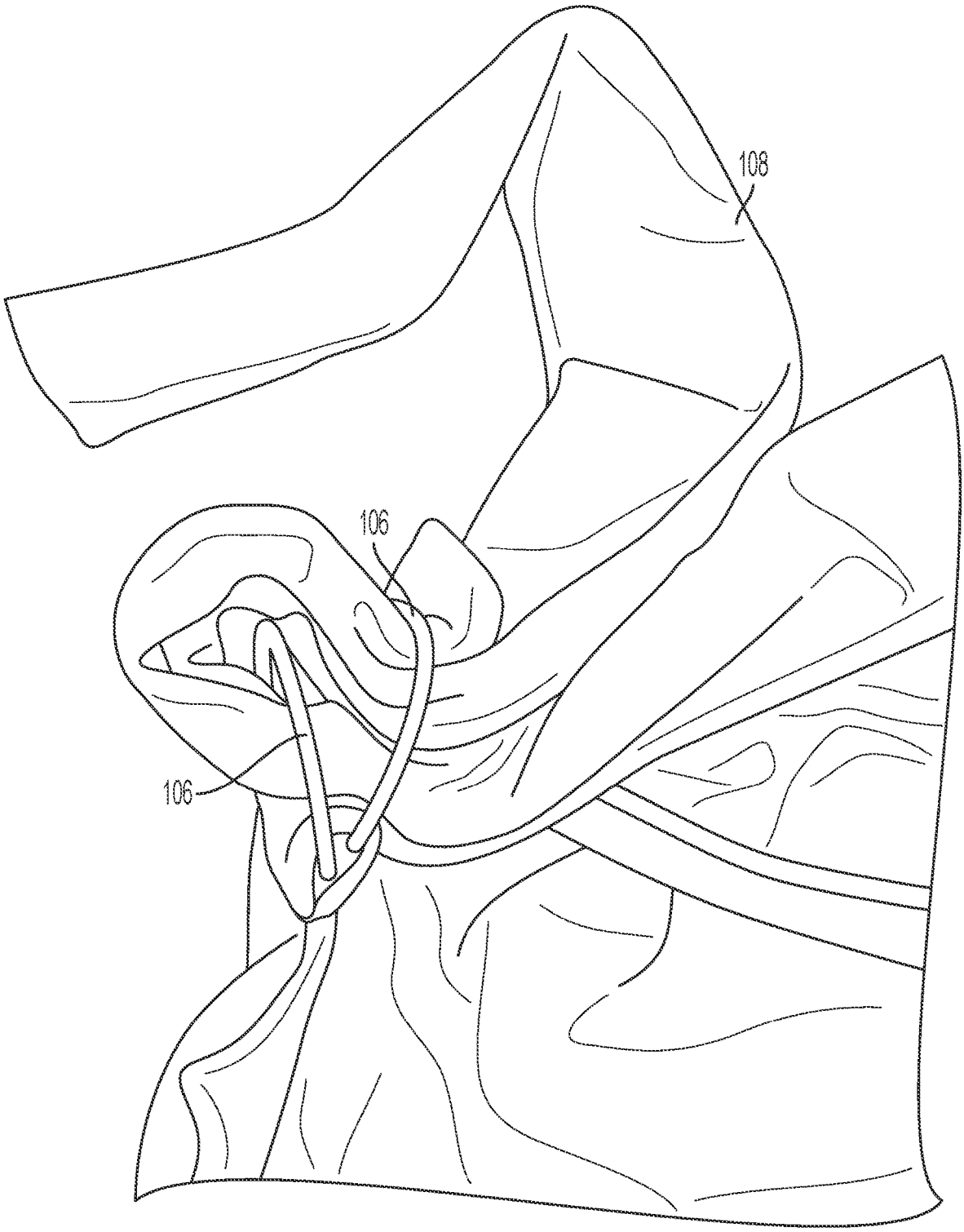

To prepare the child carrying system for back wear, in various embodiments, the user first orients the child carrying system 100 so that the first, "3 to 6 months" label is facing the user. The user then threads the distal end of each shoulder strap 104 through a fastener mechanism 114 on the same lateral side of the child carrying system as the proximal end of the shoulder strap 104, as shown in FIG. 36C. In doing so, the user threads the distal end of each strap through both rings of each respective fastener mechanism 114 from the inside to the outside. The user then loops the strap back over the outside ring and under and through the inside ring. This serves to adjustably maintain each strap in place relative to the fastener mechanism so that the shoulder straps are maintained at the length desired by the user. It should be noted that, rather than making an X with the straps for front wear, the user is creating a substantially vertical strap arrangement, like those of a backpack.

In various embodiments, the child carrying system in configured to allow the user to selectively adjust the operable length of the carrier portion 102 by wrapping a lower portion of the carrier portion 102 around the waist belt 110 before fastening the waist belt 110 around the user's waist. This may be useful, for example, when using the child carrying system 100 to carry younger and/or shorter children.

Figure 36E:
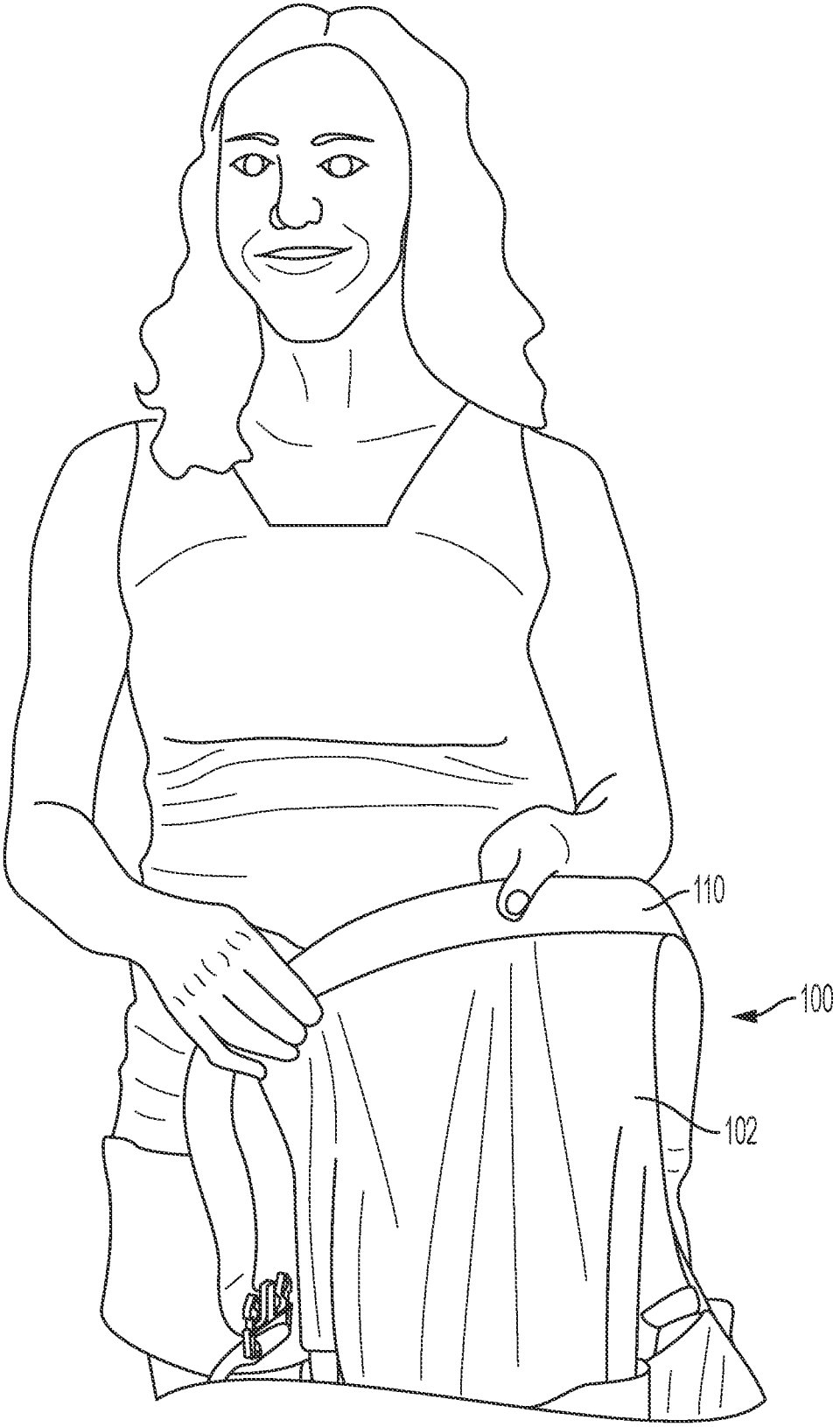
Figure 36F:
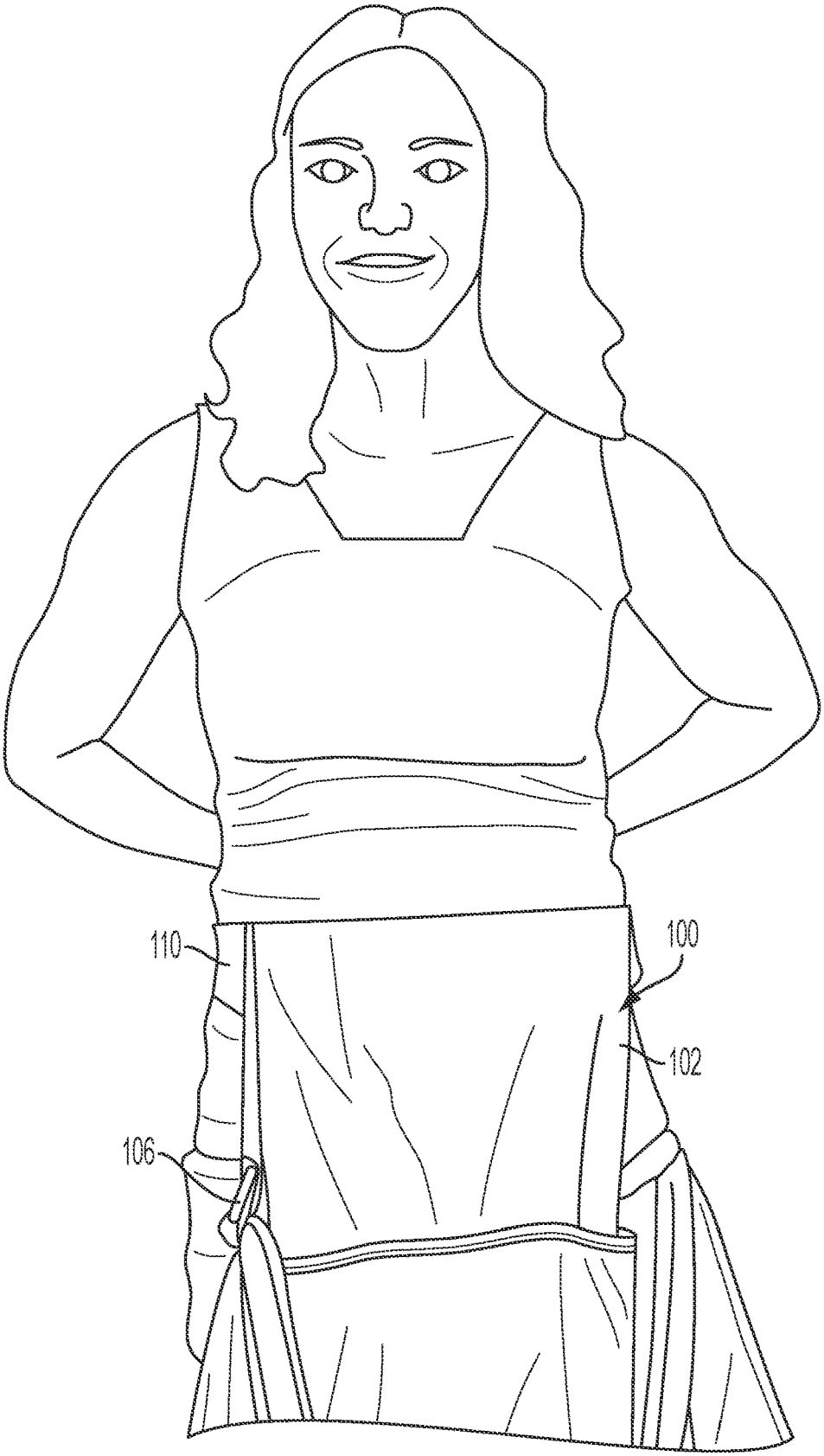
Figure 36G:
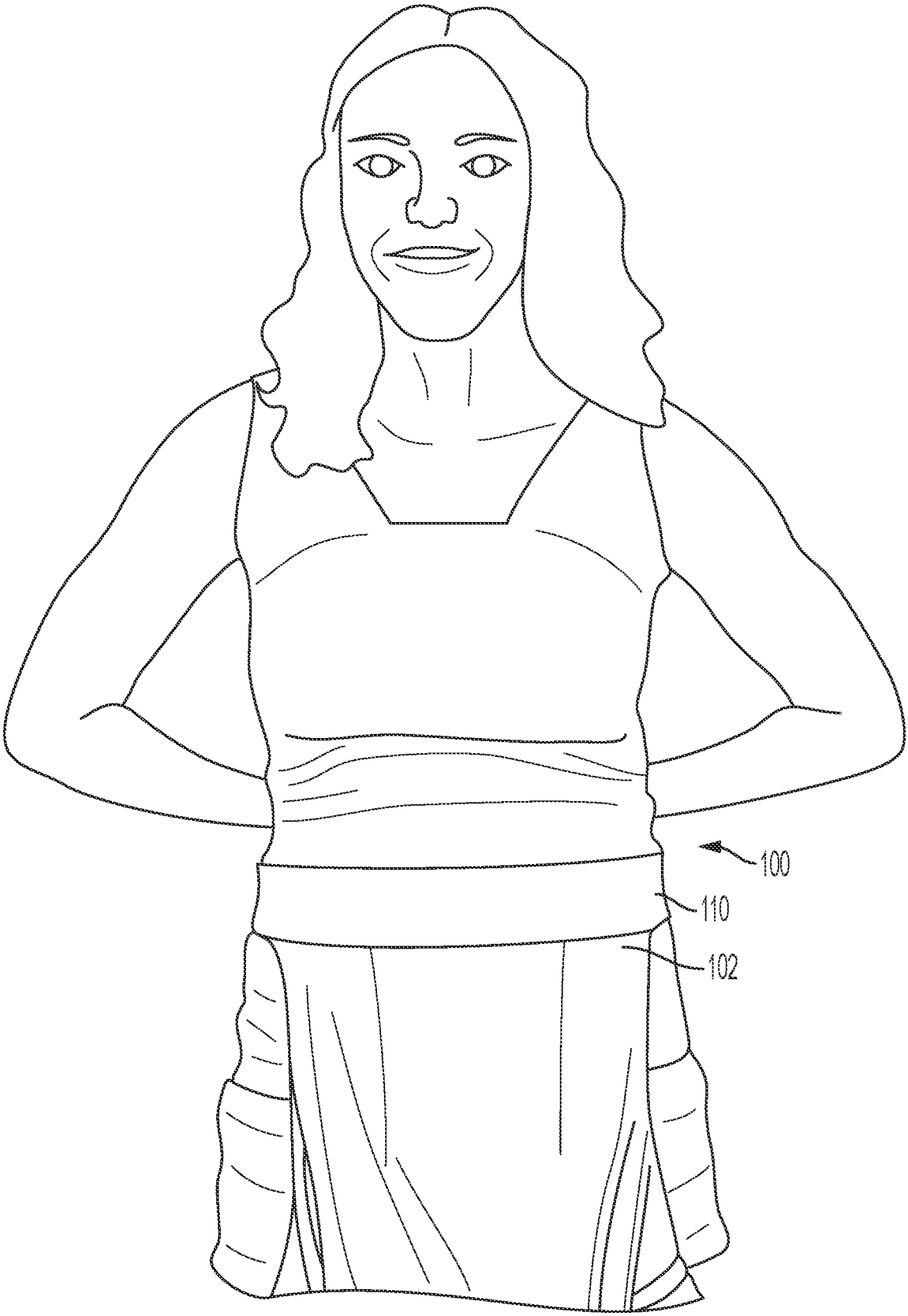

For example, in one embodiment, to use the child carrying system 100 with a child that is 3-6 months old, the user first shortens the carrier portion 102 by wrapping the bottom of the carrier portion around the waist belt 110 twice before wrapping the waist belt 110 around the user's waist and fastening it together (e.g., like a belt)—See FIGS. 36E and 36F. For larger children (e.g., those over 6 months old), in various embodiments, the carrier portion 102 doesn't need to be shortened. The user simply wraps the waist belt 110 around their waist and fastens it together (See FIG. 36G).

Figure 37A:
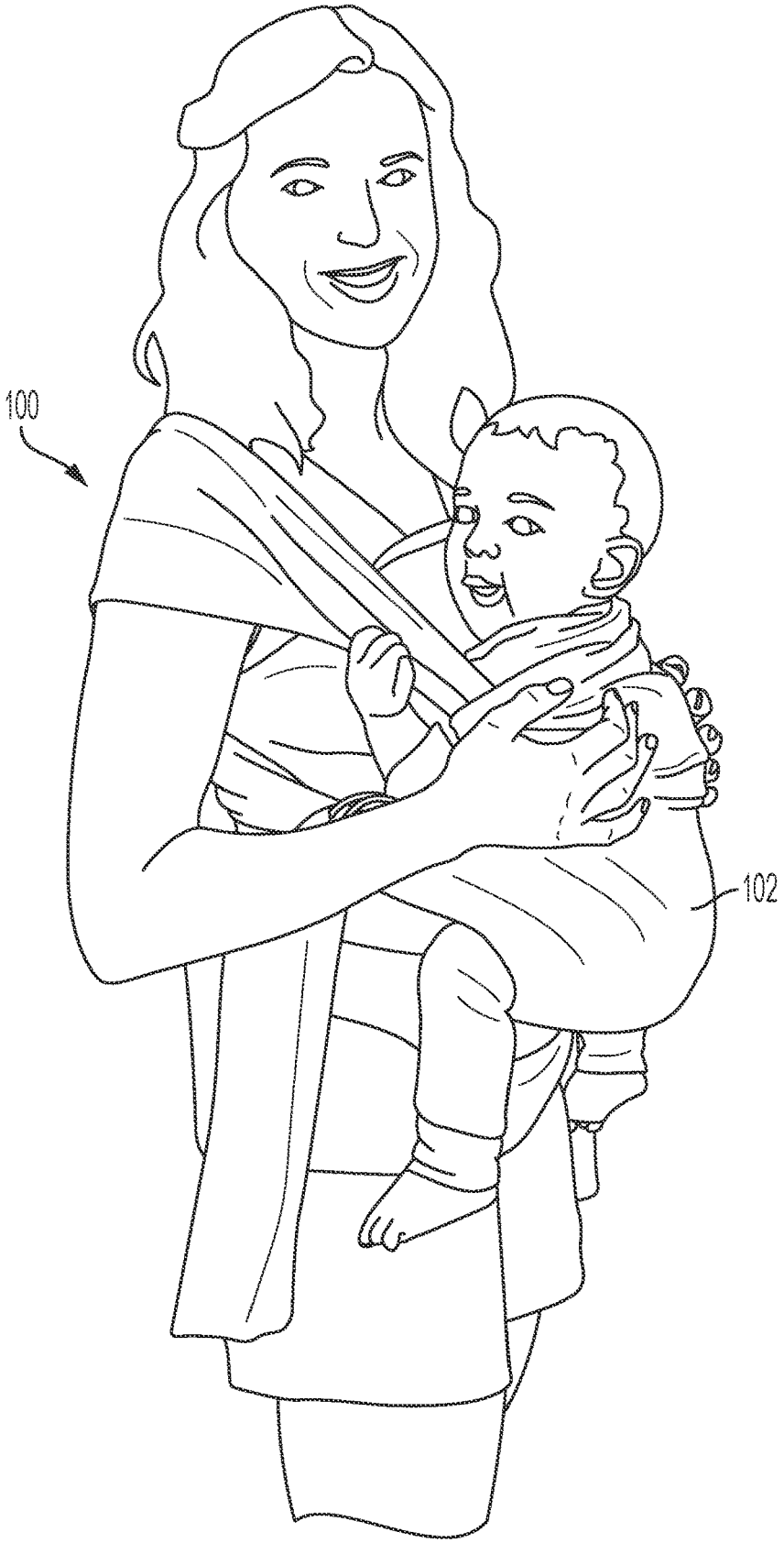
Figure 37B:
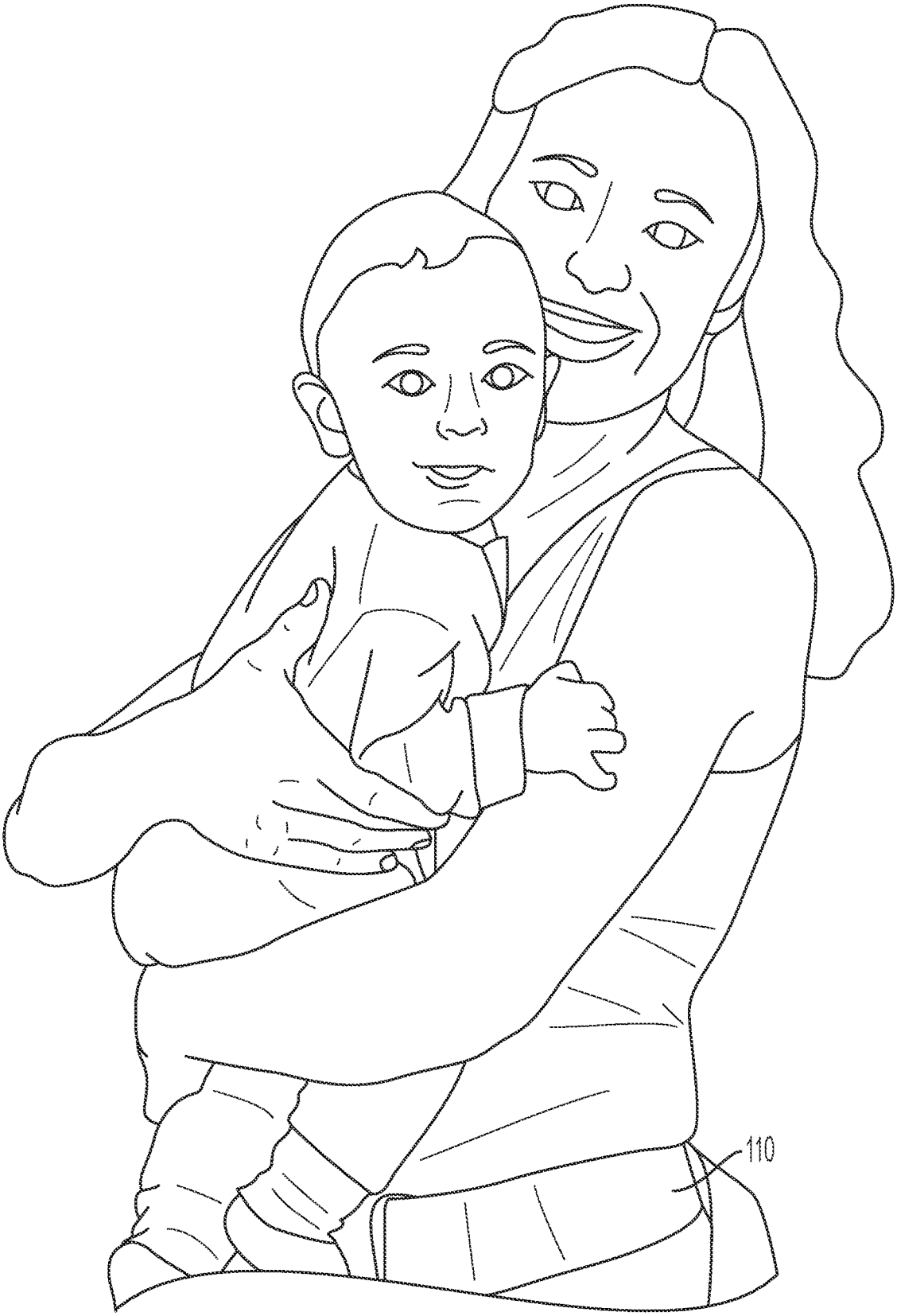
Figure 37C:
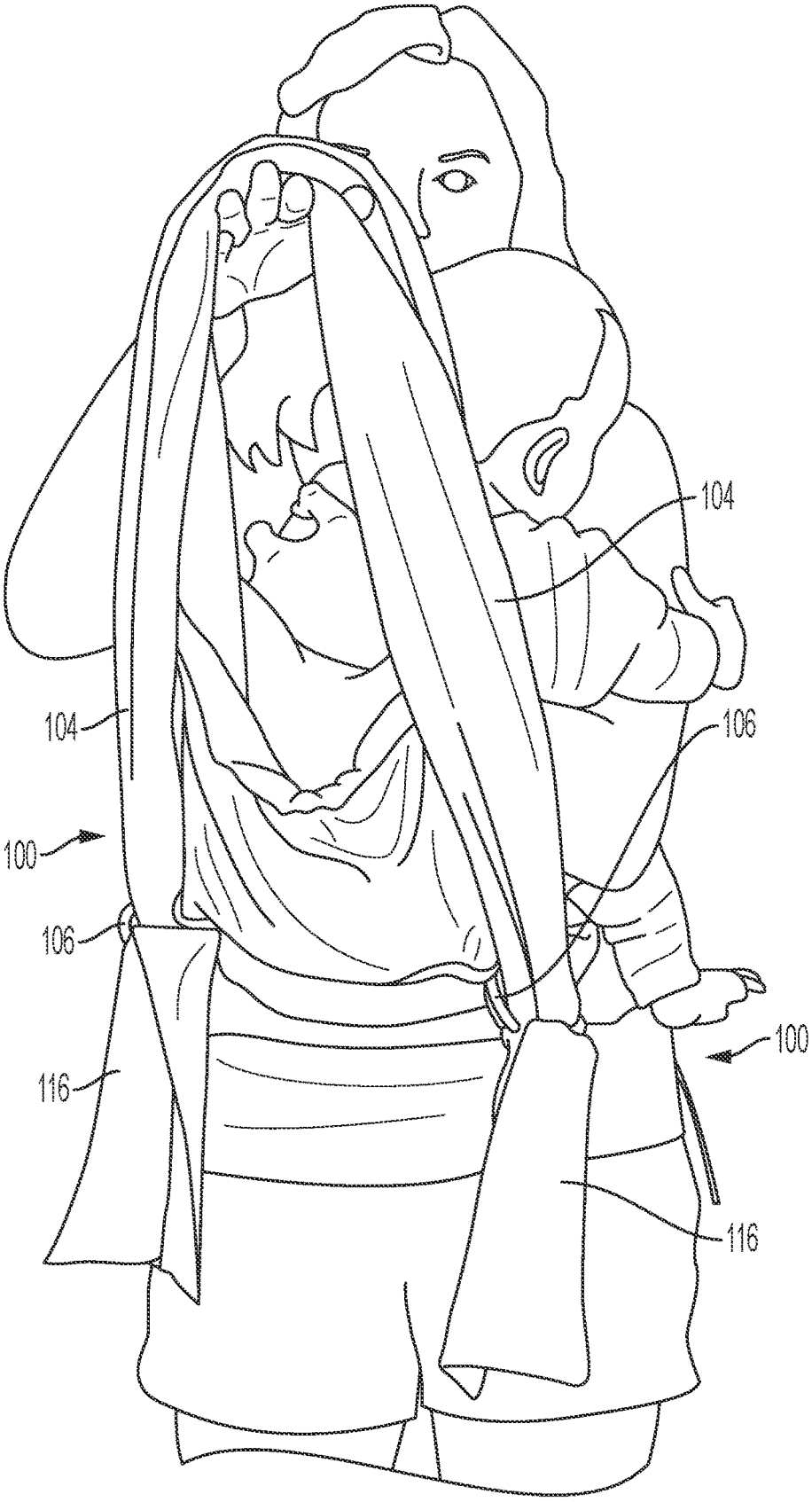
Figure 37D:
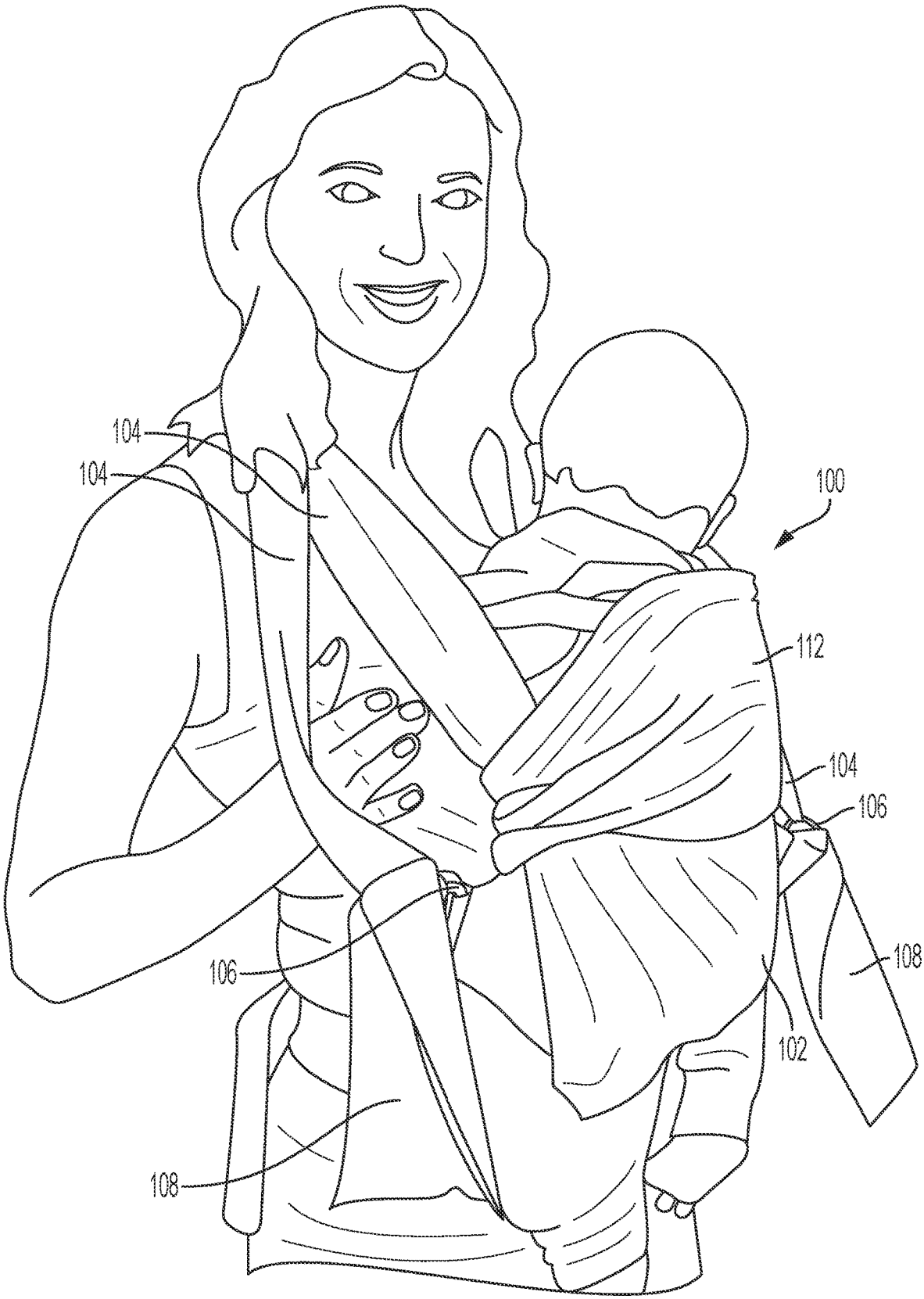
Figure 37E:
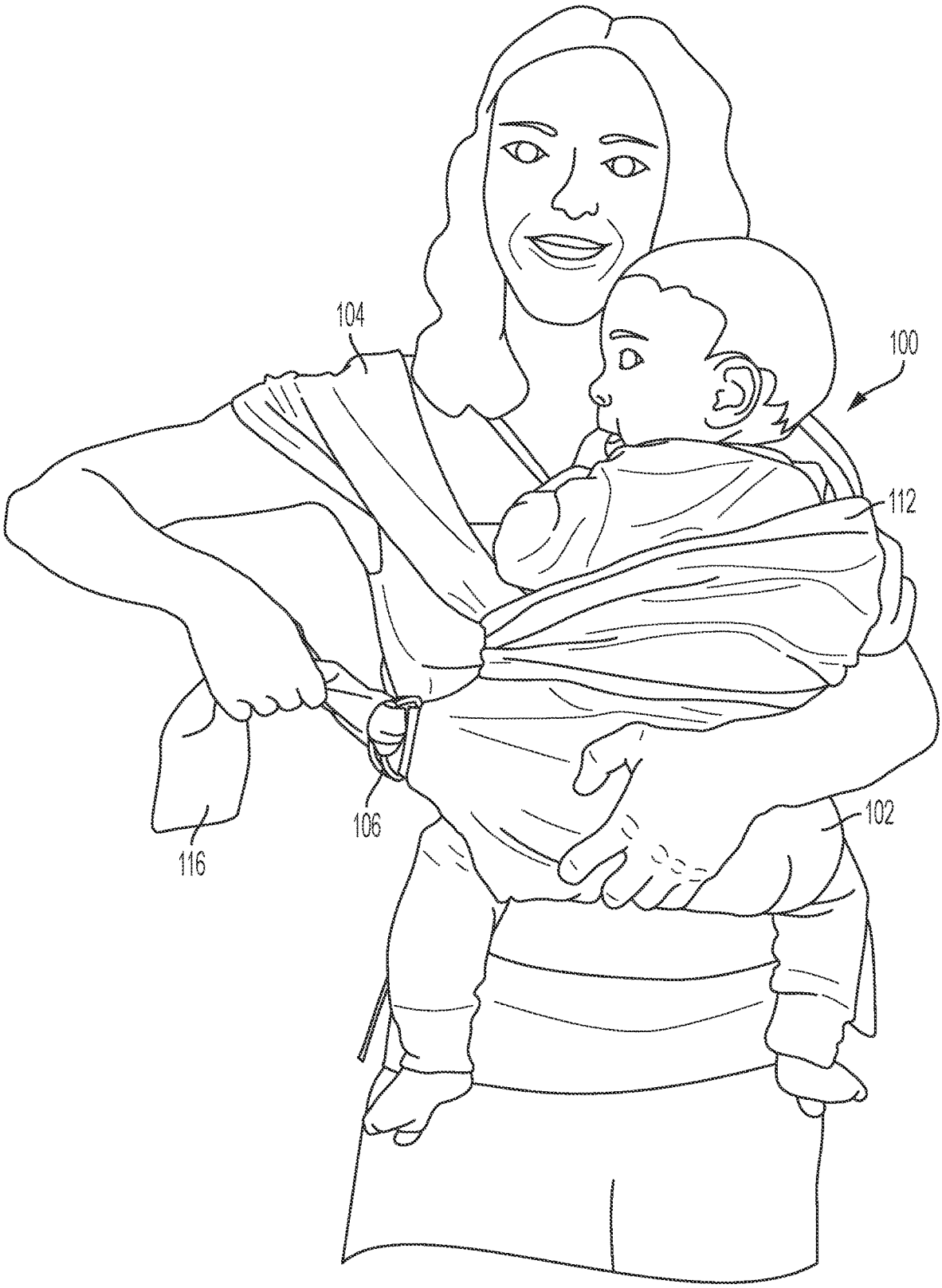

To front carry a child, a user may follow the following steps, which are illustrated in FIGS. 37A-37F. First, as shown in FIG. 37B, the user wraps the waist belt around their waist and attaches it so that the buckle is on their back. In various embodiments, the higher the user places the waist belt on their body, the higher the child will be. Next, as shown in FIG. 37C, while the carrier is hanging in front of the user, the user holds the child against their chest. The user then lifts both shoulder straps up and over their head so the straps rest behind the user's neck. Next, as shown in FIG. 37D, the user inserts their left arm between the two fabric straps on the user's left. The user then inserts their right arm between the two fabric straps on their right. On both sides, the strap fabric going into the fastener mechanism's rings should be the farthest outside and the strap fabric going to the pouch should be on the inside (See FIG. 37E).

Figure 37F:
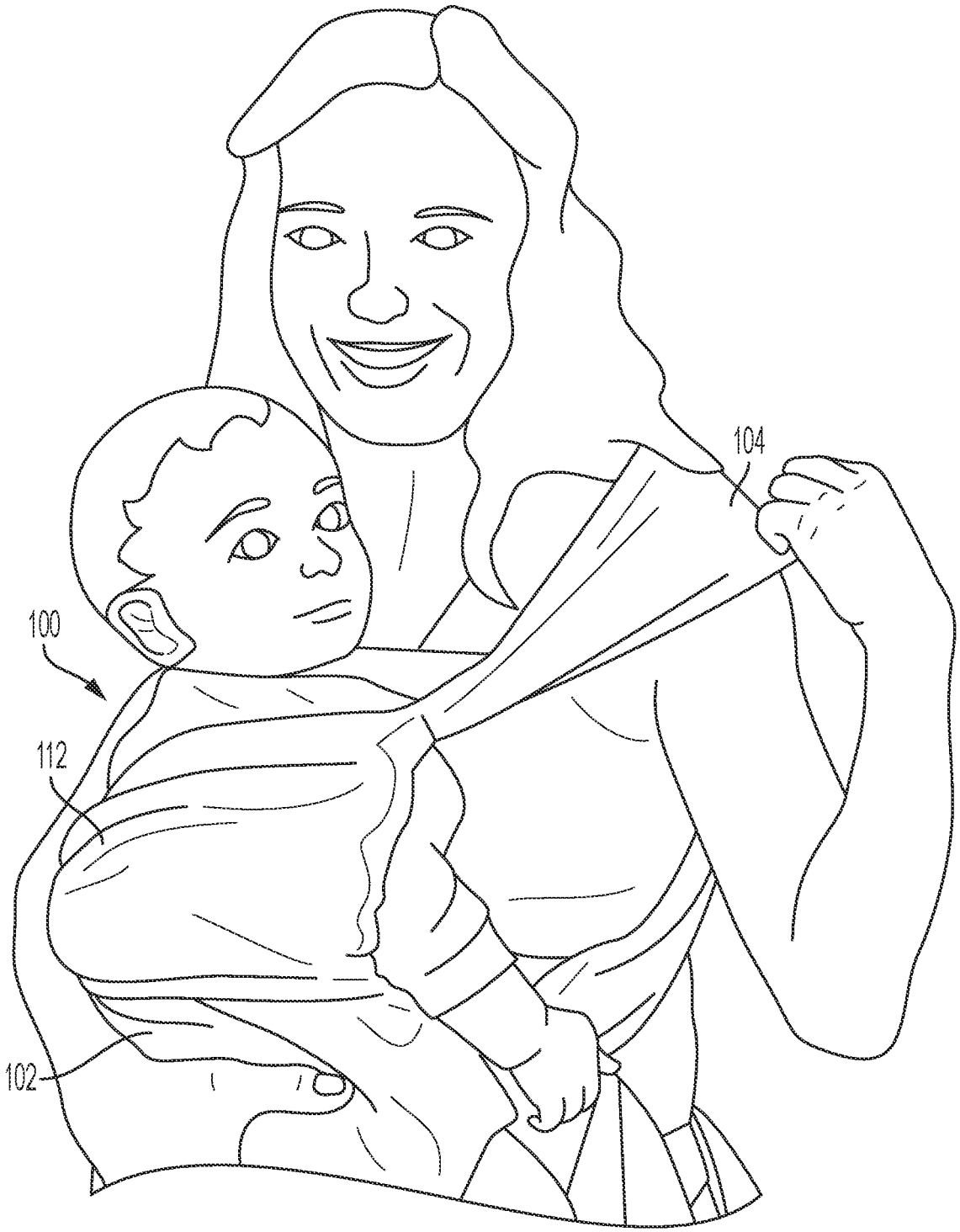
Figure 37G:
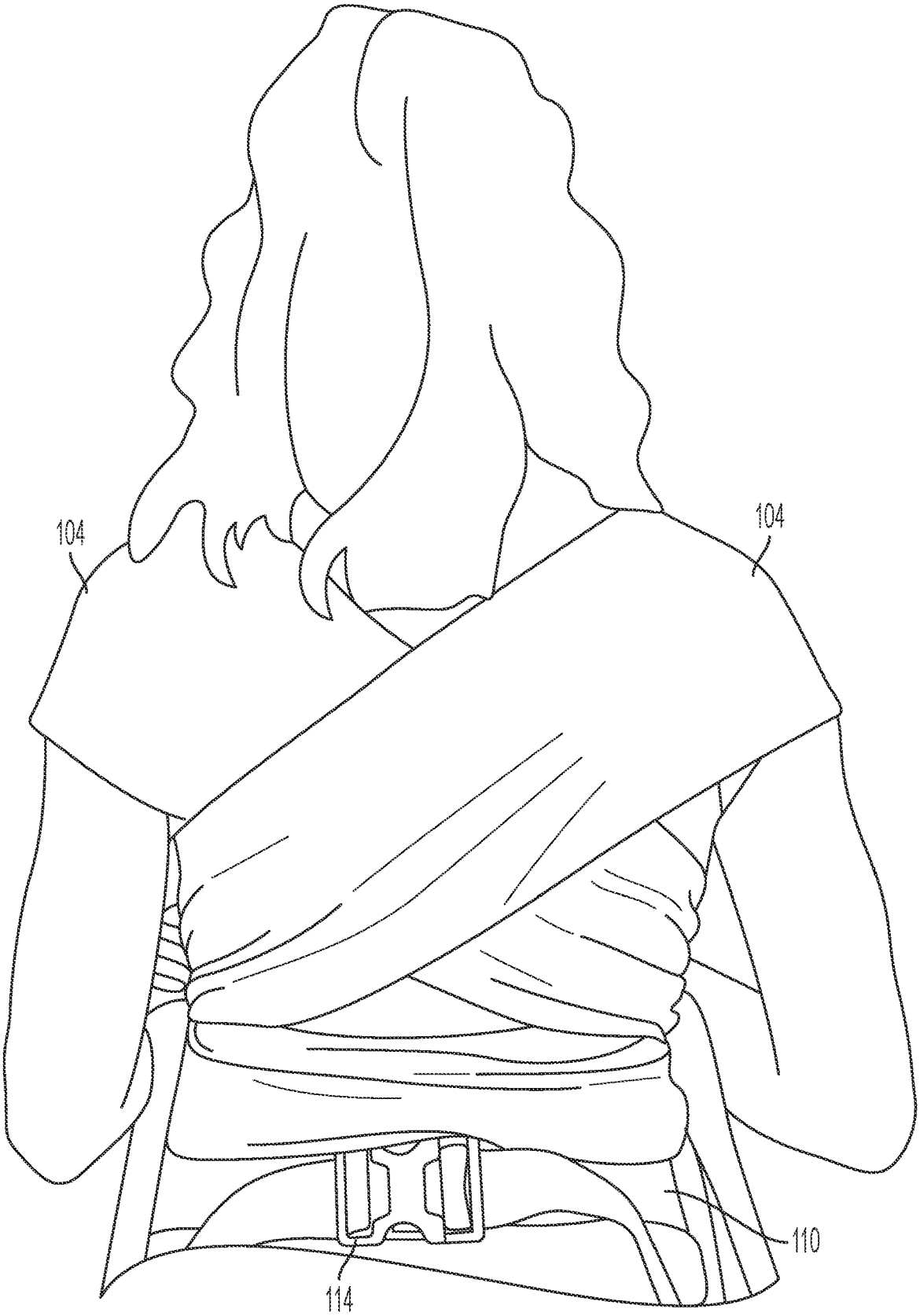

Next, the user adjusts the carrier portion to position the child where the user wishes them to be held adjacent the user's body). The user then pulls the distal end "tail" of each should strap 104 at each fastener mechanism 114 toward the user's back to tighten the carrier portion 102 and to secure the child against the user's body (See FIG. 37E). It is noted that the user can pull either shoulder strap 104 down and across their back towards the fastener mechanism 114 first, and then pull the strap tail to tighten the shoulder strap 104 in place. This method makes tightening the straps easier. Finally, as shown in FIG. 37F, the user may optionally spread the fabric of the shoulder straps 104 across their respective shoulder to increase comfort by distributing the child's weight more evenly across the user's body. For reference, FIG. 37G shows the shoulder straps 104 in a crossed arrangement across the user's back after the fabric straps 104 have been spread out across the user's shoulders.

Figure 38A:
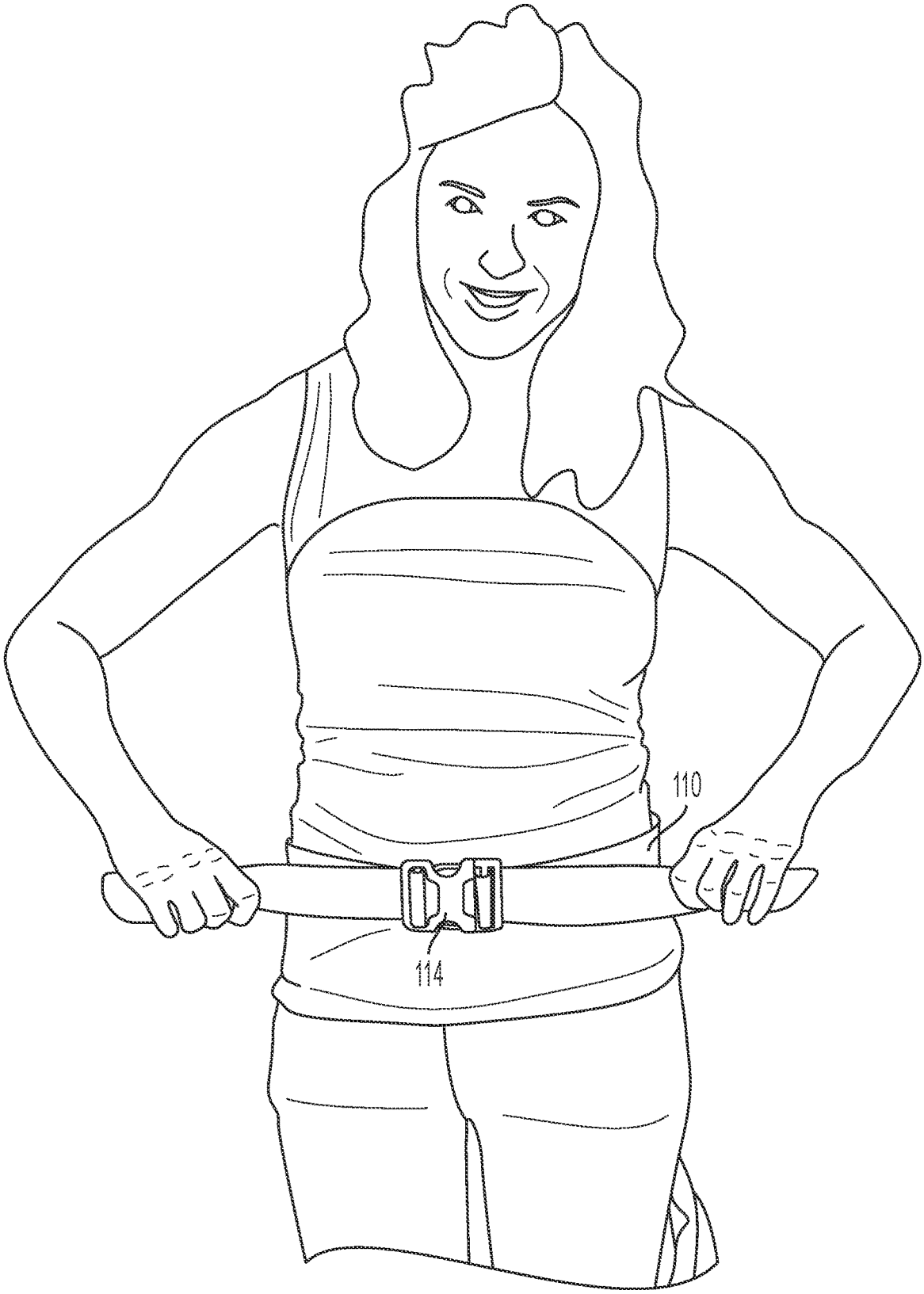
Figure 38B:
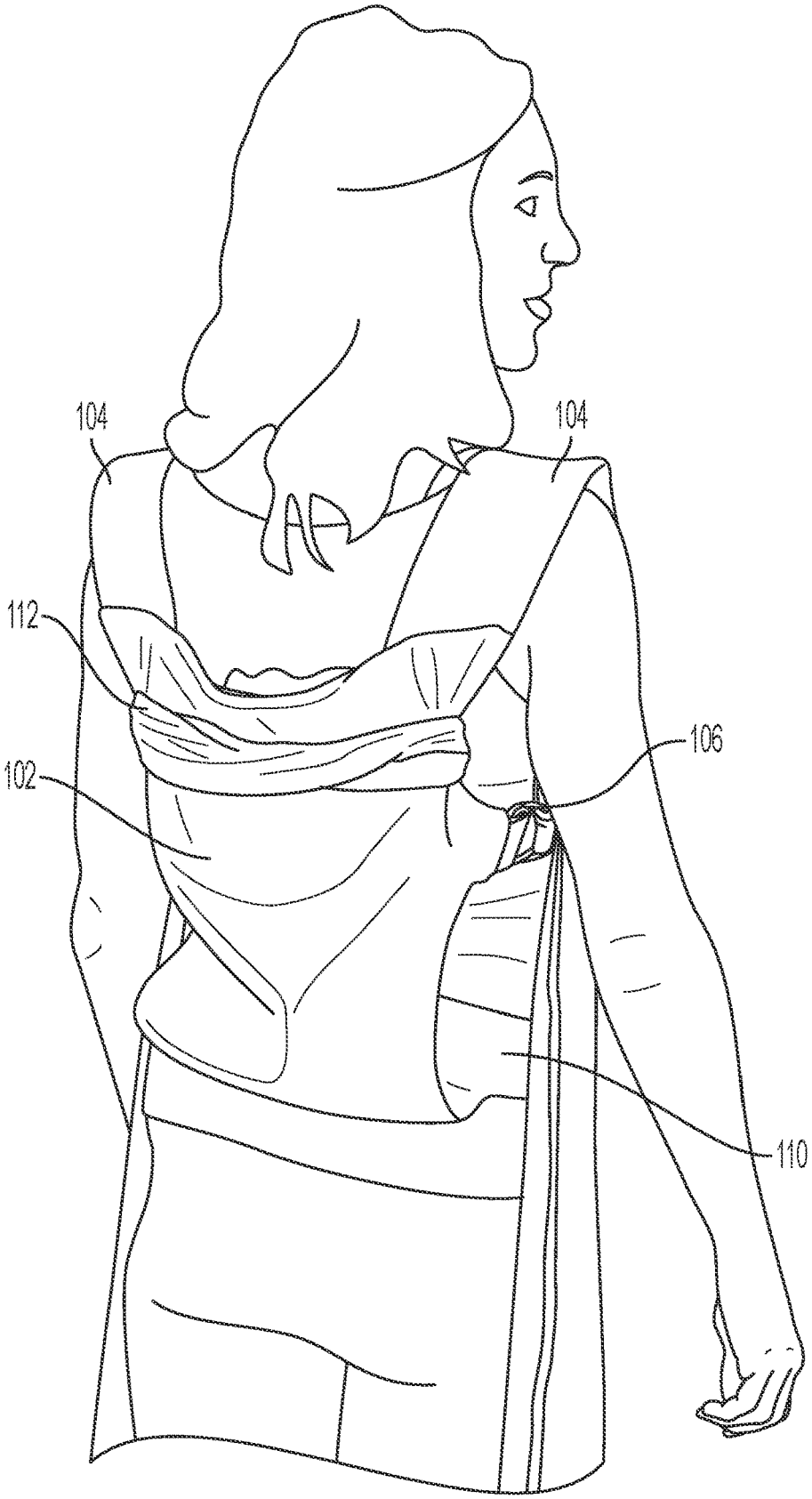
Figure 38C:
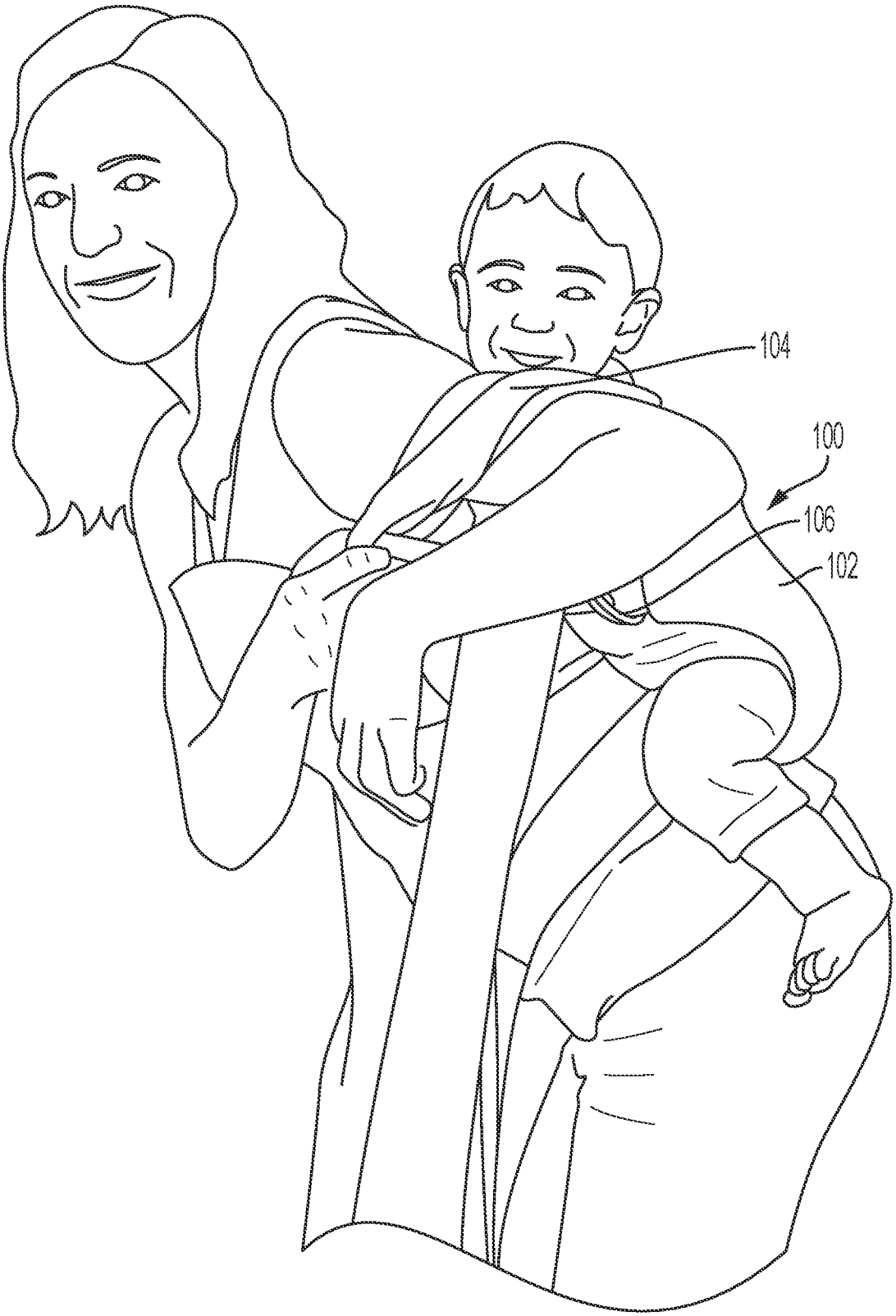
Figure 38D:
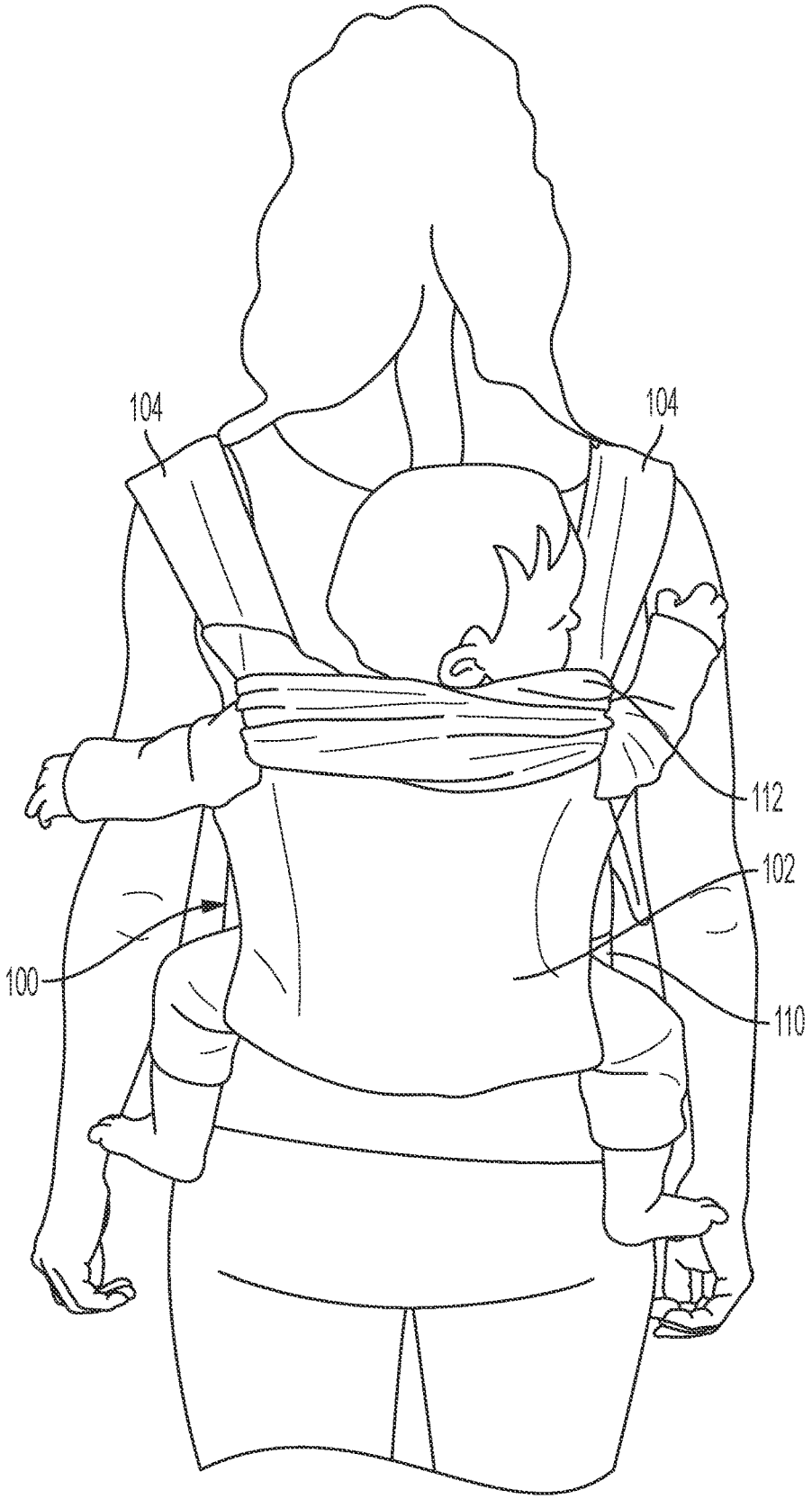
Figure 38E:
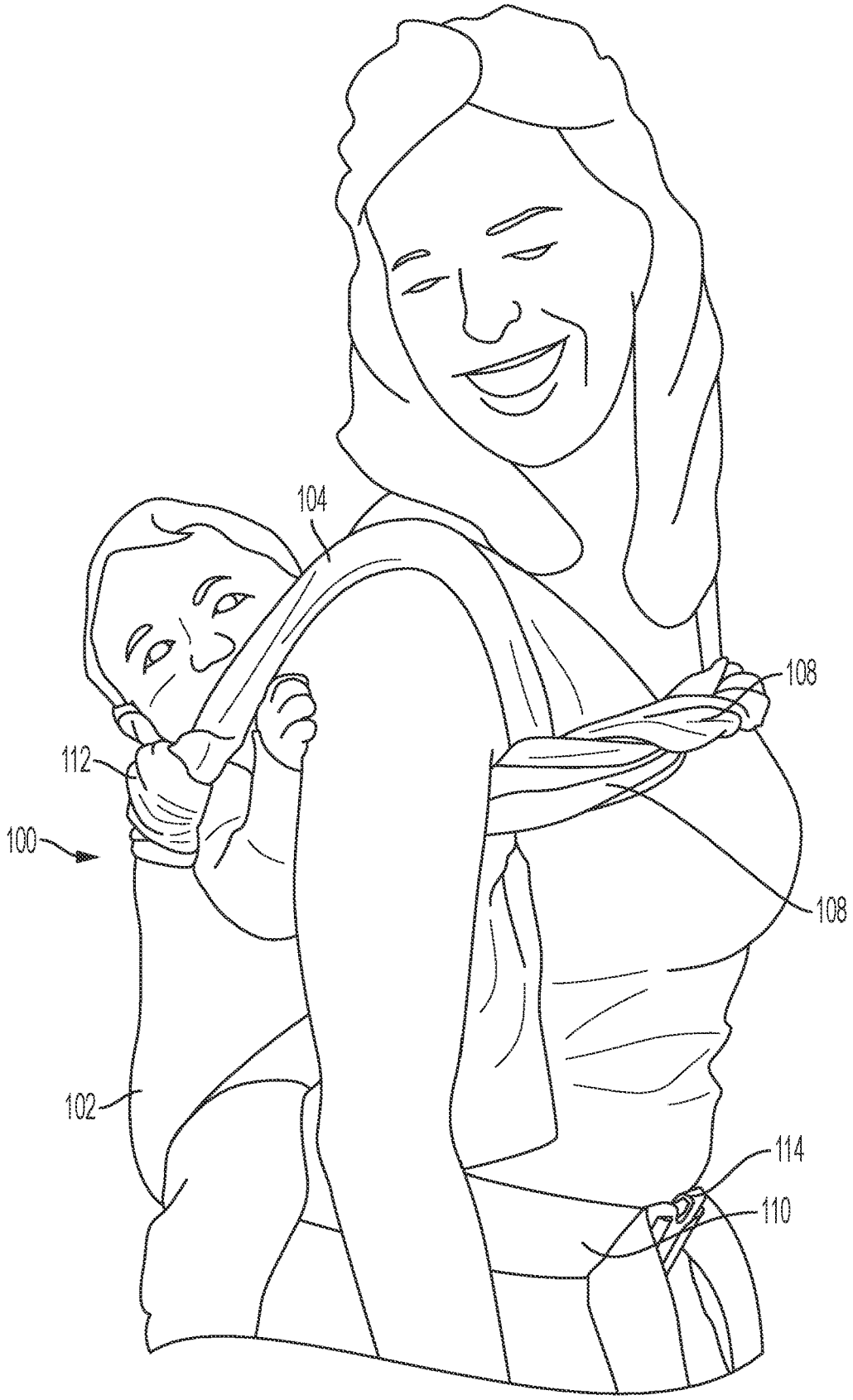
Figure 38F:
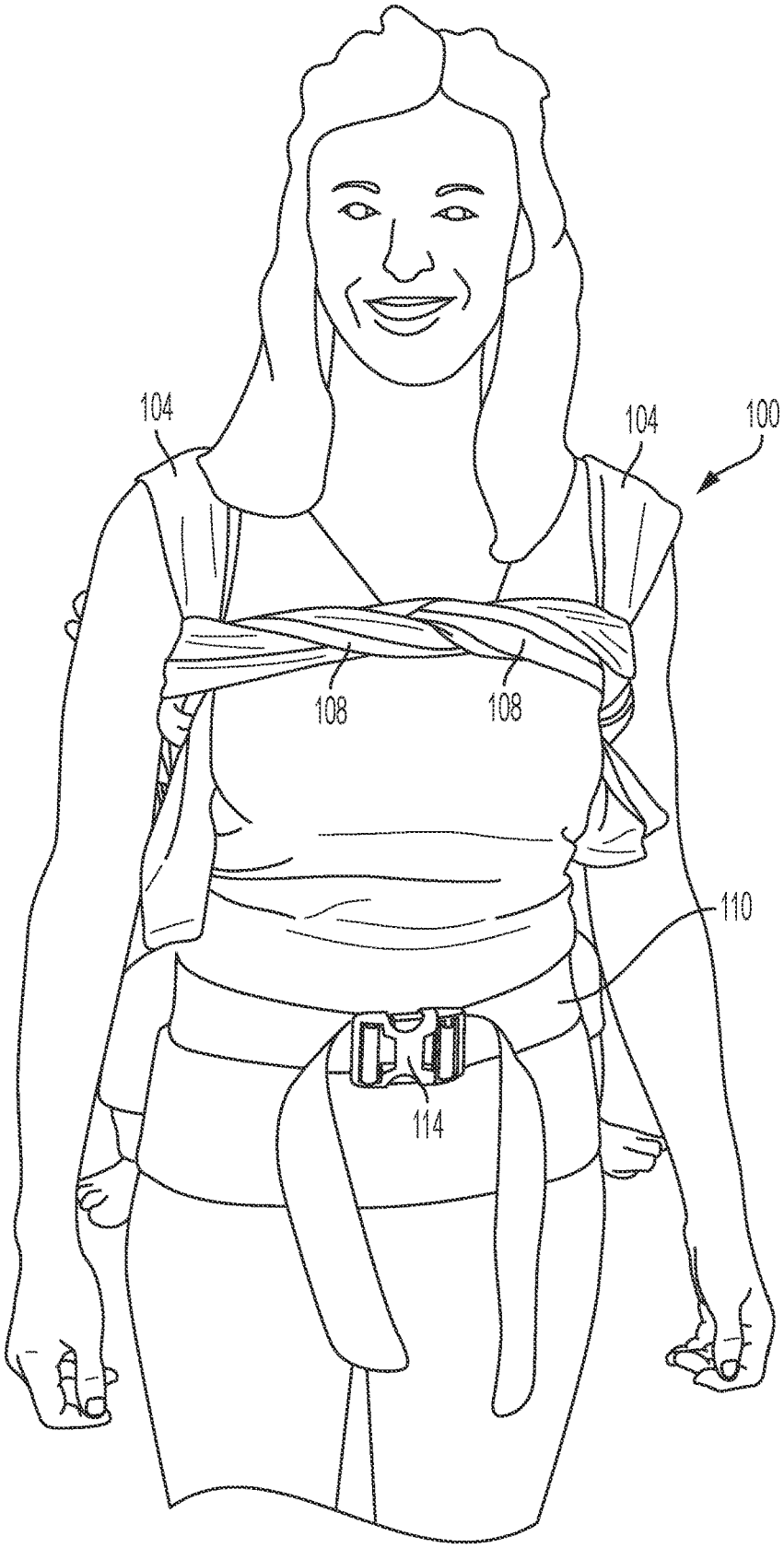
Figure 38G:
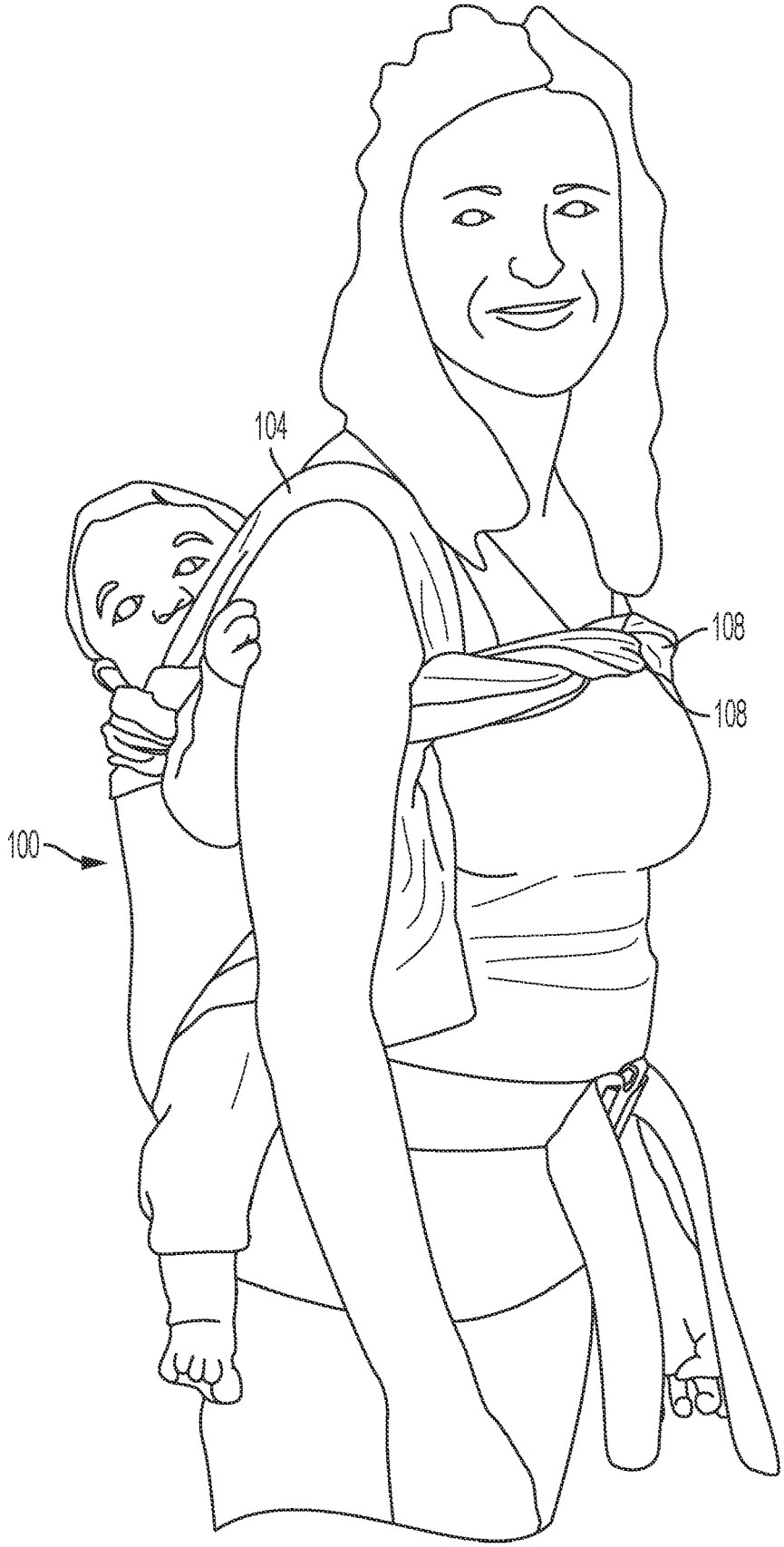

To back carry a child, the user may follow the following steps. First, the user wraps the waist belt around their waist and attaches it so that the buckle is on their front (e.g., adjacent their navel)—See FIG. 38A. Next, as shown in FIG. 38B, the user places the shoulder straps 104 over the user's shoulders and tightens the shoulder straps 104 leaving only a small amount of slack. The user should secure the distal ends of the shoulder straps 104 through the respective adjustment mechanisms 106 before putting the baby into the child carrying system 100. Next, as shown in FIG. 38C, the user leans forward at the waist and places and balances the child on their back with the child's stomach on the user's back. While the user keeps a first arm on the child, the user threads their second, free arm through the first shoulder strap 104, which is adjacent the user's second, free arm. The user then switches arms holding the child and continues holding the child with their second arm (which is already through a strap) while the user threads their first arm through the second shoulder strap 104. During this process, the user should optionally check to make sure the baby's bottom is centered in the pouch with one leg on either side of the pouch. The user should then then check the child's positioning and adjust the carrier accordingly. When in the correct position, the child's shoulders should, in various embodiments, be covered by the pouch. Once the child is positioned correctly, the users tightens the shoulder straps 104 by pulling the distal ends of the shoulder straps 104 forward until, as shown in FIGS. 38D-38E and 38G, the child carrying system 100 is comfortable and snug. The user may then optionally spread the fabric of the shoulder straps 104 across their shoulders to distribute the child's weight across the shoulders or simply leave the fabric narrow depending on the user's preference. The user may then take any suitable action with the distal "tail" ends of the shoulder straps, including without limitation the following three options. The first option is to simply leave the tail ends of the shoulder straps 104 hanging at the user's sides. A second option is to tie the tails together under the user's chest (e.g., bust). A final option is to tie the tails together above the user's chest/bust as shown in FIG. 38F.

Figure 39A:
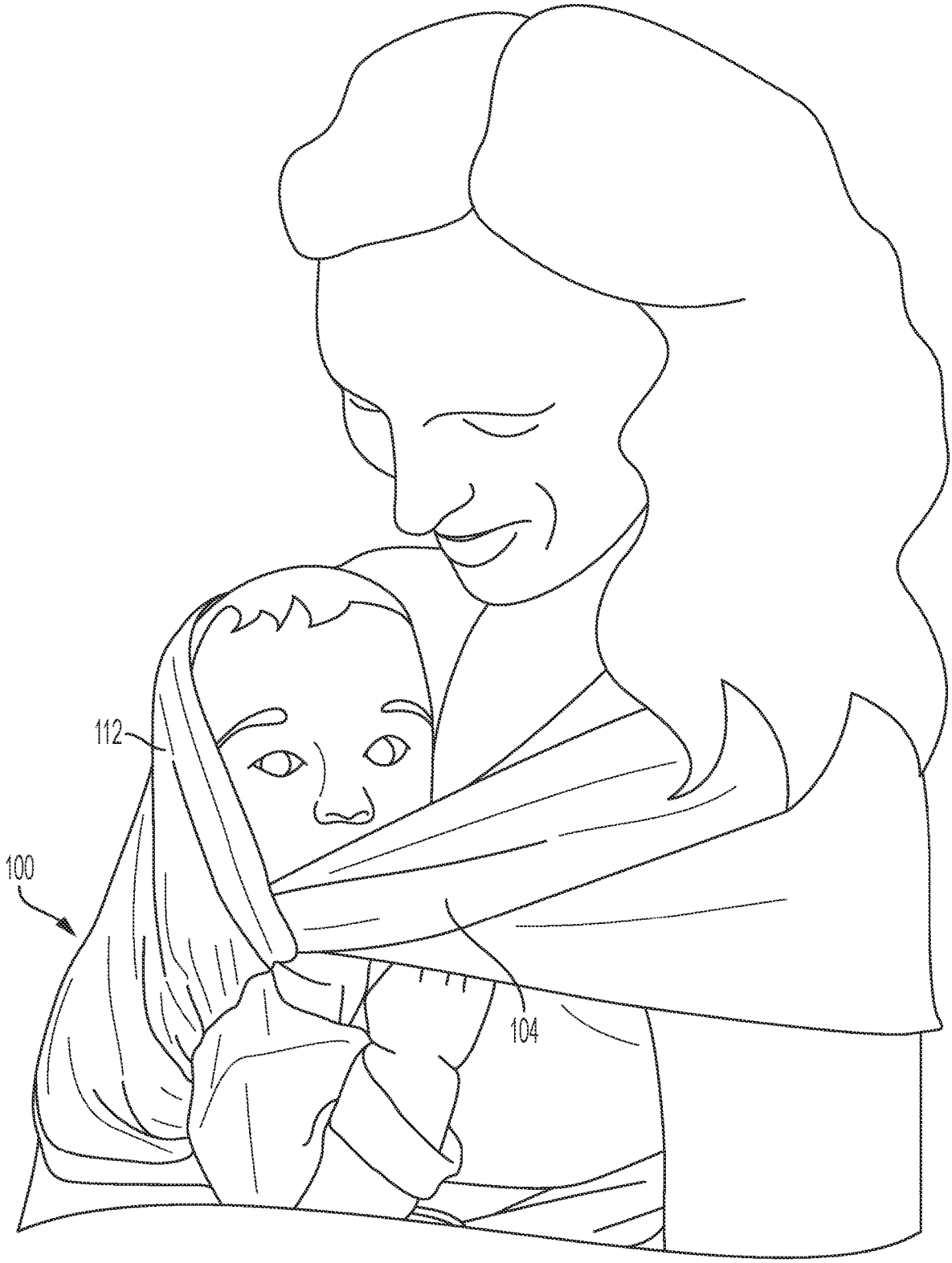
Figure 39B:
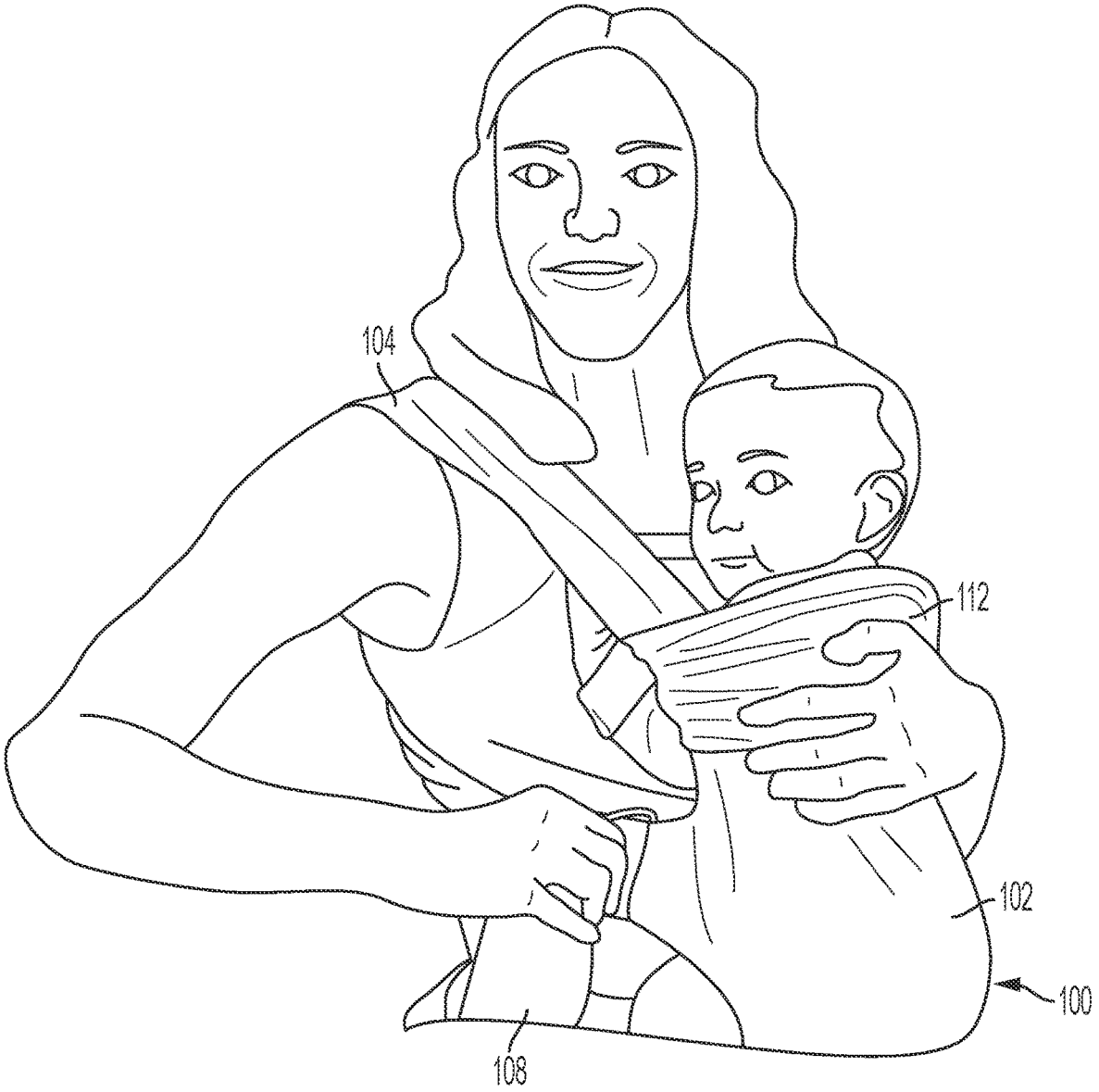

It is noted that, in various embodiments, the head support 112 has two layers. It may be advantageous to use both layers to support the child's head while they are sleeping. As mentioned above, in various embodiments, the head support is slideably attached on each lateral side to a respective one of the fabric shoulder straps 104. As a result, in such embodiments, it is possible to raise and lower each side of the head support independently. For example, the user may raise the left side of the head support into a fully extended position and only partially raise the right side of the head support so that the back side of the child's head is fully supported, but so that the child's face is visible while the child is sleeping (See FIG. 39A). It should be understood that the user may alternatively orient the head support so that: (1) both sides of the head support are fully extended;

(2) both sides of the head support are fully retracted (e.g., so that the child's head is not supported by the head support and the child has freedom to move their head without restriction—See FIGS. 38G and 39B); and/or (3) the left and right sides, are, respectively, in any other suitable extended or retracted position.

To remove the child, the user may first loosen one or more of the shoulder straps 104 from the respective fastener mechanisms 114. The user may do this, for example, by pushing the two rings of the fastener mechanism 114 forward with one hand while pulling out some fabric, creating slack, with the other. The user then simply reverses the steps of how they put the baby on. For example, for front wear, the user may lift the fabric shoulder straps 104 back over the baby's head and the user's head. For back wear, the user balances and supports the child on the user's back while the user takes their arms out of the fabric shoulder straps 104. Finally, the user releases the buckle of the waist belt 110 and stows the unit for next time.

Figure 39C:
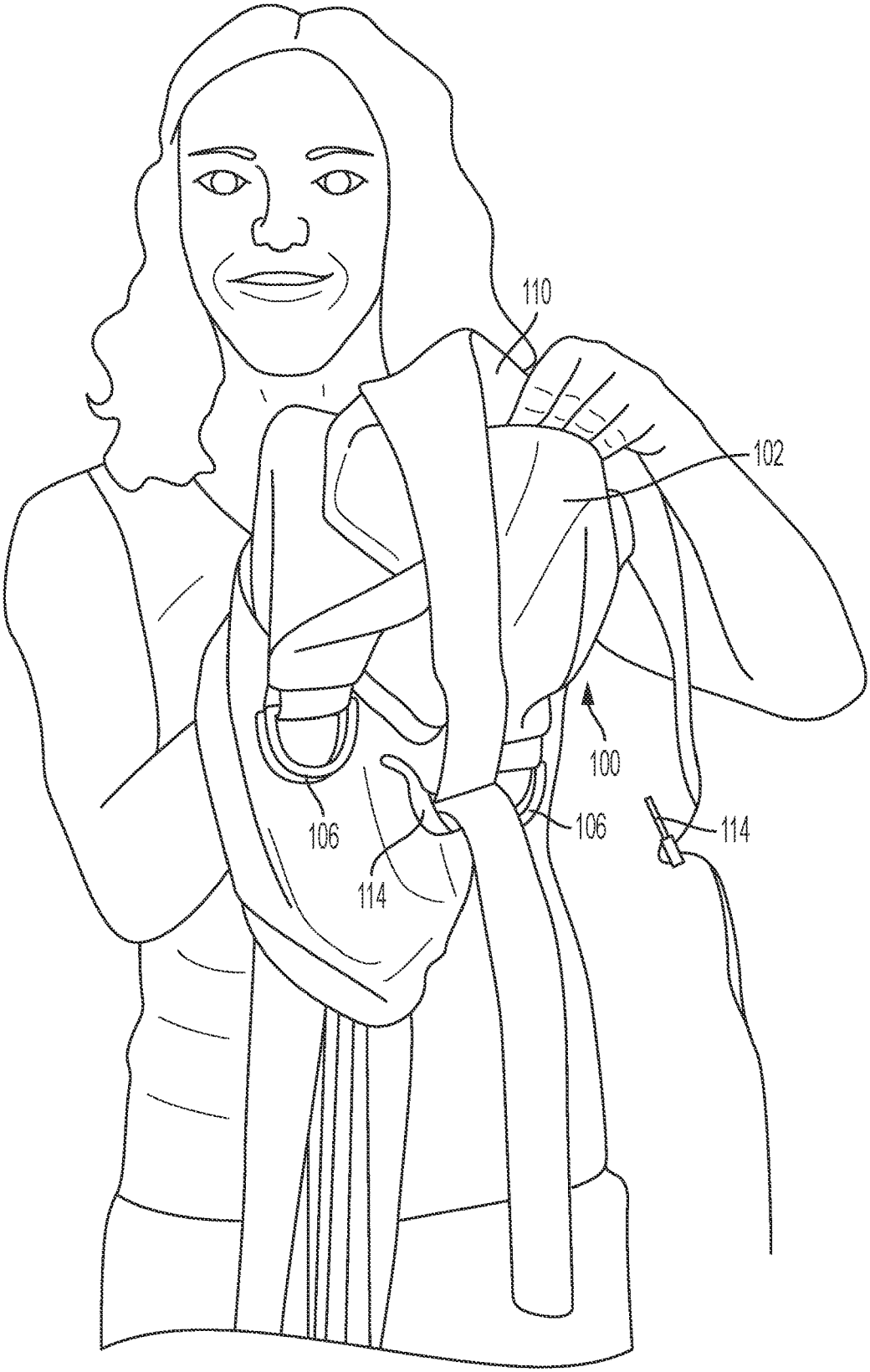
Figure 39D:
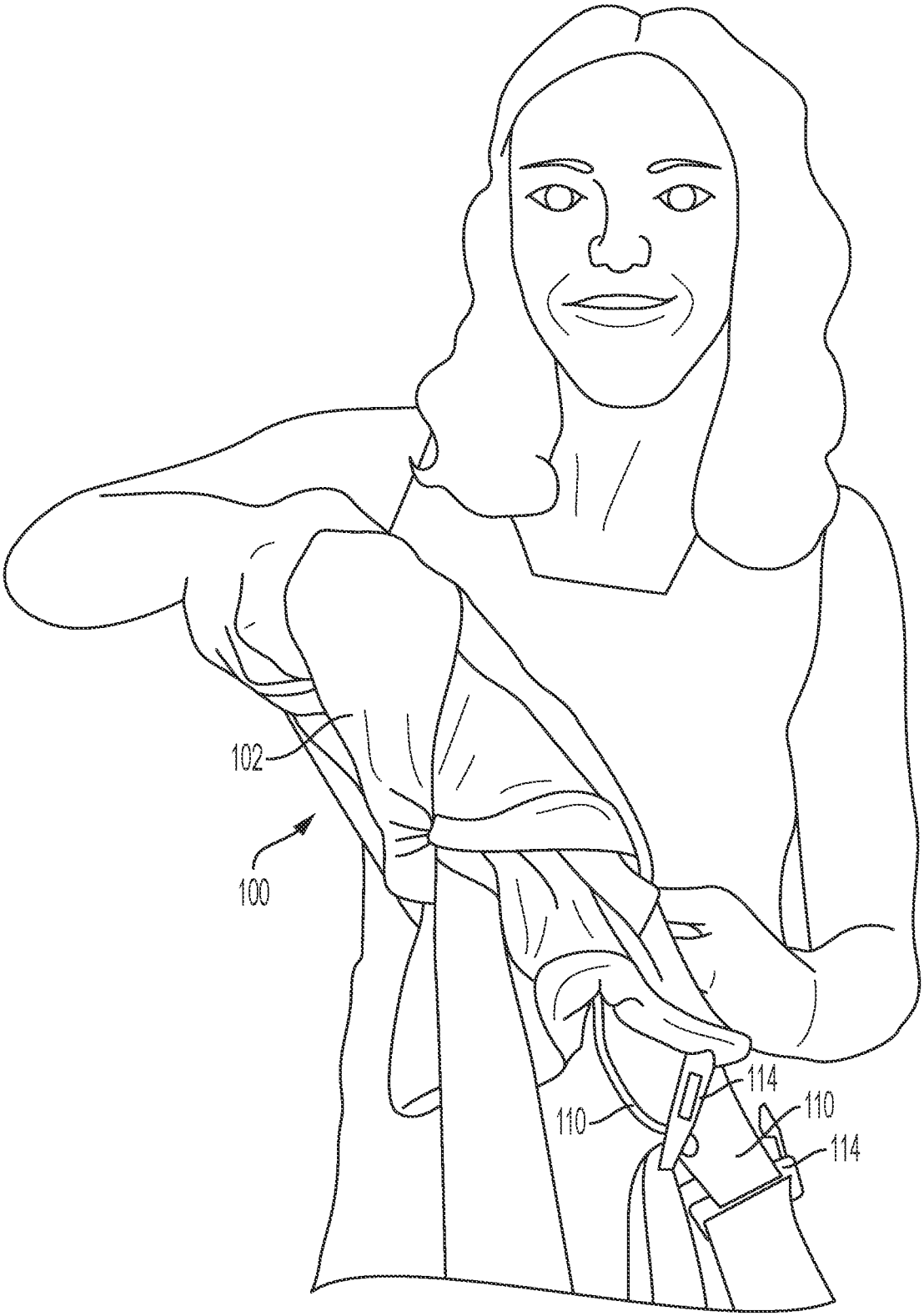
Figure 39E:
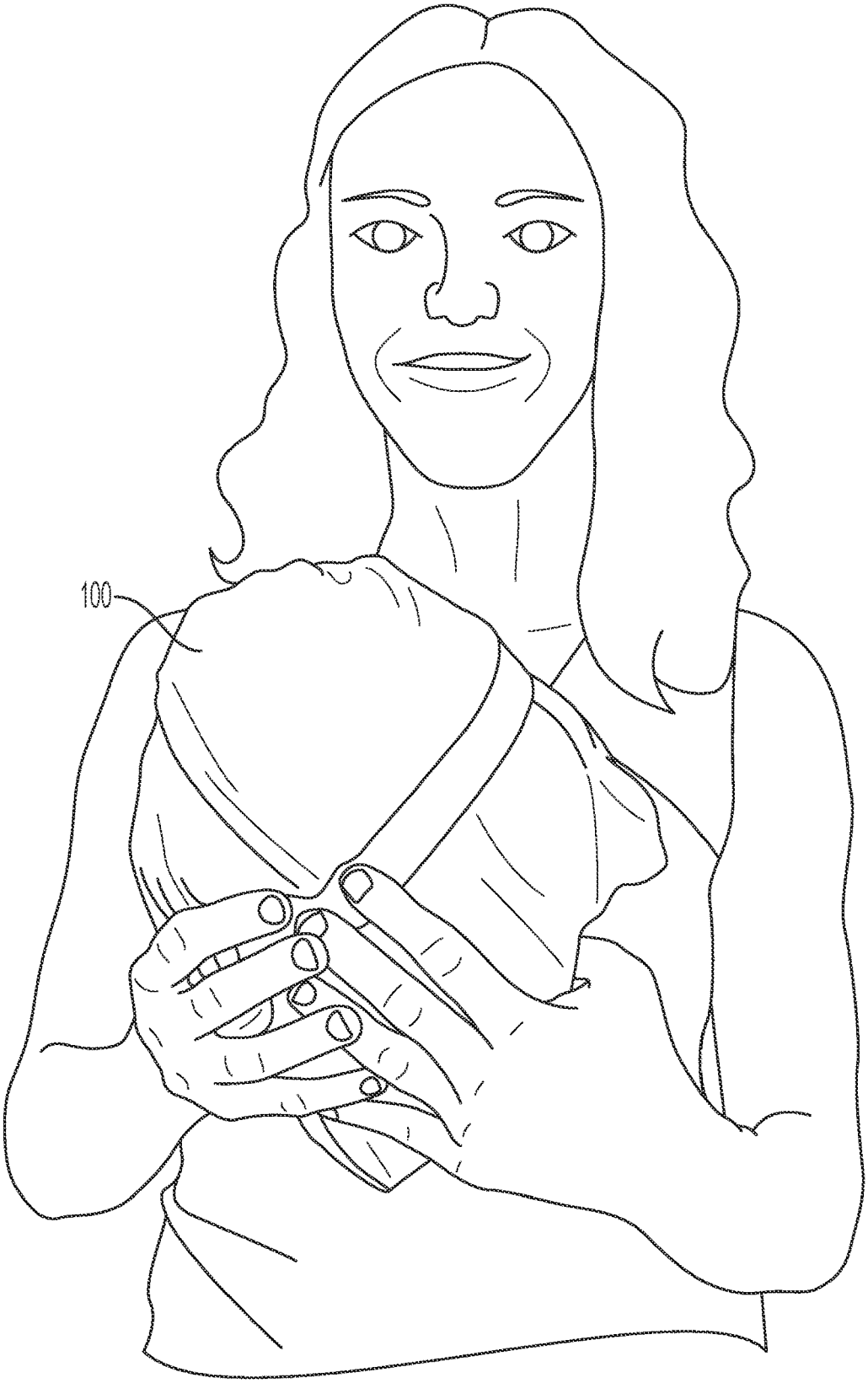

To stow the child carrying system, as shown in FIG. 39C, the user may reach their hand into the carrier portion 102 and grab a hold of the waist belt 110 with their hand. During this motion, the carrier portion 102 serves as a sort of glove for the user's hand as the user grabs hold of the waist belt 110. While continuing to hold the belt, as shown in FIG. 39D, the user pulls their hand back out of the carrier portion 102. This pulls the belt and part of the child carrying system 100 into the carrier portion and frees the user's hand. The user then arranges the remainder of the child carrying system 100 into the pouch until the child carrying system is in a ball as shown in FIG. 39E.

CONCLUSION

Many modifications and other embodiments of the invention will come to mind to one skilled in the art to which this invention pertains having the benefit of the teachings presented in the foregoing descriptions and the associated drawings. For example, as will be understood by one skilled in the relevant field in light of this disclosure, the invention may take form in a variety of different mechanical and operational configurations. Therefore, it is to be understood that the invention is not to be limited to the specific embodiments disclosed herein, and that the modifications and other embodiments are intended to be included within the scope of the appended exemplary concepts. Although specific terms are employed herein, they are used in a generic and descriptive sense only and not for the purposes of limitation.

What is claimed:

1. A child carrying system for carrying a child, comprising:

a carrier portion comprising:

a top portion;

a middle portion having a pair of tabs extending away from a center of the middle portion in a lateral direction;

a pair of adjustment mechanisms, each adjustment mechanism fixedly attached to a respective tab of the pair of tabs; and a bottom portion;

a pair of straps, each strap of the pair of straps having a first end and a second end, wherein:

each first end is fixedly attached proximate a respective top corner of the top portion; and each second end is detachably connected to an adjustment mechanism of the pair of adjustment mechanisms; and a head support configured as a single loop to wrap essentially simultaneously around the pair of straps.

2. The child carrying system of claim 1, further comprising:

printed indicia indicating adjustment settings, each adjustment setting respectively corresponding to an age of the child.

3. The child carrying system of claim 2, further comprising:

a waist belt flexibly connected to the bottom portion along a seam line such that the waist belt can be folded relative to the bottom portion along the seam line; wherein:

the adjustment settings indicate a location to which the waist belt should be folded to fit the child based on the age of the child.

4. The child carrying system of claim 1, wherein the pair of tabs is configured at a vertical location along the carrier portion such that the pair of tabs lies between arms of the child and legs of the child when the child is carried in the child carrying system.

5. The child carrying system of claim 1, wherein each adjustment mechanism comprises a pair of rings configured to:

receive the second end of a strap of the pair of straps;

secure the strap from retracting; and selectively release the strap to allow a wearer to loosen and tighten the strap.

6. The child carrying system of claim 1, wherein the width of each strap of the pair of straps is so dimensioned as to cover shoulders of a user.

7. The child carrying system of claim 1, wherein a length of each strap of the pair of straps is so dimensioned as to permit the respective second end of the strap to lie below a waist of a user when the user is carrying the child in the child carrying system.

8. The child carrying system of claim 1, wherein the pair of straps is configured to be secured by the pair of adjustment mechanisms in:

a first configuration, in which a first strap of the pair of straps secures to a first attachment mechanism of the pair of adjustment mechanisms and a second strap of the pair of straps secures to a second attachment mechanism of the pair of adjustment mechanisms; and a second configuration, in which the first strap secures to the second attachment mechanism and the second strap secures to the first attachment mechanism.

9. The child carrying system of claim 8, wherein:

the child carrying system is configured to carry the child on a rear side of a user in the first configuration; and the child carrying system is configured to carry the child on a front side of the user in the second configuration.

10. The child carrying system of claim 1, wherein the child carrying system is configured to be tightened by pulling on the second end of each strap of the pair of straps.

11. A child carrying system configured to be worn by a user to enable the user to carry a child, the child carrying system comprising:

a carrier portion;

a first strap and a second strap both fixedly attached to the carrier portion;

a head support configured as a single loop to wrap essentially simultaneously around the first strap and the second strap;

a first adjustment mechanism and a second adjustment mechanism both fixedly attached to the carrier portion; and a waist belt; wherein:

the child carrying system is adapted to be donned by the user by:

adjusting the carrier portion based on a size of the child by wrapping the carrier portion around the waist belt;

wrapping the waist belt around a waist of the user;

buckling the waist belt at a back of the user;

securing the first strap to the first adjustment mechanism, the first adjustment mechanism being on an opposite side of the carrier portion in a lateral direction from an attachment point of the first strap;

securing the second strap to the second adjustment mechanism, the second adjustment mechanism being on an opposite side of the carrier portion in the lateral direction from an attachment point of the second strap;

lifting the first strap and the second strap over a head of the user;

inserting a first arm of the user between the first strap and the second strap;

inserting a second arm of the user between the first strap and the second strap; and adjusting the carrier portion by pulling on a free end of the first strap and a free end of the second strap.

12. The child carrying system of claim 11, wherein:

the child carrying system is further adapted to be donned by the user by:

buckling the waist belt at a front of the user;

securing the first strap to the second adjustment mechanism;

securing the second strap to the first adjustment mechanism;

placing the first strap over a first shoulder of the user;

placing the second strap over a second shoulder of the user;

spreading fabric of the first strap over the first shoulder;

spreading fabric of the second strap over the second shoulder; and tying the free end of the first strap to the free end of the second strap.

13. The child carrying system of claim 11, wherein:

the child carrying system is further adapted to be donned by the user by:

separating two rings of the first adjustment mechanism;

pulling on the first strap such that the free end of the first strap advances toward the first adjustment mechanism;

separating two rings of the second adjustment mechanism;

pulling on the second strap such that the free end of the second strap advances toward the second adjustment mechanism;

lifting the first strap and the second strap over the head of the user; and unbuckling the waist belt.

14. The child carrying system of claim 11, wherein:

the head support is configured to moveably engage with the first strap and the second strap; and the child carrying system is further adapted to be donned by the user by:

moving the head support between a lowered configuration and a raised configuration.

15. The child carrying system of claim 11, wherein a bottom edge of the head support is secured to a top edge of the carrier portion.

16. The child carrying system of claim 11, wherein the head support comprises an elastic material.

17. A child carrying system comprising:

a first means for supporting a bottom of a child;

a second means and a third means for transferring a weight of the child to shoulders of a wearer and covering the shoulders;

a fourth means for selectively securing the second means and the third means to the first means; and a fifth means for supporting a head of the child, wherein the fifth means is secured to the first means, essentially simultaneously wraps around the second means and the third means as a single loop, and is adjustable in a vertical direction relative to the first means.

18. The child carrying system of claim 17, wherein the fourth means comprises a pair of rings.

19. The child carrying system of claim 17, wherein indicia of an age are printed on the first means.

20. The child carrying system of claim 17, wherein the fourth means are fixedly attached to the first means by a fabric tab, and the fabric tab permits the fourth means to move in the vertical direction relative to the first means.

* * * * *